US011219317B2

(12) United States Patent
Telford

(10) Patent No.: US 11,219,317 B2
(45) Date of Patent: Jan. 11, 2022

(54) ADJUSTABLE CHILD CARRIER WITH ENHANCED FREEDOM OF MOVEMENT

(71) Applicant: The ERGO Baby Carrier, Inc., Los Angeles, CA (US)

(72) Inventor: Rodney V. Telford, Kula, HI (US)

(73) Assignee: The Ergo Baby Carrier, Inc., Torrance, CA (US)

( * ) Notice: Subject to any disclaimer, the term of this patent is extended or adjusted under 35 U.S.C. 154(b) by 4 days.

(21) Appl. No.: 16/694,641

(22) Filed: Nov. 25, 2019

(65) Prior Publication Data

US 2020/0163466 A1 May 28, 2020

Related U.S. Application Data

(60) Provisional application No. 62/771,450, filed on Nov. 26, 2018, provisional application No. 62/873,549, filed on Jul. 12, 2019.

(51) Int. Cl.

| | |
|---|---|
| ***A47D 13/02*** | (2006.01) |
| ***A45F 3/04*** | (2006.01) |
| ***A47D 13/08*** | (2006.01) |

(52) U.S. Cl.

CPC ..... *A47D 13/025* (2013.01); *A45F 3/047* (2013.01); *A47D 13/086* (2013.01); *A45F 2003/045* (2013.01)

(58) Field of Classification Search

CPC .... A47D 13/086; A47D 13/025; A47D 13/02; A45F 3/047; A45F 2003/045; A41B 13/06

(Continued)

(56) References Cited

U.S. PATENT DOCUMENTS

| | | | |
|---|---|---|---|
| 268,932 | A | 12/1882 | Poirier |
| 576,292 | A | 2/1897 | Vanderburgh |

(Continued)

FOREIGN PATENT DOCUMENTS

| | | |
|---|---|---|
| CA | 1332928 | 11/1994 |
| CA | 2159241 | 9/1995 |

(Continued)

OTHER PUBLICATIONS

Moriguchi Yuko, JP 2014176494 A Google Translation, Sep. 2014 (Year: 2014).*

(Continued)

*Primary Examiner* — Nathan J Newhouse
*Assistant Examiner* — Matthew T Theis
(74) *Attorney, Agent, or Firm* — Erise IP, P.A.

(57) ABSTRACT

A soft-structured child carrier that includes a body panel having a bottom end attached to a bottom portion of the waistband, a first shoulder strap, a second shoulder strap, a first shoulder strap attachment panel attached to the interior side of the body panel away from the side edges of the body panel and a second shoulder strap attachment panel attached to the interior side of the body panel and away from the side edges of the body panel. The first shoulder strap attachment panel provides a first flap that is movable away from the interior surface of the body panel and includes a first lower attachment point for the first shoulder strap. The second shoulder strap attachment panel provides a second flap that is movable away from the interior surface of the body panel and includes a second lower attachment point for the second shoulder strap.

20 Claims, 24 Drawing Sheets

(58) Field of Classification Search
USPC ..... 224/158–161
See application file for complete search history.

(56) References Cited

U.S. PATENT DOCUMENTS 982,376 A 1/1911 MacFarlane
2,212,746 A 8/1940 Nelsen
2,599,474 A 6/1952 Mills
2,994,300 A 8/1961 Grahling
3,097,773 A 7/1963 Cunningham
3,229,873 A 1/1966 Hershman
3,275,373 A 9/1966 Card
3,327,914 A 6/1967 Abram
3,481,517 A 12/1969 Aukerman
3,780,919 A 12/1973 Hansson
3,840,162 A 10/1974 Horenstein et al.
3,871,562 A 3/1975 Grenier
3,964,654 A 6/1976 Wittenberger
4,009,808 A 3/1977 Sharp
D247,199 S 2/1978 Carter
4,139,131 A 2/1979 Hathaway
4,149,687 A 4/1979 Nunemacher
D253,558 S 12/1979 Carter
4,234,229 A 11/1980 Arnold
4,273,215 A 6/1981 Leggett
4,318,502 A 3/1982 Lowe et al.
4,324,430 A 4/1982 Dimas, Jr.
4,333,591 A 6/1982 Case
D266,800 S 11/1982 Kula et al.
4,361,259 A 11/1982 Chanter
4,402,440 A 9/1983 Purtzer et al.
4,434,920 A 3/1984 Moore
4,467,945 A 8/1984 Schaapveld
4,469,259 A 9/1984 Krich et al.
4,479,595 A 10/1984 Opsal
D276,478 S 11/1984 Fallon
4,480,775 A 11/1984 Stanford
4,492,326 A 1/1985 Storm
D277,811 S 3/1985 Moore
4,550,800 A 11/1985 Dietrich
4,579,264 A 4/1986 Napolitano
4,651,366 A 3/1987 Lande et al.
4,666,017 A 5/1987 Zimmerman
4,724,988 A 2/1988 Tucker
4,746,044 A 5/1988 Arvizu
4,765,279 A 8/1988 Klickstein
4,800,629 A 1/1989 Ikeda
4,867,464 A 9/1989 Cook
4,946,119 A 8/1990 Hellhake
4,986,458 A 1/1991 Linday
5,071,047 A 12/1991 Cordisco
5,076,598 A 12/1991 Nauman
D324,607 S 3/1992 Nelson
5,114,059 A 5/1992 Thatcher
D334,253 S 3/1993 Balzarini
5,205,450 A 4/1993 DeRosier
5,205,451 A 4/1993 Manzer
5,224,637 A 7/1993 Colombo
5,240,159 A 8/1993 Gregory
5,246,152 A 9/1993 Dotseth
5,284,279 A 2/1994 Sason et al.
5,325,818 A 7/1994 Leach
D357,800 S 5/1995 Roan et al.
5,490,620 A 2/1996 Bergqvist
D370,996 S 6/1996 Shimura et al.
5,522,528 A 6/1996 Petricola
5,564,612 A 10/1996 Gregory
5,570,823 A 11/1996 Lindy
D377,116 S 1/1997 Shimura et al.
D385,105 S 10/1997 Fair
5,673,828 A 10/1997 Raedel et al.
5,678,739 A 10/1997 Darling et al.
5,690,258 A 11/1997 Kataoka et al.
5,692,655 A 12/1997 Fair et al.
5,699,555 A 12/1997 Schunter
5,725,139 A 3/1998 Smith
D395,161 S 6/1998 Fair et al.
5,772,088 A 6/1998 Nelson
5,791,535 A 8/1998 Roan et al.
D397,867 S 9/1998 Fair et al.
5,799,851 A 9/1998 Wulf et al.
5,813,580 A 9/1998 Fair
5,819,341 A 10/1998 Simantob et al.
5,848,576 A 12/1998 Colaianni
5,848,741 A 12/1998 Fair
5,927,235 A 7/1999 Olaiz
5,934,528 A 8/1999 Higuchi
D414,032 S 9/1999 Howell
5,988,742 A 11/1999 Stevens
6,055,686 A 5/2000 Knight
6,125,792 A 10/2000 Gee
6,155,579 A 12/2000 Eyman et al.
6,164,509 A 12/2000 Gausling et al.
6,179,175 B1 1/2001 Painter
D437,996 S 2/2001 Fair et al.
6,182,873 B1 * 2/2001 Christopher ..... A47D 13/025 224/159
6,257,468 B1 7/2001 Yamazoe et al.
D453,066 S 1/2002 Norman
D455,546 S 4/2002 Norman
6,364,186 B1 4/2002 Gilmour et al.
6,409,060 B2 6/2002 Donine
6,415,969 B1 7/2002 Higuchi
6,443,339 B1 9/2002 Higuchi
6,499,165 B1 12/2002 Morgillo
6,520,391 B2 2/2003 Yen
6,609,642 B2 8/2003 Heinz et al.
D484,685 S 1/2004 Kassai et al.
6,681,973 B2 1/2004 Crumrine
D486,635 S 2/2004 Yagisawa et al.
6,715,651 B2 4/2004 Le Gal
6,722,543 B1 4/2004 Fitzgerald et al.
6,763,983 B2 7/2004 Norman
6,772,925 B2 8/2004 O'Hare
D507,869 S 8/2005 Liistro et al.
D509,056 S 9/2005 Shiraishi et al.
7,073,866 B1 7/2006 Berdahl
7,168,600 B2 1/2007 Hwang
7,204,462 B2 4/2007 Lembo
7,204,468 B2 4/2007 Kintzele
7,255,620 B1 8/2007 Shepherd
7,322,498 B2 1/2008 Frost
7,494,031 B2 2/2009 Kassai et al.
D590,568 S 4/2009 Crutchfield
D597,788 S 8/2009 Ellis
7,766,199 B1 8/2010 Caperon
7,878,587 B1 2/2011 Leach
7,886,946 B2 2/2011 Gray
8,028,871 B2 10/2011 Gray
8,042,869 B2 10/2011 McClintock et al.
8,127,385 B1 3/2012 Goutevenier
8,172,116 B1 5/2012 Lehan et al.
8,272,546 B2 9/2012 Leistensnider
8,408,435 B2 4/2013 Refsum
8,424,732 B1 4/2013 Lehan et al.
8,453,894 B2 6/2013 Jung et al.
8,579,168 B2 11/2013 Zack et al.
8,590,757 B2 11/2013 Frost
8,636,181 B2 1/2014 Gunter et al.
8,701,949 B1 4/2014 Lehan et al.
8,752,739 B2 6/2014 Bergkvist et al.
9,022,260 B2 5/2015 Frost
9,179,758 B2 11/2015 Calilung et al.
9,185,993 B2 11/2015 Telford et al.
9,314,113 B1 4/2016 Lehan et al.
9,357,852 B2 6/2016 Salazar et al.
9,380,887 B2 7/2016 Frost
9,380,888 B2 7/2016 Telford et al.
9,439,515 B2 9/2016 Kim
9,713,391 B2 7/2017 Telford et al.
9,788,664 B2 10/2017 Andren
9,877,595 B2 1/2018 Wang
9,877,596 B2 1/2018 Schaarschmidt
9,955,797 B2 5/2018 Telford et al.

(56) References Cited

U.S. PATENT DOCUMENTS

| | | | | |
|---|---|---|---|---|
| 10,159,357 | B2 | 12/2018 | Telford | |
| 10,172,478 | B2 | 1/2019 | Telford | |
| 10,264,895 | B2 | 4/2019 | Lindeman | |
| 10,271,663 | B2 | 4/2019 | Salazar | |
| 10,426,275 | B2 | 10/2019 | Telford | |
| 10,506,885 | B2 | 12/2019 | Telford et al. | |
| 10,736,436 | B2 | 8/2020 | Telford | |
| 11,026,521 | B2 | 6/2021 | Telford | |
| 11,051,634 | B2 | 7/2021 | Telford | |
| 2002/0011503 | A1 | 1/2002 | Hwang | |
| 2002/0175194 | A1 | 11/2002 | Norman | |
| 2003/0106916 | A1 | 6/2003 | Boone | |
| 2004/0149790 | A1 | 8/2004 | Kassa et al. | |
| 2004/0155078 | A1 | 8/2004 | Hwang | |
| 2004/0238579 | A1 | 12/2004 | Krogh | |
| 2005/0045674 | A1 | 3/2005 | Rehbein | |
| 2005/0067549 | A1 | 3/2005 | Kintzele et al. | |
| 2005/0242136 | A1 | 4/2005 | Moriguchi et al. | |
| 2005/0155995 | A1 | 7/2005 | Lee | |
| 2005/0184114 | A1 | 8/2005 | Hoff et al. | |
| 2005/0279785 | A1 | 12/2005 | Liistro et al. | |
| 2006/0011678 | A1 | 1/2006 | Kassa et al. | |
| 2006/0076373 | A1 | 4/2006 | Labelle et al. | |
| 2006/0130220 | A1 | 6/2006 | Morgan et al. | |
| 2006/0261104 | A1 | 11/2006 | Zambrzycki | |
| 2007/0029356 | A1 | 2/2007 | Moriguchi et al. | |
| 2007/0057003 | A1 | 3/2007 | Keyes | |
| 2008/0047987 | A1 | 2/2008 | Price | |
| 2008/0283561 | A1 | 11/2008 | Pamess | |
| 2010/0025441 | A1 | 2/2010 | Blaney | |
| 2010/0072236 | A1 | 3/2010 | Parness et al. | |
| 2010/0147910 | A1 | 6/2010 | Schachtner | |
| 2010/0187269 | A1* | 7/2010 | Leistensnider | A47D 13/025 224/159 |
| 2010/0308087 | A1 | 12/2010 | Lindbloom | |
| 2010/0308088 | A1 | 12/2010 | Lindblom | |
| 2011/0062195 | A1 | 3/2011 | Jones et al. | |
| 2011/0101051 | A1 | 5/2011 | Pamess | |
| 2011/0163136 | A1 | 7/2011 | Billingham | |
| 2011/0290831 | A1 | 12/2011 | Wang | |
| 2012/0037284 | A1 | 2/2012 | Korbonski | |
| 2012/0043359 | A1 | 2/2012 | Bergkvist et al. | |
| 2012/0205406 | A1 | 8/2012 | Schachtner | |
| 2012/0241487 | A1 | 9/2012 | Zack et al. | |
| 2012/0298702 | A1 | 11/2012 | Jung | |
| 2014/0097215 | A1 | 4/2014 | Caperon | |
| 2014/0167462 | A1 | 6/2014 | Lai et al. | |
| 2014/0284361 | A1 | 9/2014 | Wang | |
| 2015/0069097 | A1 | 3/2015 | Lindblom | |
| 2015/0272342 | A1 | 10/2015 | Schaarschmidt | |
| 2015/0374139 | A1 | 12/2015 | Salazar et al. | |
| 2016/0150893 | A1 | 6/2016 | Salazar et al. | |
| 2016/0316933 | A1* | 11/2016 | Antunovic | A47D 13/025 |
| 2017/0150826 | A1 | 6/2017 | Salazar | |
| 2017/0196374 | A1 | 7/2017 | Chen | |
| 2018/0116426 | A1 | 5/2018 | Telford et al. | |
| 2018/0184813 | A1 | 7/2018 | Salazar | |
| 2018/0199730 | A1 | 7/2018 | Lundh | |
| 2018/0235379 | A1 | 8/2018 | Lindeman et al. | |
| 2018/0296005 | A1 | 10/2018 | Tsai | |
| 2019/0075937 | A1 | 3/2019 | Salazar | |
| 2019/0150633 | A1 | 5/2019 | Flaunty | |
| 2019/0223619 | A1 | 7/2019 | Lindeman | |
| 2019/0380508 | A1 | 12/2019 | Telford et al. | |
| 2020/0077806 | A1 | 3/2020 | Telford | |
| 2020/0268169 | A1 | 8/2020 | Telford | |

FOREIGN PATENT DOCUMENTS

| | | | | |
|---|---|---|---|---|
| CA | 2 240 015 | | 1/2000 | |
| CN | 203873395 | U | 10/2014 | |
| CN | 104411213 | A | 3/2015 | |
| DE | 29519530 | U1 | 4/1996 | |
| DE | 22912951 | U1 | 1/2000 | |
| DE | 20116046 | | 1/2002 | |
| DE | 20 2008 014 412 | U1 | 9/2009 | |
| DE | 202010011906 | | 11/2010 | |
| DE | 202012104318 | | 11/2012 | |
| DE | 202014100616 | U1 | 6/2014 | |
| EP | 0046672 | | 3/1982 | |
| EP | 0437365 | A1 | 7/1991 | |
| EP | 0662292 | | 7/1995 | |
| EP | 0 995 380 | | 10/1998 | |
| EP | 1055382 | | 11/2000 | |
| EP | 1707082 | | 10/2006 | |
| EP | 1765123 | | 6/2011 | |
| EP | 2810587 | A1 | 12/2014 | |
| ES | 251704 | | 10/1980 | |
| FR | 1 545 820 | | 9/1967 | |
| FR | 2 524 288 | | 10/1983 | |
| FR | 2 794 010 | | 5/1999 | |
| FR | 2 794 010 | | 1/2000 | |
| FR | 2806279 | | 9/2001 | |
| FR | 2823655 | A1 | 10/2002 | |
| FR | 2 851 436 | | 8/2004 | |
| GB | 2026848 | A | 8/1978 | |
| GB | 2028633 | | 3/1980 | |
| GB | 2314026 | | 12/1987 | |
| GB | 2260687 | | 4/1993 | |
| JP | 53-155443 | | 12/1978 | |
| JP | 54-108131 | | 7/1979 | |
| JP | 58-95766 | | 6/1983 | |
| JP | 59-21273 | | 2/1984 | |
| JP | 63-187956 | | 12/1988 | |
| JP | 1-72158 | | 5/1989 | |
| JP | 2-124107 | | 5/1990 | |
| JP | 09-099842 | | 10/1995 | |
| JP | 9-121987 | | 5/1997 | |
| JP | 09-173185 | | 8/1997 | |
| JP | 10-313929 | | 2/1998 | |
| JP | 10-108764 | | 4/1998 | |
| JP | 11046938 | | 2/1999 | |
| JP | U3073766 | | 9/2000 | |
| JP | P2001-104115 | | 4/2001 | |
| JP | 2003225119 | | 8/2003 | |
| JP | 2005-131146 | | 10/2003 | |
| JP | 2005-185426 | | 12/2003 | |
| JP | 2004000687 | | 1/2004 | |
| JP | 2004154468 | | 6/2004 | |
| JP | 2005052584 | | 3/2005 | |
| JP | 2005118472 | | 5/2005 | |
| JP | 2005-288107 | | 10/2005 | |
| JP | 2005-312826 | | 11/2005 | |
| JP | 2013-118900 | | 12/2011 | |
| JP | 2012-187352 | | 10/2012 | |
| JP | 2012524603 | | 10/2012 | |
| JP | 2014176494 | A * | 9/2014 | A47D 13/025 |
| JP | 2016512124 | A | 4/2016 | |
| KR | 2000508690000 | | 10/2000 | |
| KR | 1020020008534 | | 1/2002 | |
| KR | 2003126950000 | | 4/2003 | |
| KR | 2003158200000 | | 6/2003 | |
| KR | 2003182590000 | | 6/2003 | |
| KR | 2003201940000 | | 7/2003 | |
| KR | 20-0324019 | | 8/2003 | |
| KR | 2003337880000 | | 11/2003 | |
| KR | 10-2004-0064749 | | 7/2004 | |
| KR | 10-2007-0039806 | | 4/2007 | |
| KR | 20-2009-0008715 | | 8/2009 | |
| KR | 20-0447518 | | 1/2010 | |
| KR | 20-2010-0010120 | | 10/2010 | |
| KR | 20-2011-0005263 | | 5/2011 | |
| KR | 200459659 | Y1 | 4/2012 | |
| KR | 20-0477837 | | 7/2015 | |
| WO | WO 199505952 | A1 | 3/1995 | |
| WO | WO 200189978 | A1 | 11/2001 | |
| WO | WO 2009034233 | | 3/2009 | |
| WO | WO 2010123447 | | 10/2010 | |
| WO | WO 2011011158 | | 1/2011 | |
| WO | WO 2011071441 | | 6/2011 | |
| WO | WO 2012079787 | | 6/2012 | |
| WO | WO 2014033134 | A1 | 3/2014 | |

(56) References Cited

FOREIGN PATENT DOCUMENTS

| | | |
|---|---|---|
| WO | WO 2014160355 A1 | 10/2014 |
| WO | WO 2015053696 | 4/2015 |
| WO | WO 2017095752 A1 | 6/2017 |

OTHER PUBLICATIONS

Office Action (with English translation) for Korean Patent Application No. 10-2020-7029046, dated Oct. 22, 2020, 11 pgs.
Examination Report issued for European Patent Application No. 17864576.8, dated Nov. 16, 2020, 5 pgs.
Office Action (with English translation) for Chinese Patent Application No. 201680071536.X, dated Nov. 16, 2020, 16 pgs.
Office Action for U.S. Appl. No. 10/937,193, dated Aug. 14, 2007, 9 pgs.
Office Action for U.S. Appl. No. 11/949,324, dated Oct. 6, 2009, 9 pgs.
Office Action for U.S. Appl. No. 11/949,324, dated Apr. 28, 2010, 9 pgs.
International Search Report and Written Opinion for PCT Application No. PCT/US2004/029614, completed on Feb. 11, 2005, dated Mar. 3, 2005, 9 pgs.
International Preliminary Report on Patentability for PCT/US2004/029614, dated Mar. 13, 2006, 7 pgs.
Examination Report for European Application No. 04 783 725.7, dated Sep. 21, 2007, 3 pgs.
Examination Report for European Application No. 04 783 725.7, dated Sep. 9, 2008, 4 pgs.
Examination Report for European Application No. 04 783 725.7, dated Sep. 10, 2009, 3 pgs.
Examination Report for European Application No. 04 783 725.7, dated Dec. 21, 2009, 5 pgs.
Examination Report for European Application No. 04 783 725.7, dated Jun. 1, 2010, 6 pgs.
Office Action for U.S. Appl. No. 11/949,324, dated Oct. 4, 2010, 10 pgs.
Office Action for U.S. Appl. No. 11/949,324, dated Jul. 18, 2011, 14 pgs.
Notice of Opposition filed on Mar. 13, 2012, against European Patent No. EP1765123B1, 213 pgs.
Declaration of Judy Petterson regarding BabyTrekker with enclosures 1 and 2, dated May 26, 2011, 18 pgs.
International Search Report and Written Opinion for International Application No. PCT/US2014/026378, dated Jul. 21, 2014, 10 pgs.
Office Action for U.S. Appl. No. 14/685,235, dated May 22, 2015, 8 pgs.
International Preliminary Report on Patentability (Ch. I) for International Patent Application No. PCT/US2014/026378, dated Sep. 15, 2015, 6 pgs.
Office Action for U.S. Appl. No. 14/862,933, dated Oct. 30, 2015, 5 pgs.
Office Action for U.S. Appl. No. 14/685,235, dated Nov. 27, 2015, 8 pgs.
International Search Report and Written Opinion for International Patent Application No. PCT/US2016/026626, dated Jun. 30, 2016, 7 pgs.
Office Action for U.S. Appl. No. 15/177,114, dated Aug. 24, 2016, 10 pgs.
Petition for Inter Partes Review of U.S. Pat. No. 9,022,260, 94 pgs.
Petition for Inter Partes Review of U.S. Pat. No. 8,590,757, 100 pgs.
Baby Matey Soft Baby Carriers Literature, Kidpower Unlimited Inc., Toronto, ON, CA, 10 pgs.
BabyTrekker Instruction Manual, Petterson Infant Products, Flin Flon, MB, CA, 1998, 16 pgs.
Declaration of Richard N. Hinrichs, Ph.D and Appendix A thereto for Petition for Inter Partes Review of U.S. Pat. No. 9,022,260, 158 pgs.
Declaration of Richard N. Hinrichs, Ph.D and Appendix A thereto for Petition for Inter Partes Review of U.S. Pat. No. 8,590,757, 155 pgs.
Declaration of Shari Hall White and Appendix A thereto, Jun. 29, 2016, 12 pgs.
Declaration of Judy Pettersen and Exhibits thereto, Aug. 14, 2016, 50 pgs.
Nov. 24, 1998 Letter from U.S. ITC regarding U.S. tariff classification of babyTrekker, 2 pgs., retrieved from http://www.faqs.org/rulings/rullngs1998NYD83381.html).
Feb. 2002 forum post from "USA", 2 pgs., retrieved from http://windsorpeak.com/vbulletin/showthread.php?185543-baby-bjorn-and-large-husband).
U.S. Appl. No. 75/057,147 Documents, U.S. Patent and Trademark Office, 44 pgs.
Complaint, *The Ergo Baby Carrier, Inc.* v. *BOBA Inc.*, Case No. 2:15-cv-08946, In the United States District Court for the Central District of California, filed Nov. 17, 2015, 7 pgs.
Blaffer Hardy, S., Family Planning Primate Style, Mother Nature—A History of Mothers, Infants and Natural Selection, 2000, pp. 197-204.
Jones, Sandy, Back Packs and Soft Carriers, Guide to Baby Products, Consumers Digest, 1998, Ch. 4, pp. 33-40.
Longe, Jaqueline L., Baby Carrier, How Products are Made: An Illustrated Guide to Product Manufacturing, 2001, vol. 6, pp. 22-26.
Pelot, Ron P., et al., "Background Document for an Advanced Personal Load Carriage System for the Canadian forces", Ergonomics Research Group, Queen's University, Kingston, ON, CA, Mar. 29, 1995, 148 pgs.
Brewer, Gail S., A Quick Guide for Starting Right, Baby Carriers, Right from the Start: Meeting the Challenges of Mothering Your Unborn and Newborn Baby, 1981, pp. 159-160.
Salter, R.B., "Etiology, Pathogenesis and Possible Prevention of Congenital Dislocation of the Hip", The Canadian Medical Association Journal, vol. 98, No. 20, May 18, 1968.
Jones, Sandy, Getting Around, Guide to Baby Products, Consumers Digest, 2001, pp. 41, 55-60, 157-160, 199-201.
Gilligan, Shannon, Best for Baby: A Selective Consumer's Guide to Products and Services from Infancy to Preschool, 1988, pp. 41-46.
O'Donohue, Rosaleen, Baby Rides the Asian Way, The Australian Women's Weekly, Jul. 23, 1969 at p. 9.
Doan, Marlyn, Children's Gear, Starting Smail in the Wilderness, The Sierra Club Outdoors Guide for Families, 1979, at pp. 161-167.
Guide to the Ann Moore Innovative Lives Presentation, 1999, Archives Center, National Museum of American History, Smithsonian Institute, Aug. 2010, 12 pgs., retrieved from http://amhistory.si.edu/archives/AC0706.pdf).
Warren, A.J., "The Mom Who Invented the Snugli", CBS News, Mar. 6, 2001, 4 pgs., retrieved from http://www.cbsnews.com/news/the-mom-who-invented-the-snugli/.
Bach, John, "Practical Inventor Influenced American Culture", University of Cincinnati UC Magazine, Aug. 2010, 6 pgs.
"Eager Market for Baby Carrier" The Gazette, Montreal May 15, 1984: C-19 (accessed at https://news.google.com/newspapers?id=zA0vAAAAIBAJ&sjid=mqUFAAAAIBAJ&pg=1454%2C2468510).
Roseman, E., et al., Baby Carriers, The Canadian Parents' Sourcebook, 1986, at pp. 149-153.
Rafelman, Rachel, The Portable Baby, Baby Gear for the First Year, 1997, pp. 40-41.
Laury, Jean Ray, Baby Carrier, A Treasury of Needlecraft Gifts for the New Baby, 1976, pp. 90-93.
Byrnes, E.A., "A Blue-Jean 'Person Pack': Toting the Tot on the Trail", The Mother Earth News, No. 75, May/Jun. 1982, p. 164.
The Kozy Family, 16 pgs., retrieved from Web Archives of http://www.kozycarrier.homestead.com/.
Packababy, 17 pgs., retrieved from Web Archives of http://www.packababy.com/.
Welcome to Sutemigear, 10 pgs., retrieved from Web Archives of http://sutemigear.com/.
"The Pick of the Extended Trek Packs" Backpacker, Oct. 1997, vol. 23, pp. 58-69.

(56) References Cited

OTHER PUBLICATIONS

Jones, Sandy, Back Packs and Soft Carriers, Guide to Baby Products, Consumers Reports, 1991, pp. 9-15.
Baby Trekker—Advantages, 2 pgs., retrieved from https://web.archive.org/web/20000708141511/http://www.babytrekker.com/advantages.htm.
Evenflo Soft Carriers, 2 pgs., retrieved from https://web.archive.org/web/20010331081113/http://www.evenflo.com/ep/furniture/softcarrier.phtml.
Newspaper ad for Napsak Soft Baby Carrier by Evenflow, The Pittsburgh Press (Pittsburgh, Pennsylvania), Thursday, Dec. 12, 1991, p. 57.
Pelot, R.P. et al., "A Static Biomechanical Load Carriage Model", RTO HFM Specialist Meeting on Soldier Mobility Innovation in Load Carriage System Design and Evaluation, Kingston, CA, Jun. 27-29, 2000, 13 pgs.
Knapik, J., "Physiological, Biomechanical and Medical Aspects of Soldier Load Carriage", RTO HFM Specialist Meeting on Soldier Mobility Innovation in Load Carriage System Design and Evaluation, Kingston, CA, Jun. 27-29, 2000, 20 pgs.
Holewijn, M., "Physiological Strain Due to Load Carrying", European Journal of Applied Physiology, 1990, 61:237-245.
Frame Carriers, 1 pg., retrieved from https://web.archive.org/web/20000526184535/http://www.evenflo.com/ep/furniture/framecarrier.phtml.
Aronson, D.D. et al., "Developmental dysplasia of the hip", Pediatrics, Aug. 1994, vol. 94(2), 202, 11 pgs.
Hodgson, A.R., "Congenital Dislocation of the Hip", British Medical Journal, Sep. 7, 1961, p. 647.
Leveau, Barney F., et al., "Developmental biomechanics," Physical Therapy, 64.12, 1984:1878.
The Age, Mar. 5, 1970 at p. 14.
Certified Translation of "What parents should watch out for when buying babywearing carriers" by Kirkiliones, retrieved from http://web.archive.org/web/20010719033113/http://www.continuu m-concept.de/liedkir.htm).
Kirkilionis, E., Das Tragen des Säuglings im Hüftsitz—eine spezielle Anpassung des menschlichen Traglings. Zoologische Jahrbücher, 1992, 96 (3), 395-415.
Kirkilionis, E., Worauf Eltern beim Kauf von Tragehilfen für Säuglinge achten sollten, 1994.
Kirkilionis, E., Die Grundbedürfnisse des Säuglings und deren medizinische Aspekte—dargestellt und charakterisiert am Jungentypus Tragling. notabene medici, 1997, 27 (2), 61-66, 27 (3), 117-121.
Kirkilionis, E., Ein Baby will gatragen sein, 1999, 171 pgs.
"The Beginning" Ergo Baby Blog, 13 pgs., retrieved from https://blog.ergobaby.com/2011/02/the-beginning/).
REI—Kelty Kangaroo Child Carrier, 2 pgs., retrieved from https://web.archive.org/web/19970222133805/http://rei.com/shopping/store3/CAMPING/BABY_CARRIERS/BABY_CARRIERS/b ud/617589.html.
Tough Traveler, Kidsystems, 3 pgs., retrieved from http://web.archive.org/web/20011106132550/http://www.toughtraveler.com/cat7.html.
Mackie, H.W. et al., "The effect of simulated school load carriage configurations on shoulder strap tension forces and shoulder interface pressure", Applied Ergonomics, 36, 2005, pp. 199-206.
Hinrichs, et al., "An Investigation of the Inertial Properties of Backpacks Loaded in Various Configurations", United States Army Natick, Research and Development Laboratories, Natick, MA, 1982, 75 pgs.
Nelson, et al., "Effects of Gender, Load, and Backpack on Easy Standing and Vertical Jump Performance vol. II", United States Army Natick, Research and Deveiopment Laboratories, Natick, MA, Mar. 1982, 77 pgs.
Martin, et al., "Effects of Gender, Load, and Backpack on the Temporal and Kinematic Characteristics of Walking Gait vol. III", United States Army Natick, Research and Development Laboratories, Natick, MA, Apr. 1982, 77 pgs.
Martin, et al., "A Mathematical Model of the Inertial Properties of a Carrier-Backpack System vol. IV", United States Army Natick, Research and Development Laboratories, Natick, MA, May 1982, 89 pgs.
Definition of "flexed", Random House Websters Unabridged Dictionary, Oct. 1999, Second Edition, p. 733.
Rose, Marion, Baby Carriers—Cultural History, Aware Parenting, Dec. 8, 2006, 11 pgs., retrieved from http://awareparenting.blogspot.com/2006/12/baby-carriers-cultural-history.html.
European Search Report for European Application No. 14773586.4, dated Oct. 16, 2016, 9 pgs.
International Search Report and Written Opinion for International Patent Application No. PCT/US2016/059534, dated Jan. 3, 2017, 8 pgs.
Office Action for Chinese Patent Application No. 201480023993.2, dated Jan. 11, 2017, 20 pgs.
Holewijn, Michael, "Physiological Strain Due to Load Carrying," European Journal of Applied Physiology and Occupational Physiology, Feb. 1990, 10 pgs.
BabyTrekker Instruction Manual, Pettersen Infant Products, Canada, 1998, 16 pgs.
BabyTrekker Instruction Manual, Pettersen Infant Products, Canada, 16 pgs.
Casses, R., "Infant Carriers and Spinal Stress," <<http://continuum-concept.org/reading/spinalstress.html>>, Jun. 16, 2002, 3 pgs.
Jones, S., "Guide to Baby Products," Consumer Reports, Completely Revised Seventh Edition, 2001, 21 pgs.
<<http://www.kelty.com/Kelty/index.cfm?fuseaction=Kids.ShowProduct&type=carrier&ID=12>>, Aug. 5, 2002, 1 page.
"Kwik Sew," Pattern 1046, Kwik Sew Pattern Co., Inc., Minneapolis, MN, 8 pgs.
Declaration of Judy Pettersen regarding BabyTrekker, May 26, 2011, 18 pgs.
"The Baby Trekker Product Info," <<http://www.babytrekker.com/product.htm>>, Jun. 10, 2002, 1 page.
"The Baby Trekker Testimonials," <<http://www.babytrekker.com/testimonials.htm>>, Dec. 21, 2001, 4 pgs.
"The Baby Trekker Testimonials," <<http://www.babytrekker.com/testimonials.htm>>, Sep. 16, 2002, 4 pgs.
"Baby/Toddler Sling," <<http://www3.telus.net/public/aa83106/Sling/sling.html>>, Nov. 19, 2003, 5 pgs.
"First Journey Advantages," <<http://www.first-journey.com/advantage1pics/advantages1.html>>, Dec. 14, 2002, 1 page.
"First Journey Advantages," <<http://www.first-journey.com/advantage2pics/advantages2.html>>, Dec. 14, 2002, 1 page.
"First Journey Instructions," <<http://www.first-journey.com/instructions/instructions>>, Dec. 14, 2002, 1 page.
"First Journey Photos & Quotes," <<http://www.first-journey.com/photosandquotes/photos>>, Dec. 14, 2002, 2 page.
First Journey Brochure, <<www.first-journey.com>>, 2002, 2 pgs.
<<http://koti.welho.com/skoivune/sakara/english/about/index.html>>, Apr. 30, 2003, 2 pgs.
<<http://koti.welho.com/skoivune/sakara/english/index.html>>, Jun. 24, 2003, 2 pgs.
<<http://koti.welho.com/skoivune/sakara/english/guide/index.html>>, Jun. 28, 2003, 1 page.
<<http://koti.welho.com/skoivune/sakara/english/guide/ohje2.html>>, May 1, 2003, 1 page.
<<http://koti.welho.com/skoivune/sakara/english/guide/ohje3.html>>, May 1, 2003, 1 page.
<<http://koti.welho.com/skoivune/sakara/ohje/ohje4.html>>, May 2, 2003, 1 page.
<<http://koti.welho.cem/skoivune/sakara/ohje/ohje6.html>>, May 29, 2003, 1 page.
<<http://koti.welho.com/skoivune/sakara/ohje/ohje7.html>>, May 9, 2003, 1 page.
<<http://koti.weiho.com/skoivune/sakara/english/order/index.htmi>>, Apr. 30, 2003, 1 page.
<<http://koti.weiho.com/skoivune/sakara/index2.html>>, Jun. 20, 2003, 2 pgs.
<<http://koti.weiho.com/skoivune/sakara/sakarat/index.html>>, Apr. 30, 2003, 2 pgs.

(56) References Cited

OTHER PUBLICATIONS

Weego Soft Baby Carrier, Instructions for Use, Weego Babytragesacke, Berlin, DE, 4 pgs.
<<http://www.weego.com/coinf.html>>, Aug. 6, 2002, 2 pgs.
<<http://www.weego.com/product.html>>, Dec. 11, 2001, 1 page.
<<http://www.weego.com/fabnc.html>>, Nov. 2, 2001, 2 pgs.
<<http://www.weego.com/preem.html>>, Aug. 6, 2002, 2 pgs.
<<http://www.weego.com/acatalog/ool.html>>, Jun. 5, 2002, 3 pgs.
<<http://www.weego.de/024.htm>>, Aug. 12, 2003, 1 page.
<<http://www.weego.de/english/024.htm>>, Apr. 23, 2004, 1 page.
<<http://www.weego.de/english/ortho.htm>>, Jun. 1, 2004, 1 page.
<<http://www.weego.de/english/design.htm>>, Mar. 24, 2004, 1 page.
<<http://www.weego.de/english/interaktiv.htm>>, Jul. 3, 2004, 1 page.
<<http://www.weego.de/english/trageposition.htm>>, Apr. 23, 2004, 1 page.
"6 in One Rider," Infantino, LLC, San Diego, California, 2002, 1 page.
Assorted Photos, U.S. Appl. No. 60/501,396, filed Sep. 10, 2003, 3 pgs.
Wormleighton, A., "Baby Gifts: To Sew, Applique, Crochet and Knit," Copyright Marshall Cavendish Limited, 1998, 13 pgs.
"Baby Pack Baby Carrier," <<http://www.beginnings.org/shop/buikrugdragers_babypack.htm>>, Feb. 4, 2002, 1 page.
"Baby Trekker Instruction Sheet," 2 pgs.
Constance, S., "Backpacking the Baby," Sydney Morning Herald, Dec. 1, 1998, 3 pgs.
File History for U.S. Appl. No. 14/685,235, filed Apr. 13, 2015, 460 pgs.
"Chinese Baby Carrier," <<http://portebebe.free.fr>>, Jun. 2002, 7 pgs.
Coff, H., "Cut Scheduling for Optimum Fabric Utilization in Apparel Production," Georgia Institute of Technology, Nov. 1976, 141 pgs.
"Baby Matey, Soft Baby Carriers," Copyright Kidpower Unlimited Inc., 4 pgs.
"Theodore Bean Infants & Toddlers Carriers & Accessories," Theodore Bean Adventure Company Inc., 2000, 16 pgs.
"Clinical Practice Guideline: Early Detection of Developmental Dysplasia of the Hip," American Academy of Pediatrics vol. 105, No. 4, Apr. 2000, 10 pgs.
File History for European Patent Application No. 04783725.7, filed Sep. 10, 2004, 693 pgs.
"First Journey Visite Guidée," Pettersen Infant Products, www.first-journey.com, 2004, 2 pgs.
"First Journey Tour Guide," Pettersen Infant Products, www.first-journey.com, 2002, 2 pgs.
"Graco Soft Carrier Owner's Manual, Model 5070 Series," Graco Children's Products, Inc., 1999, 7 pgs.
Jones et al., "Guide to Baby Products," Consumer Reports Books, Fourth Edition, Dec. 1995, 10 pgs.
Harman et al., "The Effects of Backpack Weight on the Biomechanics of Load Carriage," Military Division, U.S. Army Research Institute of Environmental Medicine, May 3, 2000, 72 pgs.
"In & Out Carrier Instructions," Hauck Fun for Kids, 2003, 3 pgs.
"In & Out Carrier Instructions," Hauck Fun for Kids, Aug. 2003, 3 pgs.
"Wearing Your Baby," <<http://wearingyourbaby.co.nz/history>>, 2014, 11 pgs.
Longe, J., "How Products are Made: An Illustrated Guide to Product Manufacturing," 2001, vol. 6, 8 pgs.
"GVP Gear G4," <<http://www.gvpgear.com/g4.asp>>, Jun. 2, 2002, 3 pgs.
"Backpack Tips," <<http://backpacking.net/gearpack-tips.html>>, Jun. 2, 2002, 6 pgs.
"Make Your Own G4 Pack," <<http://www.gvpgear.com/make_your_own.asp>>, Jun. 2, 2002, 17 pgs.
King, F.H, "Farmers of forty Centuries," Copyright 2002 Blackmask Online, www.blackmask.com, 118 pgs.
"Worauf Eitem beim Kauf von Tragehilfen fuer Sauglinge achten sollten"—Things parents shopping for infant carriers should look out for, <<http://www.continuum-concept.de/liedkir.htm>>, Jul. 19, 2001, 4 pgs.
"Lifter Baby Carrier," <<http://www.beginnings.org/shop/buikheuprugdragers_lifter.htm>>, Jun. 19, 2002, 2 pgs.
"Ultralight Pack," <<http://www.backpacking.net/makegear/gvp-pack/>>, Mar. 1, 2003, 29 pgs.
Martin, J. and Hooper, R., "Military Load Carriage: A Novel Method of Interface Pressure Analysis," RTO HFM Specialists' Meeting on "Soldier Mobility: Innovations in Load Carriage System Design and Evaluation," Jun. 27-29, 2000, 9 pgs.
"Miguel Inspired Originals," <<http://miguelinspired.com/about.html>>, Oct. 30, 2005, 2 pgs.
"Miguel Inspired Originals," <<http://miguelinspired.com/gpage2.html>>, Oct. 30, 2005, 5 pgs.
"Miguel Inspired Originals," <<http://miguelinspired.com/gpage.html>>, Oct. 30, 2005, 2 pgs.
"Miguel Inspired Originals." <<http://miguelinspired.com/gpage3.html>>, Oct. 30, 2005, 1 page.
"The Australian Women's Weekly," vol. 37, No. 8, Jul. 23. 1969, 80 pgs.
"For Shane Gould Innes—Motherhood is a Mind," The Australian Women's Weekly, <<National library of Australia—http://nla.gov.au/nla-news-page5623013>>, Oct. 11, 1978, 1 page.
". . . Blowing Experience," The Australian Women's Weekly, <<National library of Australia—http://nla.gov.au/nla-news-page5623014>>, Oct. 11, 1978, 1 page.
Cessnock Eagle and South Mattland Recorder, vol. 32, No. 4162, Jun. 22, 1944, <<National library of Australia—http://nla.gov.au/nla-news-page10625124>>, 1 page.
File History for U.S. Appl. No. 10/937,193, filed Sep. 9, 2004, 135 pgs.
"Porte-bébé chinois," <<http://portebebe.free.fr/>>, Jun. 5, 2002, 6 pgs.
U.S. Appl. No. 60/501,396, filed Sep. 10, 2003, 9 pgs.
"Device for Worn Baby," Patent Translate Description of Russian Application No. RU12646, 3 pgs.
Santa Cruz Sentinel, <<https://www.newspapers.com/image/71319712>>, Jul. 26, 1987, 1 page.
Krantz, L. and Ludman-Exley, S., "The Best of Everything for Your Baby," Copyright 2000 by Prentice Hall, Inc., 18 pgs.
"Home Watch," The Sydney Morning Herald, <<https://www.newspapers.com/image/123957115>>, Jan. 10, 1993, 1 page.
Chancellor, N., "It's a Shoulder Style," The Sydney Morning Herald, <<https://www.newspapers.com/image/123869066>>, Jun. 24, 1947, 1 page.
Constance, M., "Backpacking the Baby," The Sydney Morning Herald, <<https://www.newspapers.com/image/120542968>>, Dec. 1, 1988, 1 page.
Gebrauchsanweisung (User's Manual), Weego Baby Carrier, 4 pgs.
"Why Choose the Wilkinet?," <<http://www.wilkinet.co.uk/WhyChoose.asp>>, Apr. 17, 2003, 2 pgs.
Wilkinet—FAQ, <<http://www.wilkinet.co.uk/FAQs.asp>>, Feb. 17, 2003, 3 pgs.
Wilkinet—History of the Wilkinet Baby Carrier, <<http://www.wilkinet.co.uk/History.asp>>, Feb. 17, 2003, 3 pgs.
Wilkinet—Reviews and Testimonials, <<http://www.wilkinet.co.uk/ReviewsParents.asp>>, Feb. 18, 2003, 2 pgs.
Wilkinet—Reviews and Testimonials, <<http://www.wilkinet.co.uk/ReviewsPress.asp>>, Feb. 18, 2003, 2 pgs.
Wilkinet—Product Views, <<http://www.wilkinet.co.uk/BabyCarriers.asp>>, Feb. 17, 2003, 2 pgs.
Wilkinet—Instructional Videos, <<http://www.wilkinet.co.uk/Videos.asp>>, Feb. 18, 2003, 2 pgs.
Appendix A: Baby Matey Non-Patent Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix BB: Consumer Reports Guide to Baby Products by Sandy Jones, published in 2001 ("Guide to Baby Products") Invalidity Chart, *The Ergo Baby Carrier, Inc.* v. *BOBA Inc.*, Case No.

(56) References Cited

OTHER PUBLICATIONS

2:15-cv-08946, In the United States District Court for the Central District of California, Jul. 15, 2016, 11 pgs.
Appendix AAA: Japanese Pub. No., S54-108131 ("The '131 Patent") Invalidity Chart, *The Ergo Baby Carrier, Inc.* v. *BOBA Inc.*, Case No. 2:15-cv~08946, In the United States District Court for the Central District of California, Jul. 15, 2016, 11 pgs.
Appendix B: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix BB: U.S. Pat. No. 3,780,919 ("Hansson") Invalidity Chart, *The Ergo Baby Carrier. Inc.* v. *BOBA Inc.*, Case No. 2:15-cv-08946, In the United States District Court for the Central District of California, Jul. 15, 2016, 4 pgs.
Appendix BBB: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix C: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix CC: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix CCC: DIY Baby Sling System Invalidity Chart, *The Ergo Baby Carrier, Inc.* v. *BOBA Inc.*, Case No. 2:15-cv-08946, In the United States District Court for the Central District of California. Jul. 15, 2016, 11 pgs.
Appendix D: babyTrekker Instruction Manual copyright date stamped 1998 ("1998 babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix DD: Kelty Kangaroo Invalidity Chart, *The Ergo Baby Carrier, Inc.* v. *BOBA Inc.*, Case No. 2:15-cv-08946. In the United States District Court for the Central District of California. Jul. 15, 2016, 7 pgs.
Appendix DDD: Kozy System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix E: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix EE: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix EEE: Packababy System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix F: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix FF: "Physicological, Biomechanical and Medical Aspects of Soldier Load Carriage" by Joseph Knapik, Presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix FFF: Sakara System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix G: First Journey System Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix GG: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix GGG: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix H: French Patent Pub. No. 2795010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix HH: "A Static Biomechanical Load Carriage Model" by R.P. Peiot et al., Presented in Jun. 2000 ("Peiot") invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix HHH: Casses Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix I: U.S. Pat. No. 4,986,458 ("Linday") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix II: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 7 pgs.
Appendix III: U.S. Pat. No. 6,182,873 ("Christopher") Invalidity Chart, *The Ergo Baby Carrier, Inc.* v. *BOBA Inc.*, Case No. 2:15-cV-08946, In the United States District Court for the Central District of California, Jul. 15, 2016, 2 pgs.
Appendix J: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix JJ: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix JJJ: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix K: "A Blue-Jean Person Pack." by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix KK: Weego System Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix KKK: U.S. Pat. No. 5,848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix L: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix LL: U.S. Pat. No. 6,257,468 ("Yamazoe") Invalidity Chart, *The Ergo Baby Carrier, Inc.* v. *BOBA Inc.*, Case No.

(56) References Cited

OTHER PUBLICATIONS

2:15-cv-08946, In the United States District Court for the Central District of California, Jul. 15, 2016, 4 pgs.
Appendix LLL: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix M: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix MM: Baby Matey Literature as Cited on the Face of U.S. Pat. No. 4,986,458 ("Baby Matey Literature") invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix MMM: U.S. Pat. No. 3,780,919 ("Hansson") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix N: Japanese Pub. No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix NN: Baby Matey System Invalidity Chart, *The Ergo Baby Carrier, Inc.* v. *BOBA Inc.*, Case No. 2:15-cv-08946, In the United States District Court for the Central District of California, Jul. 15, 2016, 22 pgs.
Appendix NNN: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix O: Japanese Patent Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of Califomnia, Jul. 15, 2016, 13 pgs.
Appendix OO: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OOO: Kelty Kangaroo Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix P: U.S. Pat. No. 4,009,808 ("Sharp") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix PP: babyTrekker Instruction Manual copyright date stamped 1998 ("1998 babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix PPP: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix Q: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix QQ: babyTrekker Instruction Manual ("babyTrekker Manual") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix QQQ: "Physiological, Biomechanical and Medical Aspects of Soldier Load Carriage" by Joseph Knapik, presented in Jun. 2000 ("Knapik") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Appendix R: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix RR: babyTrekker System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix RRR: U.S. Pat. No. 4,434,920 ("Moore") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix S: Kozy System Invalidity Chart, *The Ergo Baby Carrier, Inc.* v. *BOBA Inc.*, Case No. 2:15-cv-08946, In the United States District Court for the Central District of California. Jul. 15, 2016, 18 pgs.
Appendix SS: First Journey System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SSS: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix T: Packababy System Invalidity Chart, *The Ergo Baby Carrier, Inc.* v. *BOBA Inc.*, Case No. 2:15-cv-08946, In the United States District Court for the Central District of California, Jul. 15, 2016, 19 pgs.
Appendix TT: French Patent Pub. No. 2794010 ("Ducruet") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix TTT: Pony Ride Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix U: Sakara System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix UU: U.S. Pat. No. 4,986,458 ("Linday") Invalidity Chart, *The Ergo Baby Carrier, Inc.* v. *BOBA Inc.*, Case No. 2:15-cv~08946, In the United States District Court for the Central District of California, Jul. 15, 2016, 15 pgs.
Appendix UUU: U.S. Pat. No. 5,114,059 ("Thatcher") Invalidity Chart, *The Ergo Baby Carrier, Inc.* v. *BOBA Inc.*, Case No. 2:15-cv-08946, In the United States District Court for the Central District of California, Jul. 15, 2016, 3 pgs.
Appendix V: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix VV: U.S. Pat. No. 4,469,259 ("Krich") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix VVV: Weego System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix W: Casses Invalidity Chart, *The Ergo Baby Carrier, Inc.* v. *BOBA Inc.*, Case No. 2:15-cv-08946, In the United States District Court for the Central District of California, Jul. 15, 2016, 6 pgs.
Appendix WW: "A Blue-Jean Person Pack" by E.A. Byrnes as published on p. 164 of the May/Jun. 1982 issue of The Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 17 pgs.

(56) References Cited

OTHER PUBLICATIONS

Appendix WWW: U.S. Pat. No. 6,257,468 ("Yamazoe") Invalidity Chart, *The Ergo Baby Carrier, Inc.* v. *BOBA Inc.*, Case No. 2:15-cv-08946, In the United States District Court for the Central District of California, Jul. 15, 2016, 2 pgs.
Appendix X: U.S. Pat. No. 6,182,873 ("Christopher") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix XX: EP Patent No. 0437365 ("Gunderman") Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix Y: U.S. Pat. No. 6,155,579 ("Eyman") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix YY: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix Z: U.S. Pat. No. 5,848,741 ("Fair") Invalidity Chart, *The Ergo Baby Carrier, Inc.* v. *BOBA Inc.*, Case No. 2:15-cv-08946, In the United States District Court for the Central District of California, Jul. 15, 2016, 4 pgs.
Appendix ZZ: Japanese Patent Publication No. S53-155443 ("The '443 Patent") Invalidity Chart, *The Ergo Baby Carrier, Inc.* v. *BOBA Inc.*, Case No. 2:15-cv-08946, In the United States District Court for the Central District of California, Jul. 15, 2016, 10 pgs.
Tentative Ruling on Claim Construction, U.S. Pat. No. 8,590,757 and U.S. Pat. No. 9,022,260, *The Ergo Baby Carrier, Inc.* v. *BOBA Inc.*, Case No. 2:15-cv-08946, In the United States District Court for the Central District of California, Dec. 1, 2016, 11 pgs.
File History for U.S. Trademark U.S. Appl. No. 75/457,187, filed Mar. 25, 1998, 56 pgs.
"Kinderpack Wearing Instructions for Infant Size," <<https://mykinderpack.com/pages/instructions>>, Copyright 2017 Kindercarry, 5 pgs.
"Kinderpack Wearing Instructions for Toddler Size," <<https://mykinderpack.com/pages/instructions>>, Copyright 2017 Kindercarry, 5 pgs.
SSC Instructions, <<http://www.isara.ro/en/content/7-instructiuni-ssc>>, Copyright 2016 ISARA, 12 pgs.
Wrapping instructions Baby Carriers, <<http://www.kokadi.de/en/instruction:_:162.html>>, Copyright 2016 ISARA, 28 pgs.
"The Five Hidden Features of the Yamaya Baby Carrier," <<http://http://blog.cybex-online.com/blog/safety/the-five-hidden-features-of-the-yemaya-baby-carrier/>>, Oct. 13, 2016 ISARA, 7 pgs.
Preliminary Invalidity Contentions, *The Ergo Baby Carrier, Inc.* v. *BOBA Inc.*, Case No. 2:15-cv-08946, In the United States District Court for the Central District of California, Jul. 15, 2016, 18 pgs.
BOBA, Inc.'s First Amended Counterclaims for Declaration of Unenforceability, Invalidity, and Monopolization, *The Ergo Baby Carrier, Inc.* v. *BOBA Inc.*, Case No. 2:15-cv-08946, In the United States District Court for the Central District of California, May 23, 2016, 73 pgs.
Joint Motion to Terminate for Inter Partes Review of U.S. Pat. No. 9,022,260 (IPR2016-01870) and U.S. Pat. No. 8,590,757 (IPR2016-01866), 3 pgs.
Office Action for Japanese Patent Application No. 2016-502118, dated Apr. 7, 2017, 9 pgs.
Office Action for U.S. Appl. No. 15/177,114, dated May 31, 2017, 12 pgs.
Office Action for U.S. Appl. No. 15/602,744, dated Aug. 8, 2017, 42 pgs.
Office Action for Korean Patent Application No. 10-2015-7028949, dated Jul. 20, 2017, 20 pgs.
Office Action for U.S. Appl. No. 15/177,114, dated Oct. 3, 2017, 5 pgs.
Office Action for European Patent Application No. 14773586.4, dated Oct. 12, 2017, 5 pgs.
Office Action for Chinese Patent Application No. 201480023993.2, dated Sep. 26, 2017, 5 pgs.
Office Action for U.S. Appl. No. 15/177,114, dated Nov. 3, 2017, 12 pgs.
Office Action for U.S. Appl. No. 15/177,114, dated Feb. 21, 2018, 13 pgs.
Office Action for U.S. Appl. No. 15/916,990, dated May 15, 2018, 5 pgs.
Office Action for U.S. Appl. No. 15/337,813, dated May 22, 2018, 6 pgs.
Office Action for U.S. Appl. No. 15/177,114, dated May 30, 2018, 5 pgs.
International Preliminary Report on Patentability and Written Opinion for PCT/US2016/59534, dated May 1, 2018, 6 pgs.
Office Action for U.S. Appl. No. 15/094,515, dated Jun. 28, 2018, 15 pgs.
European Search Report for European Patent Application No. 16777348.0, dated Oct. 4, 2018, 10 pgs.
Office Action for U.S. Appl. No. 16/204,581, dated Jan. 25, 2019, 5 pgs.
International Search Report and Written Opinion for International Patent Application No. PCT/US17/58820, dated Jan. 5, 2018, 12 pgs.
Office Action for U.S. Appl. No. 15/796,422, dated Nov. 26, 2018, 18 pgs.
Office Action for U.S. Appl. No. 15/094,515, dated Feb. 19, 2019, 15 pgs.
Office Action for Japanese Patent Application No. 2017-552901 (with English translation), dated Feb. 19, 2019, 9 pgs.
Notice of Allowance for U.S. Appl. No. 15/796,422, dated Mar. 27, 2019, 7 pgs.
International Preliminary Report on Patentability (IPRP) for International Application No. PCT/US2017/058820, dated May 9, 2019, 11 pgs.
Corrected Notice of Allowability for U.S. Appl. No. 15/796,422, dated May 30, 2019, 6 pgs.
Extended European Search Report for European Patent Application No. 16860977.4, dated Jun. 5, 2019, 7 pgs.
Notice of Allowance for U.S. Appl. No. 15/796,422, dated Jul. 25, 2019, 5 pgs.
Office Action with English translation for Japanese Patent Application No. 2018-521974, dated Oct. 24, 2019, 7 pgs.
Office Action for U.S. Appl. No. 15/796,422, dated Nov. 21, 2019, 20 pgs.
Office Action for Korean Patent Application No. 10-2018-7015023, dated Dec. 17, 2019, 5 pgs.
International Search Report and Written Opinion for International Patent Application No. PCT/US19/063052, 11 pgs.
Notice of Allowance for U.S. Appl. No. 15/796,422, dated Apr. 20, 2020, 4 pgs.
Office Action for U.S. Appl. No. 16/551,286, dated Apr. 23, 2020, 6 pgs.
Office Action (with English translation) for Korean Patent Application No. 10-2018-7015023, dated Dec. 17, 2019, 10 pgs.
Notice of Allowance (with English translation) for Korean Patent Application No. 10-2018-7015023, dated Jul. 9, 2020, 10 pgs.
Extended European Search Report for European Patent Application No. 17864576.8, dated Feb. 14, 2020, 7 pgs.
Initial Determination on Violation of Section 337 and Recommended Determination on Remedy and Bond, In re Matter of Certain Child Carriers, United States International Trade Commission, Inv. No. 337-TA-1154, Mar. 10, 2020, 210 pgs.
Exhibit RX-0116, In re Matter of Certain Child Carriers, United States International Trade Commission, Inv. No. 337-TA-1154, Photographs Embedded in McKibbon Declaration, Exhibit 3 to Depo of McKibbon, 2 pgs.
Exhibit RX-0118, In re Matter of Certain Child Carriers, United States International Trade Commission, Inv. No. 337-TA-1154, Photographs Embedded in McKibbon Declaration, Exhibit 4 to Depo of McKibbon, 1 pg.

(56) References Cited

OTHER PUBLICATIONS

Exhibit RX-0120, In re Matter of Certain Child Carriers, United States International Trade Commission, Inv. No. 337-TA-1154, Flickr Photos of Petals and Puddles, Exhibit 5 to Depo of McKibbon, 3 pgs.
Exhibit RX-0123, In re Matter of Certain Child Carriers, United States International Trade Commission, Inv. No. 337-TA-1154: Photo of carrier, Exhibit 7 to Depo of McKibbon, 1 pg.
Exhibit RX-0133, In re Matter of Certain Child Carriers, United States International Trade Commission, Inv. No. 337-TA-1154, Etsy Pages for petalsandpuddles, Exhibit 82 to Depo of Wick, 4 pgs.
Exhibit RX-0135, In re Matter of Certain Child Carriers, United States International Trade Commission, Inv. No. 337-TA-1154, Wayback Machine Page for Etsy search results baby sling, Exhibit 83 to Depo of Wick, Aug. 19, 2010, 4 pgs.
Exhibit RX-0159, In re Matter of Certain Child Carriers, United States International Trade Commission, Inv. No. 337-TA-1154, Ergobaby Omni 360 Cool Air Mesh Instruction Manual, 26 pgs.
Exhibit RX-0160, In re Matter of Certain Child Carriers, United States International Trade Commission, Inv. No. 337-TA-1154, Ergobaby Omni 360 Instruction Manual, 26 pgs.
Exhibit RX-0161, In re Matter of Certain Child Carriers, United States International Trade Commission, Inv. No. 337-TA-1154, Ergobaby Adapt Instruction Manual, 23 pgs.
Exhibit RX-0163, In re Matter of Certain Child Carriers, United States International Trade Commission, Inv. No. 337-TA-1154, Ergobaby 360 Bundle of Joy Instruction Manual, 26 pgs.
Exhibit RX-0200, In re Matter of Certain Child Carriers, United States International Trade Commission, Inv. No. 337-TA-1154, Declaration of Di Linh Reichman Regarding the Hibiscus Carrier, Sep. 2, 2019, 6 pgs.
Exhibit RX-0206, In re Matter of Certain Child Carriers, United States International Trade Commission, Inv. No. 337-TA-1154, Color Photograph (Respondent Exhibit), Exhibit 301 to Depo of Reichman, 1 pg.
Exhibit RX-0208, In re Matter of Certain Child Carriers, United States International Trade Commission, Inv. No. 337-TA-1154, Color Photograph (Respondent Exhibit), Exhibit 302 to Depo of Reichman, 1 pg.
Exhibit RX-0210, In re Matter of Certain Child Carriers, United States International Trade Commission, Inv. No. 337-TA-1154, Color Photograph (Respondent Exhibit), Exhibit 303 to Depo of Reichman, 1 pg.
Exhibit RX-0212, In re Matter of Certain Child Carriers, United States, International Trade Commission, Inv. No. 337-TA-1154, Color Photograph (Respondent Exhibit), Exhibit 304 to Depo of Reichman, 1 pg.
Exhibit RX-0214, In re Matter of Certain Child Carriers, United States International Trade Commission, Inv. No. 337-TA-1154, Color Photograph (Respondent Exhibit), Exhibit 305 to Depo of Reichman, 1 pg.
Exhibit RX-0216, In re Matter of Certain Child Carriers, United States International Trade Commission, Inv. No. 337-TA-1154, Color Photograph (Respondent Exhibit), Exhibit 306 to Depo of Reichman, 1 pg.
Exhibit RX-0218, In re Matter of Certain Child Carriers, United States International Trade Commission, Inv. No. 337-TA-1154, Color Photograph (Respondent Exhibit), Exhibit 307 to Depo of Reichman, 1 pg.
Exhibit RX-0231, In re Matter of Certain Child Carriers, United States International Trade Commission, Inv. No. 337-TA-1154, Declaration of Kristin Dybvig-Pawelko regarding the No. Tie Mei Tai Hibiscus Child Carrier Exhibit 7 to Depo of Dr. Dybwig-Pawelko, Sep. 28, 2019, 9 pgs.
Exhibit RX-0235, In re Matter of Certain Child Carriers, United States International Trade Commission, Inv. No. 337-TA-1154, Color Photograph labeled A (Respondent Exhibit), Exhibit 320 to Depo of Dr. Dybwig-Pawelko, 1 pg.
Exhibit RX-0237, In re Matter of Certain Child Carriers, United States International Trade Commission, Inv. No. 337-TA-1154, Color Photograph labeled B (Respondent Exhibit), Exhibit 320 to Depo of Dr. Dybwig-Pawelko, 1 pg.
Exhibit RX-0239, In re Matter of Certain Child Carriers, United States International Trade Commission, Inv. No. 337-TA-1154, Color Photograph labeled C (Respondent Exhibit), Exhibit 320 to Depo of Dr. Dybwig-Pawelko, 1 pg.
Exhibit RX-0240, In re Matter of Certain Child Carriers, United States International Trade Commission, Inv. No. 337-TA-1154, Color Photograph labeled D (Respondent Exhibit), Exhibit 320 to Depo of Dr. Dybwig-Pawelko, 1 pg.
Exhibit RX-0241, In re Matter of Certain Child Carriers, United States International Trade Commission, Inv. No. 337-TA-1154, Omni Alternate Preliminary—For Review Only (PowerPoint) 10 pgs.
Exhibit RX-0242, In re Matter of Certain Child Carriers, United States International Trade Commission, Inv. No. 337-TA-1154, Color Photograph labeled E (Respondent Exhibit), Exhibit 320 to Depo of Dr. Dybwig-Pawelko, 1 pg.
Exhibit RX-0280, In re Matter of Certain Child Carriers, United States International Trade Commission, Inv. No. 337-TA-1154, TheBabyWearer post about carriers for facing out and referencing both Silly Goose and Pikkolo, Oct. 22, 2007, 9 pgs.
Exhibit RX-0289, In re Matter of Certain Child Carriers, United States International Trade Commission, Inv. No. 337-TA-1154, Pikkolo physical carrier and packaging, 12 pgs.
Exhibit RX-0296, In re Matter of Certain Child Carriers, United States International Trade Commission, Inv. No. 337-TA-1154, Tula Free-to-Grow Carrier Instruction Manual, 25 pgs.
Exhibit RX-0297, In re Matter of Certain Child Carriers, United States International Trade Commission, Inv. No. 337-TA-1154, Tula Explore Carrier Instruction Manual, 8 pgs.
Exhibit RX-0341, In re Matter of Certain Child Carriers, United States International Trade Commission, Inv. No. 337-TA-1154, Infantino Flip 4-in-1 Carrier Design Drawings, Sep. 21, 2017, 12 pgs.
Exhibit RX-0342, In re Matter of Certain Child Carriers, United States International Trade Commission, Inv. No. 337-TA-1154, Infantino Flip 4-in-1 Carrier Product Manual, 2 pgs.
Exhibit RX-0343, In re Matter of Certain Child Carriers, United States International Trade Commission, Inv. No. 337-TA-1154, Infantino Upscale Carrier Product Manual, 2016, 10 pgs.
Exhibit RX-0344, In re Matter of Certain Child Carriers, United States International Trade Commission, Inv. No. 337-TA-1154, Infantino Upscale Carrier Product Manual RX, 2016, 10 pgs.
Exhibit RX-0347, In re Matter of Certain Child Carriers, United States International Trade Commission, Inv. No. 337-TA-1154, Infantino Go Forward Evolved Product Manual, 24 pgs.
Exhibit RX-0351, In re Matter of Certain Child Carriers, United States International Trade Commission, Inv. No. 337-TA-1154, Photograph of Michelle McEntire and Children, Feb. 17, 2008, 1 pg.
Exhibit RX-0402, In re Matter of Certain Child Carriers, United States International Trade Commission, Inv. No. 337-TA-1154, Web Archive Hibiscus Baby Wearing Instructions, 2007, 3 pgs.
Exhibit RX-0411, In re Matter of Certain Child Carriers, United States International Trade Commission, Inv. No. 337-TA-1154, The Cat Bird Baby Website Printout—Our Booth at the ABC Kids Expo in Las Vegas, Sep. 13, 2007, 5 pgs.
Exhibit RX-0413, In re Matter of Certain Child Carriers, United States International Trade Commission, Inv. No. 337-TA-1154, The Cat Bird Baby Website Printout—Pikkolo, a Mei Tai-Like Buckle Carrier, Aug. 2, 2007, 5 pgs.
Exhibit RX-0415, In re Matter of Certain Child Carriers, United States International Trade Commission, Inv. No. 337-TA-1154, Pikkolo Carrier Design Drawings, Jul. 2007, 1 pg.
Exhibit RX-0417, In re Matter of Certain Child Carriers, United States International Trade Commission, Inv. No. 337-TA-1154, Cat Bird Baby Purchase Order, Sep. 25, 2007, 1 pg.
Exhibit RX-0419, In re Matter of Certain Child Carriers, United States International Trade Commission, Inv. No. 337-TA-1154, Sales Receipt for Pikkolo Carrier, Sep. 14, 2007, 4 pgs.
Exhibit RX-0437, In re Matter of Certain Child Carriers, United States International Trade Commission, Inv. No. 337-TA-1154, FlickR Page Printout, Sep. 19, 2008, 2 pgs.

(56) References Cited

OTHER PUBLICATIONS

Exhibit RX-0480, In re Matter of Certain Child Carriers, United States International Trade Commission, Inv. No. 337-TA-1154, FlickR Photograph of Closet with Different Types of Material, Apr. 30, 2008, 3 pgs.
Exhibit RX-0482, In re Matter of Certain Child Carriers, United States International Trade Commission, Inv. No. 337-TA-1154, FlickR Photograph of Closet with Different Types of Material, Apr. 30, 2008, 2 pgs.
Exhibit RX-0484, In re Matter of Certain Child Carriers, United States International Trade Commission, Inv. No. 337-TA-1154, FlickR Photograph of crafting supplies, Apr. 30, 2008, 2 pgs.
Exhibit RX-0504, In re Matter of Certain Child Carriers, United States International Trade Commission, Inv. No. 337-TA-1154, Exhibit A to Declaration of Joline Sikora, Jul. 10, 2007, 1 pg.
Exhibit RX-0505, In re Matter of Certain Child Carriers, United States International Trade Commission, Inv. No. 337-TA-1154, Exhibit B to Declaration of Joline Sikora, Jul. 11, 2007, 3 pgs.
Exhibit RX-0506, In re Matter of Certain Child Carriers, United States International Trade Commission, Inv. No. 337-TA-1154, Exhibit C to Declaration of Joline Sikora, Jul. 11, 2007, 3 pgs.
Exhibit RX-0507, In re Matter of Certain Child Carriers, United States International Trade Commission, Inv. No. 337-TA-1154, Exhibit D to Declaration of Joline Sikora, Sep. 18, 2007, 1 pg.
Exhibit RX-0508, In re Matter of Certain Child Carriers, United States International Trade Commission, Inv. No. 337-TA-1154, Exhibit E to Declaration of Joline Sikora, Sep. 18, 2007, 1 pg.
Exhibit RX-0509, In re Matter of Certain Child Carriers, United States International Trade Commission, Inv. No. 337-TA-1154, Exhibit F to Declaration of Joline Sikora, Sep. 18, 2007, 1 pg.
Exhibit RX-0510, In re Matter of Certain Child Carriers, United States International Trade Commission, Inv. No. 337-TA-1154, Exhibit G to Declaration of Joline Sikora, Sep. 18, 2007, 1 pg.
Exhibit RX-0512, In re Matter of Certain Child Carriers, United States International Trade Commission, Inv. No. 337-TA-1154, Exhibit I to Declaration of Joline Sikora, 2007), 3 pgs.
Exhibit RX-0513, In re Matter of Certain Child Carriers, United States International Trade Commission, Inv. No. 337-TA-1154, Exhibit J to Declaration of Joline Sikora, 1 pg.
Exhibit RX-0514, In re Matter of Certain Child Carriers, United States International Trade Commission, Inv. No. 337-TA-1154, Exhibit K to Declaration of Joline Sikora, 2007, 1 pg.
Exhibit RX-0515, In re Matter of Certain Child Carriers, United States International Trade Commission, Inv. No. 337-TA-1154, Exhibit L to Declaration of Joline Sikora, Feb. 17, 2008, 4 pgs.
Exhibit RX-0520, In re Matter of Certain Child Carriers, United States International Trade Commission, Inv. No. 337-TA-1154, Exhibit Q to Declaration of Joline Sikora, Aug. 23, 2007, 2 pgs.
Exhibit RX-0521, In re Matter of Certain Child Carriers, United States International Trade Commission, Inv. No. 337-TA-1154, Exhibit R to Declaration of Joline Sikora, Aug. 23, 2007, 2 pgs.
Exhibit RX-0522, In re Matter of Certain Child Carriers, United States International Trade Commission, Inv. No. 337-TA-1154, Exhibit S to Declaration of Joline Sikora, Feb. 17, 2008, 2 pgs.
Exhibit RX-0523, In re Matter of Certain Child Carriers, United States International Trade Commission, Inv. No. 337-TA-1154, Exhibit T to Declaration of Joline Sikora, Feb. 17, 2008, 2 pgs.
Exhibit RX-0524, In re Matter of Certain Child Carriers, United States International Trade Commission, Inv. No. 337-TA-1154, Exhibit U to Declaration of Joline Sikora, Feb. 17, 2008, 2 pgs.
Exhibit RX-0525, In re Matter of Certain Child Carriers, United States International Trade Commission, Inv. No. 337-TA-1154, Exhibit V to Declaration of Joline Sikora, Jul. 21, 2007-Sep. 19, 2008, 64 pgs.
Exhibit RX-0526, In re Matter of Certain Child Carriers, United States International Trade Commission, Inv. No. 337-TA-1154, Exhibit W to Declaration of Joline Sikora, Feb. 27, 2007-Apr. 5, 2009, 41 pgs.
Exhibit RX-0527, In re Matter of Certain Child Carriers, United States International Trade Commission, Inv. No. 337-TA-1154, Exhibit A to Declaration of Mischele McEntire, Feb. 17, 2007, 2 pgs.
Exhibit RX-0528, In re Matter of Certain Child Carriers, United States International Trade Commission, Inv. No. 337-TA-1154, Exhibit B to Declaration of Mischele McEntire, Feb. 17, 2008, 4 pgs.
Exhibit RX-0539, In re Matter of Certain Child Carriers, United States International Trade Commission, Inv. No. 337-TA-1154, LILLEbaby Complete 6 Position Baby Carrier User Manual, Exhibit 613 to Depo of L. Lehan, 16 pgs.
Exhibit RX-0551, In re Matter of Certain Child Carriers, United States International Trade Commission, Inv. No. 337-TA-1154, Silly Goose Photos and thread from babywearer.com, Sep. 14, 2007, 14 pgs.
Exhibit RX-0552, In re Matter of Certain Child Carriers, United States International Trade Commission, Inv. No. 337-TA-1154, Silly Goose Photos and thread from babywearer.com, Oct. 31, 2007, 15 pgs.
Respondent's Pre-Hearing Brief, In re Matter of Certain Child Carriers, United States International Trade Commission, Inv. No. 337-TA-1154, Nov. 8, 2019, 405 pgs.
Respondent's Post-Hearing Initial Brief, In re Matter of Certain Child Carriers, United States International Trade Commission, Inv. No. 337-TA-1154, Jan. 6, 2020, 102 pgs.
Respondent's Post-Hearing Responsive Brief, In re Matter of Certain Child Carriers, United States International Trade Commission, Inv. No. 337-TA-1154, Jan. 28, 2020, 127 pgs.
Commission Investigative Staff's Pre-Hearing Brief, In re Matter of Certain Child Carriers, United States International Trade Commission, Inv. No. 337-TA-1154, Nov. 20, 2019, 195 pgs.
Commission Investigative Staff's Initial Post-Hearing Brief, In re Matter of Certain Child Carriers, United States International Trade Commission, Inv. No. 337-TA-1154, Jan. 13, 2020, 124 pgs.
Commission Investigative Staff's Reply Post-Hearing Brief, In re Matter of Certain Child Carriers, United States International Trade Commission, Inv. No. 337-TA-1154, Jan. 22, 2020, 26 pgs.
Complainant's Pre-Hearing Brief, In re Matter of Certain Child Carriers, United States International Trade Commission, Inv. No. 337-TA-1154, Nov. 21, 2019, 852 pgs.
Complainant's Post-Hearing Initial Brief, In re Matter of Certain Child Carriers, United States International Trade Commission, Inv. No. 337-TA-1154, Jan. 6, 2020, 147 pgs.
Complainant's Post-Hearing Responsive Brief, In re Matter of Certain Child Carriers, United States International Trade Commission, Inv. No. 337-TA-1154, Jan. 17, 2020, 85 pgs.
Notice of Commission Determination to Review in Part a Final Initial Determination Finding No. Violation of Section 337; Termination of the Investigation, 85 Federal Register 95, at 29484-29485, May 15, 2020, 2 pgs.
Notice of Allowance for U.S. Appl. No. 16/551,286, dated Aug. 18, 2020, 2 pgs.
Office Action for Japanese Patent Application No. 2018-521974 dated Aug. 14, 2020, 2 pgs.
Notice of Allowance for U.S. Appl. No. 16/551,286, dated Jan. 19, 2021, 2 pgs.
Office Action for Japanese Patent Application No. 2020-060090, dated Feb. 19, 2021, 1 pg.
Notice of Allowance for U.S. Appl. No. 16/682,288, dated Mar. 2, 2021, 3 pgs.
Notice of Allowance for U.S. Appl. No. 16/551,286, dated May 27, 2021, 2 pgs.
Office Action with English translation for Chinese Patent Application No. 201680071536.X, dated Apr. 7, 2021, 18 pgs.
Notice of Allowance for U.S. Appl. No. 16/682,288, dated Apr. 26, 2021, 3 pgs.
International Preliminary Report on Patentability (Ch. 1) for International Application No. PCT/US2019/063052, dated May 25, 2021, 4 pgs.
Office Action with English translation for Korean Patent Application No. 10-2020-7029046, dated Jun. 2, 2021, 8 pgs.

(56) References Cited

OTHER PUBLICATIONS

Office Action with English translation for Japanese Patent Application No. 2019-523098, dated May 31, 2021, 13 pgs.
Notice of Allowance with English translation for Korean Patent Application No. 10-2020-7029046, dated Aug. 5, 2021, 4 pgs.

* cited by examiner

ADJUSTABLE CHILD CARRIER WITH ENHANCED FREEDOM OF MOVEMENT

RELATED APPLICATIONS

The present application claims the benefit of priority under 35 U.S.C. § 119(e) to United States Provisional Application No. 62/771,450, entitled "ADJUSTABLE CHILD CARRIER WITH ENHANCED FREEDOM OF MOVEMENT," filed Nov. 26, 2018, and U.S. Provisional Application No. 62/873,549, entitled "ADJUSTABLE CHILD CARRIER WITH ENHANCED FREEDOM OF MOVEMENT," filed Jul. 12, 2019, each of which is fully incorporated herein by reference for all purposes.

TECHNICAL FIELD

The present disclosure relates to child carriers. More particularly, the present disclosure relates to a child carrier that is adaptable to allow a child enhanced freedom of movement. The present disclosure also relates to child carriers that provide easy height and width adjustment.

BACKGROUND

Soft structured child carriers use stitching and fabrics to provide structure rather than a rigid frame. Such carriers have become increasingly popular for carrying infants and toddlers because they afford the wearer freedom of hand and arm movement while carrying a child. On the other hand, some soft structure carriers unduly limit the leg and arm movement of the child. Moreover, some soft structure carriers limit the child to be being carried in a single position and orientation, such as inward-facing, front-carry.

A number of some soft-structured carriers support a child in a non-ergonomic upright position with the child's legs hanging down and the base of the child's spine supporting the child's bodyweight. This position is not optimal for the child because it can unduly limit curvature of the spine and put stress on the infant's sacrum. This can cause the child's pelvis to tilt backward limiting leg and hip movement, which may impede healthy development of the infant's pelvis.

Moreover, soft structured carriers are often designed for a very limited age, weight and size of child and make compromises regarding the shape of the carrier to accommodate a range of ages. A carrier designed for infants or younger babies may not accommodate a child as the child grows into toddlerhood because the seat and back support portions of the carrier will become too small. On the other hand, a carrier designed for older children may not properly support an infant.

One solution to addressing the limited size range of a carrier is the use of a specially designed "infant insert." In general, an infant insert is an accessory that incorporates additional padding and structure and makes it possible to carry a small infant in a carrier that would not otherwise properly support the infant. However, not all carriers support the use of infant inserts. Moreover, depending on design, infant inserts may be cumbersome, non-intuitive, and easily lost. In particular, the use of a separate infant insert may require that parents keep track of two separate devices and may significantly increase the difficulty of configuring the carrier for a wearer, the wearing of the carrier, or the ingress and egress of a child to the carrier.

Due to the foregoing issues, parents may opt for changing carriers as the child ages.

SUMMARY

One embodiment of comprises a soft-structured child carrier that includes a waistband, a body panel having a bottom end attached to a bottom portion of the waistband, a first shoulder strap adapted to lift a first top corner of the body panel, a second shoulder strap adapted to lift a second top corner of the body panel, a first shoulder strap attachment panel attached to the interior side of the body panel away from the side edges of the body panel and a second shoulder strap attachment panel attached to the interior side of the body panel and away from the side edges of the body panel. The first shoulder strap attachment panel provides a first flap that is movable away from the interior surface of the body panel and includes a first lower attachment point for the first shoulder strap. The second shoulder strap attachment panel provides a second flap that is movable away from the interior surface of the body panel and includes a second lower attachment point for the second shoulder strap.

More particularly, according to one embodiment, the first shoulder strap attachment panel is attached to the body panel to the first side of the body panel's lateral centerline and closer to the lateral centerline than to the first side edge. Further, according to one embodiment, the second side edge is attached to the body panel to a second side of the body panel's lateral centerline and closer to the lateral centerline than to the second side edge.

According to one aspect of the present disclosure, the first shoulder strap attachment panel is adapted to protect a child carried in the child carrier from the first shoulder strap and the second shoulder strap attachment panel is adapted to protect the child from the second shoulder strap. For example, in one embodiment, the first lower attachment point is disposed on the exterior side of the first shoulder strap attachment panel exterior side and the second lower attachment point is disposed on the exterior side of the second shoulder strap attachment panel exterior side.

According to one embodiment, the child carrier includes a webbing tab attached to the first shoulder strap attachment panel at the first lower attachment point. A first buckle member is attached to the webbing tab. The first buckle member is adapted to connect to a respective buckle member on a portion the first shoulder strap. According to one embodiment, the child carrier further includes a second webbing tab attached to the second shoulder strap attachment panel at the second lower attachment point. A second buckle member is attached to the second webbing tab. The second buckle member is adapted to connect to a respective buckle member on a portion of the second shoulder strap. In one embodiment, the first shoulder strap includes a first shoulder strap portion extending from a first top corner of the body panel to a third buckle member, the third buckle member adapted to connect to the first buckle member, and the second shoulder strap comprises a second shoulder strap portion extending from the second top corner to a fourth buckle member, the fourth buckle member adapted to connect to the second buckle member.

According to one embodiment, the first shoulder strap attachment panel is adapted to form a first leg opening for a child when the first shoulder strap attachment panel is pulled away from the body panel by the first shoulder strap and the second shoulder strap attachment panel is adapted to form a second leg opening for the child when the second shoulder strap attachment panel pulled away from the body panel by the second shoulder strap.

According to one embodiment, the body panel has a first body panel width at the bottom end of the body panel and a second body panel width away from the waistband, the second body panel width being less than the first body panel width. The first lower attachment point and second lower attachment point may be farther away from the bottom end of the body panel than the second body panel width. The second body panel width may be a minimum body panel width.

According to one aspect of the present disclosure, the body panel is adapted to form a bucket seat. The body panel can include a foldable portion that is adapted to fold between the waistband and a wearer to reduce an effective height of the body panel and the base width of the bucket seat. According to one embodiment, the width of the body panel narrows along the foldable portion, moving away from the waistband.

The body panel can be configurable in a plurality of configurations relative to the waistband. According to one embodiment the plurality of configurations include i) a first configuration in which the body panel is lifted up by the first shoulder strap and second shoulder strap to the exterior side of the waistband and is not folded between the waistband and the wearer, the first configuration forming a first bucket seat with a first base width; and ii) a second configuration in which a portion of the body panel is folded between the waistband and the wearer and the body panel exists from behind the waistband at the top edge of the waistband, the second configuration forming a second bucket seat with a second base width. According to one embodiment, the body panel has a first body panel width at the bottom end of the body panel and a second body panel width away from the waistband such that the first base width is equal to the first body panel width and the second base width is equal to the second body panel width. In some embodiments, the first configuration is adapted to support a larger child in a first spread squat position and the second configuration is adapted to support a smaller child in a second spread squat position.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

Figure 1:
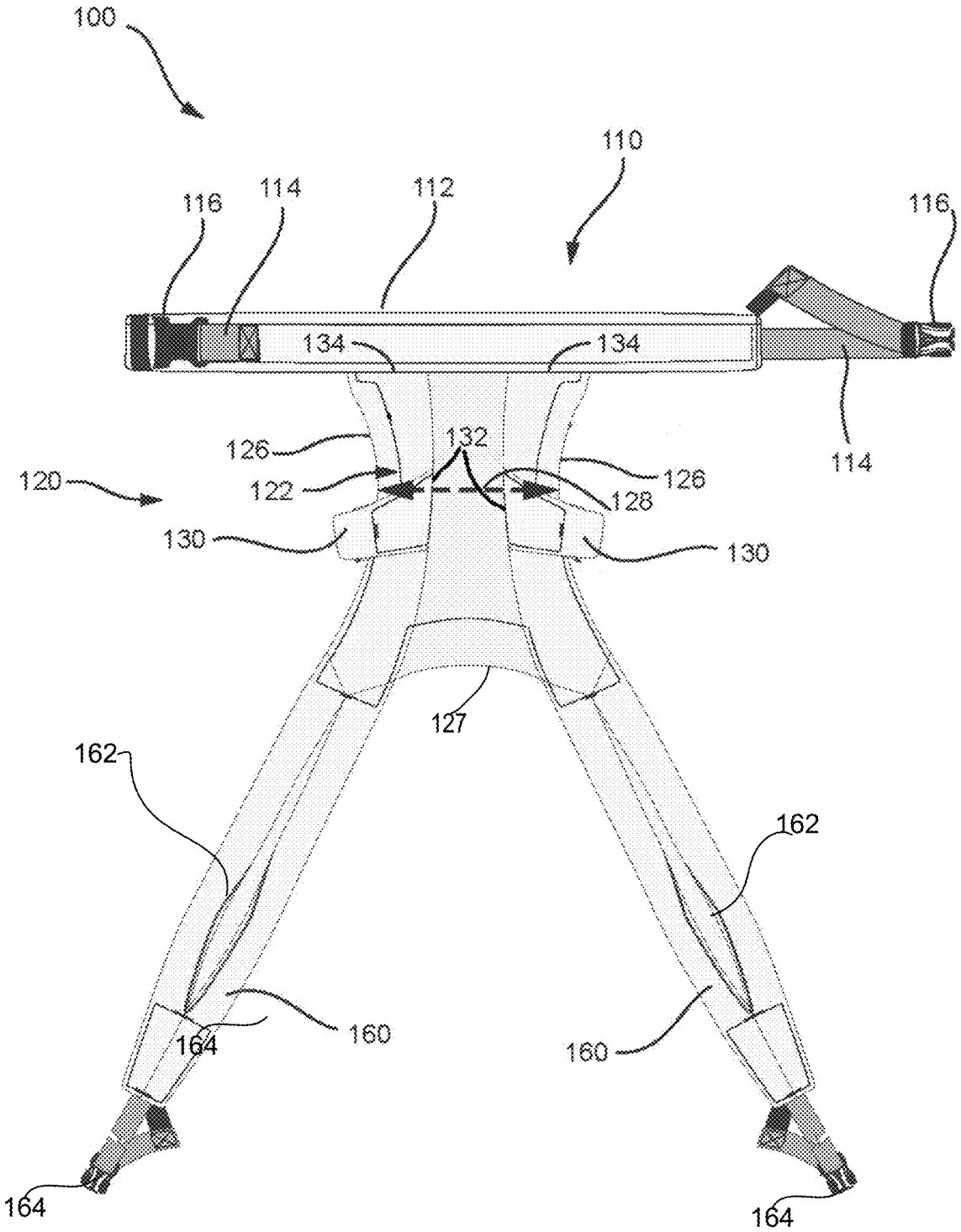
FIG. 1 is a diagrammatic representation of a first view of one embodiment of a carrier.

Child carriers and related methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

One embodiment comprises a carrier that allows for less tension on the body panel (e.g., front panel), particularly the side edges of the body panel, by having the side/lower shoulder strap attachment points to the interior of the body panel away from the side edges of the body panel. The reduced tension allows for more freedom of movement for the child.

According to one embodiment, a carrier may include shoulder strap attachment panels that provide shoulder strap attachment points. The shoulder strap attachment panels are attached to the interior of the body panel of the soft structured carrier, away from the side edges, thereby lessening tension on the side edges of the body panel. Further the shoulder strap attachment point may be on the exterior side of the shoulder strap attachment panels such that the shoulder strap attachment panels protects the child in the child carrying area from the shoulder straps (e.g., protects the child from coarse material or buckles that are part of the shoulder strap).

In addition, or in the alternative, a carrier may include features that allow the carrier to be reconfigured to accommodate a range of child ages/sizes. One embodiment comprises a carrier that allows for easy height and width adjustment by adjusting how the body panel is lifted and/or folded relative to the waistband (e.g., waist belt). According to one embodiment, the body panel is adapted so that it can be pulled up and folded between the waistband and the wearer's torso to shorten the body panel and narrow the body panel. In another mode of use, the body panel can be pulled up to the front of the waistband to lengthen the body panel and widen the body panel.

According to one embodiment, the body panel may be sewn or otherwise attached to the bottom of a waistband (where the "bottom" of the waistband herein refers to the bottom of the waistband in the orientation in which the waistband is intended to be worn during use). The body panel may be adapted to be pulled up behind the waistband and folded between the waistband and the wearer's stomach to achieve a configuration in which the portion of the body panel that supports the child is shorter and has narrower seat base—in this case, making the carrier body panel come out from between the wearer and the top edge of the waistband thus shortening the carrier's effective height by the waistband height measurement. In some embodiments, the body panel may be folded multiple times behind the waistband. The configuration can be adapted to ergonomically seat a smaller child. According to one embodiment, the carrier body panel also releases from the waistband at the narrowest point of the body panel in this configuration (e.g., the body panel emerges from between the wearer and waistband with the narrowest width of the body panel at the top edge of the waistband). In this configuration, the baby/infant is seated above the waistband as opposed to below the waistband in the second configuration.

In another embodiment, the body panel may be adapted to be pulled up between a panel retaining strap and the front of the waistband to achieve a configuration in which the portion of the body panel that supports the child is shorter and has narrower seat base—in this case, making the carrier body panel come out from between the waistband and the top edge of the panel retaining strap thus shortening the carrier's effective height by the distance between the bottom of the waistband and the top of the panel retaining strap. In some embodiments, the body panel may be folded multiple times between the waistband and panel retaining strap. The configuration can be adapted to ergonomically seat a smaller child. According to one embodiment, the carrier body panel emerges from between the waistband and the top of the panel retaining strap with the narrowest width of the body panel at the top edge of the panel retaining strap).

The body panel can also be lifted up to the front of the waistband to achieve another configuration in which the portion of the body panel available to support the child is longer and the seat base is wider. The second configuration can be adapted to ergonomically support a larger child.

The carrier can be adapted to carry a child in a manner that supports the child and maintains the child's pelvis and thighs in a preferred ergonomic position through a range of ages. In particular, embodiments described herein provide carriers that support the child's bottom, pelvis and thighs in a desired position. Embodiments described herein also allow a child to be carried in an inward facing orientation (facing the wearer) or an outward facing orientation (facing away from the wearer). The adjustable child carrier can be configured to accommodate children of a wide range of sizes. For example, embodiments of a child carrier as disclosed herein may provide an adjustable child carrier usable with a newborn children (infant) (e.g., around 7 pounds) and additionally with children all the way to up to around 30 pounds or more.

One embodiment comprises an adjustable freedom-of-movement, simple construction carrier that ergonomically and easily supports a child through a range of ages, while fitting comfortably on a wide range of body types. According to one embodiment, the carrier allows for (1) easy height and width adjustment by adjusting how the body panel is lifted and/or folded relative to the waistband and/or (2) less tension on the body panel, particularly the side edges of the body panel.

Figure 2:
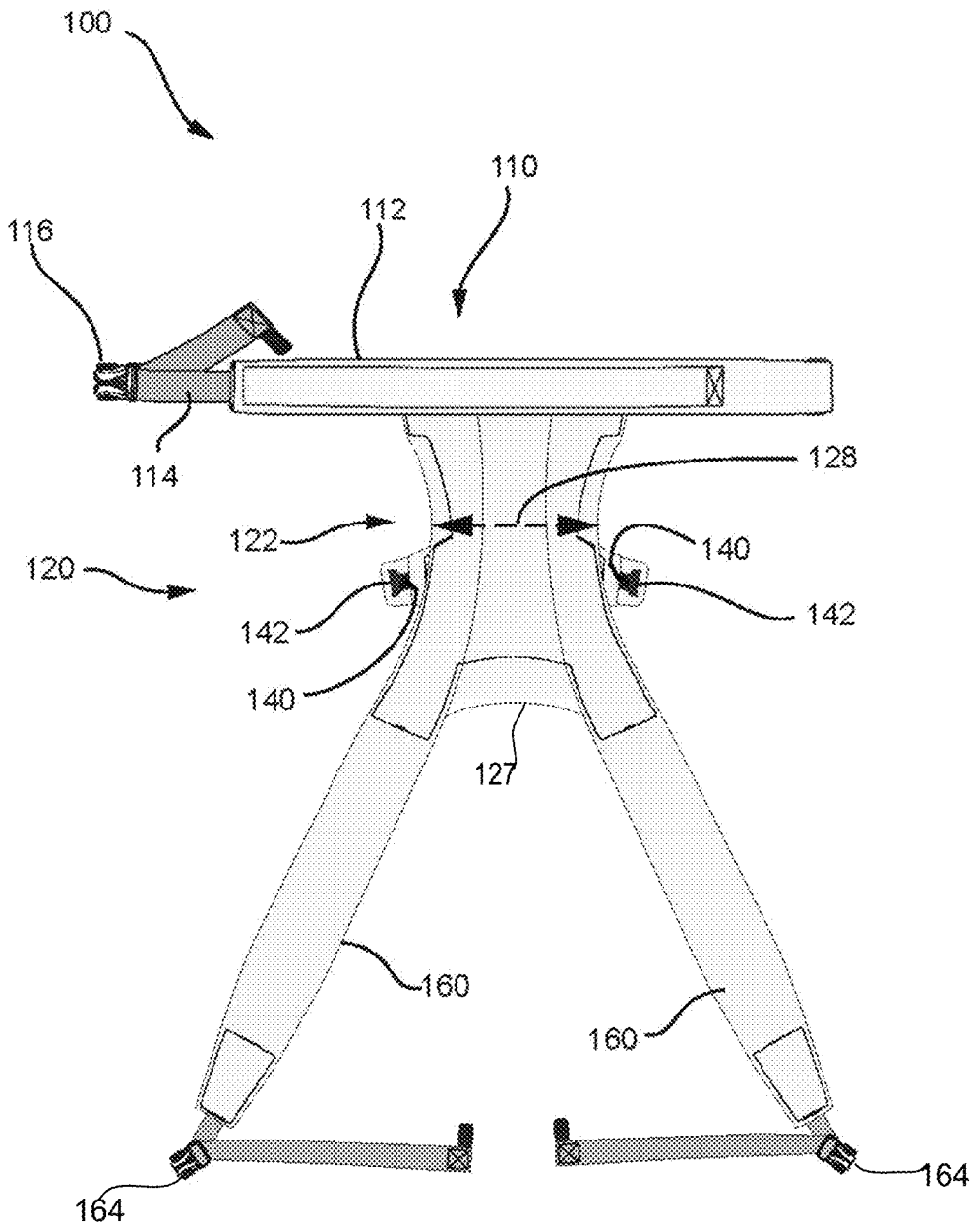
FIG. 2 is a diagrammatic representation of a second view of one embodiment of a carrier.
Figure 3:
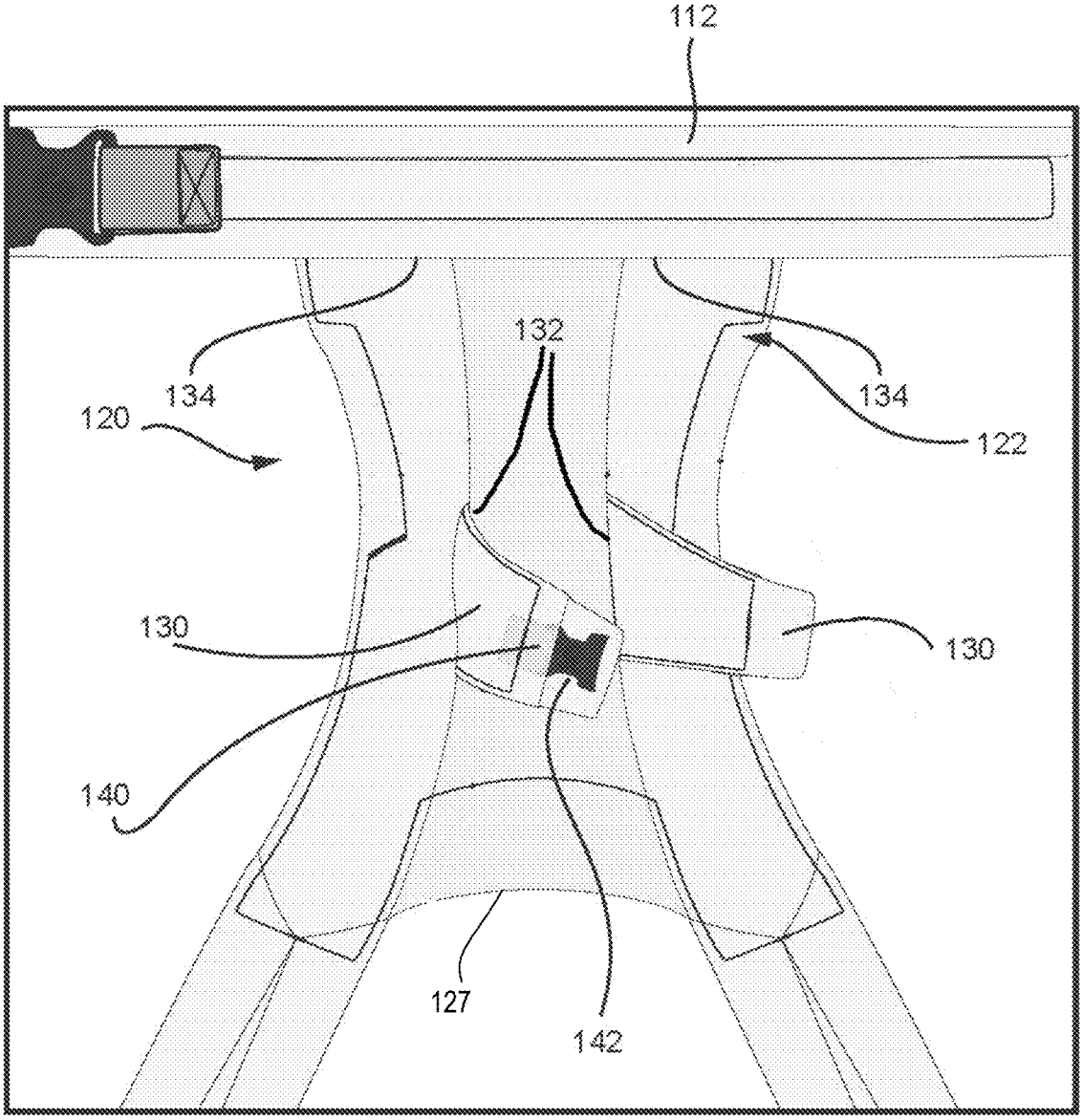
FIG. 3 is a diagrammatic representation of a detail view of one embodiment of a carrier.

FIG. 1 is a diagrammatic representation of a first view of one embodiment of a carrier 100 and FIG. 2 is a diagrammatic representation of a second view of one embodiment of a carrier 100. FIG. 3 is a diagrammatic representation of an interior view of one embodiment of a carrier 100 in more detail. FIG. 1 illustrates the exterior of waistband 110 (the side of the waistband that faces away from the wearer/does not touch the wearer during use) with body panel assembly 120 hanging down from the bottom edge 134 of waistband 110 to expose an interior side the body panel assembly 120 and shoulder straps 160. FIG. 2 illustrates the interior of the waistband 110 (the side of the waistband that faces the wearer/touches the wearer during use) with the body panel assembly 120 hanging down to show the exterior of the body panel assembly 120 and shoulder straps 160.

Waistband 110 comprises a band of one or more sections to encircle a wearer and a fastening mechanism, such as a buckle, snaps, ties or other mechanism, to fasten the band. In the illustrated embodiment, waistband 110 comprises a padded section 112, strap sections 114 sewn or otherwise attached to padded sections 112 and complementary buckle members 116 attached to strap sections 114. Padded section 112 is adapted to encircle the hips of the wearer when the carrier is worn. Padded section 112 can be padded, for example, with a semi-rigid material and covered with fabric. This material can be stiff foam, or any other appropriate material known or convenient, including closed cell foams such as ethylene-vinyl acetate (also known as EVA). The semi-rigid material and the wide shape of the padded section 112 serves to distribute the weight of the child around waist of the wearer. Limited adjustment of the waist belt length is provided by an adjusting loop formed at one of the buckle members. In another embodiment, the waistband comprises a relatively narrow waist belt sized to fit entirely around a user's waist and a belt pad disposed along a portion of the belt to provide the padded section 112.

Body panel assembly 120 is adapted to form a child carrying area in cooperation with the wearer's torso. To this end, body panel assembly 120 comprises a body panel 122 (e.g., a front panel) that may be adapted to form a curved shape that supports the legs, hips, posterior and upper body of the child. The body panel 122 includes an end proximate to waistband 120 (referred to herein as the "bottom end"), two opposed side edges 126 and a top end 127. The bottom end of body panel 122 is sewn or otherwise attached to the bottom portion of waistband 110, for example at or near the bottom edge of padded section 112. For example, the bottom end is stitched securely into the bottom section of the waistband 110. Moving away from waistband 110, the outer side edges 126 of body panel 122 are shaped such that the body panel width (indicated generally at 128) changes along at least a portion of the body panel 122. According to one embodiment, the outer side edges 126 curve or otherwise taper laterally inward such that to a minimum body panel width and then curve or otherwise taper latterly outward again. According to one embodiment, the minimum body panel width occurs at a distance from the bottom end of body panel 122. The minimum body panel width, location of the minimum body panel width and the shape of side edges 126 can be selected to create desired carrier shapes in the multiple configurations.

In general, body panel 122, at least proximate to waistband 110, may be formed of an easily foldable textile construction. Body panel 122 may be formed from one or more panels joined together. For example, body panel 122 may include a center panel and side panels. Body panel 122 can be formed of a single material or multiple materials. For example, body panel 122 may be formed with an interior layer selected for comfort against a child's skin and an outer layer selected for breathability, fashion, stain resistance, etc. In some embodiments, body panel 122 or other portions of carrier 100 may incorporate engineered knitting to shape the carrier. For example, the center portion of the body panel may be shaped using engineered knitting. In some embodiments, the entire body panel 122 is shaped using seamless engineered knitting. In such an embodiment, body panel 122 can be constructed such that there are no seams or darts on the body of the carrier and all body shape is achieved through knitting.

According to one embodiment, each shoulder strap 160 is sewn or otherwise coupled to body panel assembly 120 at a respective first point, which may be referred to as an upper attachment point because it is an upper attachment point when the carrier is in use, and second point, which may be referred to as a lower attachment point or side attachment point. The shoulder straps 160 are adapted to lift body panel assembly 120 and pull body panel assembly 120 toward the wearer to create the child carrying area. In the embodiment illustrated, each shoulder strap 160 has a portion that extends from an upper corner or portion of body panel 122 to a buckle member 164. The buckle member 164 connects to a respective buckle member 142, which is in turn attached to a webbing tab 140.

According to one embodiment, the shoulder straps 160 may have an expandable width. For example, shoulder straps 160 may include material that is folded over to form a slit 162 or other opening that can open/widen to allow the shoulder straps to widen.

Body panel assembly 120 comprises wings, flaps or other mechanism to direct tension or force from the lower shoulder strap attachment points away from the side edge 126, thus reducing the tension on outer edges 126 of body panel 122 during use and allowing greater freedom of movement for the child. In the illustrated embodiment, body panel assembly 120 comprises pair of shoulder strap attachment panels 130 that are sewn or otherwise attached to the interior of the body panel 122. Shoulder strap attachment panels 130 provide lower attachment points for the shoulder straps 160 and are adapted so that force or tension at the lower attachment points is transferred to body panel 122 away from side edges 126.

According to one embodiment, each shoulder strap attachment panel 130 is sewn or otherwise coupled to body panel 122 along an inner side edge 132 to body panel 122 at a position that is away from the outer side edges 126 of body panel 122. Even more particularly, according to one embodiment, the inner side edges 132 are coupled to the body panel 122 closer to the lateral centerline of the body panel than to the respective body panel side edge 126. While the shoulder strap attachment panels 130 of the illustrated embodiment are attached to body panel 122 away from the lateral centerline of body panel 122, the shoulder strap attachment panels 130 may be sewn or otherwise attached to body panel 122 at the lateral centerline in other embodiments.

Shoulder strap attachment panels 130 provide wings or flaps. More particularly, a portion of each shoulder strap attachment panel 130 is free to be pulled (e.g., swing) away from body panel 122. In the illustrated embodiment, the bottom edges, outer side edges and top edges of shoulder strap attachment panels 130 are free and thus shoulder strap attachment panels 130 may swing or otherwise be pulled away from away from body panel 122 (e.g., swing away from body panel 122).

According to one embodiment, all or a portion of each shoulder strap attachment panel 130 may have a width such that, when the carrier is spread open, the width of the carrier at the shoulder strap attachment panels 130 is greater than the width of the body panel 122 at the same distance from the bottom end of the body panel 122. In the illustrated embodiment, the top portions of the shoulder strap attachment panels 130 (the portions proximate to the respective top edges and distal from waistband 110) have a sufficient length that they can extend past the closest body panel side edges 126. The shoulder strap attachment panels 130 are shaped to provide leg openings for a child's legs when shoulder strap attachment panels 130 are pulled away from body panel 122 by the shoulder straps.

Each shoulder strap attachment panel 130 includes an attachment point for a shoulder strap. In the illustrated embodiment, for example, each shoulder strap attachment panel 130 includes an attachment point at which a shoulder strap webbing attachment tab 140 is sewn or otherwise coupled to the exterior side of each shoulder strap attachment panel 130 (the attachment in the illustrated embodiment is partially obscured by a covering material). Buckle members 142 are attached to the shoulder strap webbing attachment tabs 140 so that shoulder straps can be connected to strap webbing attachment tabs 140 with complementary buckle members 164. The shoulder strap attachment point on each shoulder strap attachment panel 130—that is, the point where the shoulder strap webbing attachment tab 140 is sewn or otherwise coupled to the shoulder strap attachment panel 130 in the illustrated embodiment—is located on a portion of the shoulder strap attachment panel 130 that can swing or otherwise move away from body panel 122. In some embodiments, the shoulder strap attachment point on each shoulder strap attachment panel 130 is latterly inboard of the respective side edge 126. Furthermore, the shoulder strap side attachment point on each shoulder strap attachment panel 130 is located so that it is farther away from the bottom edge of body panel 122 than the narrowest portion of body panel 122. In other embodiments, the attachment point may be located outboard of the respective side edge 126 and/or in another location relative to the narrowest part of the body panel 122.

FIG. 3 illustrates a view of the interior of one embodiment of body panel assembly 120 with a shoulder strap attachment panel 130 partially folded over. Side shoulder webbing attachment tab 140, is sewn or otherwise attached to shoulder strap attachment panel 130, which is sewn or otherwise attached to the interior of the body panel 122, as opposed to the outside edge 126 of body panel 122. Thus, the force or tension from the respective shoulder strap at the shoulder strap attachment point on the shoulder strap attachment panel 130 is transferred to the body panel 122 away from the outside edge 126. This results in less tension on the body panel edges 126 to allow for more freedom of movement for the child.

It will be appreciated that shoulder strap attachment panels 130 are provided by way of example and other shapes of shoulder strap attachment panels may be used. Moreover, while shoulder strap attachment panels 130 are illustrated as separate panels, shoulder strap attachment panels 130 may be portions of a single panel that is sewn or otherwise attached to body panel 122 to form shoulder strap attachment panels. Further, shoulder strap attachment panels 130 may have a variety of form factors.

Moreover, the force or tension from a lower shoulder strap attachment point may be directed away from the side edges 126 of a body panel 122 by other mechanisms. For example, in another embodiment the second end of each shoulder strap (e.g., shoulder strap webbing attachment tabs 140 or other shoulder strap portion) may be sewn or otherwise attached directly to the interior of a body panel 122 away from the side edges 126. Thus, it will be appreciated that a variety of mechanisms may be used to reduce tension on the side edges of the body panel. Moreover, various mechanism to reduce tension on the side edges of a panel, such as shoulder strap attachment panels, can be used with a variety of carrier designs. By way of example, attachment panels of various forms or other mechanisms to reduce tension at the side edges of the body panel may be used with a variety of carrier designs, including carriers in which the body panel height and width is adjustable and designs in which the body panel height and width is not adjustable.

Figure 4A:
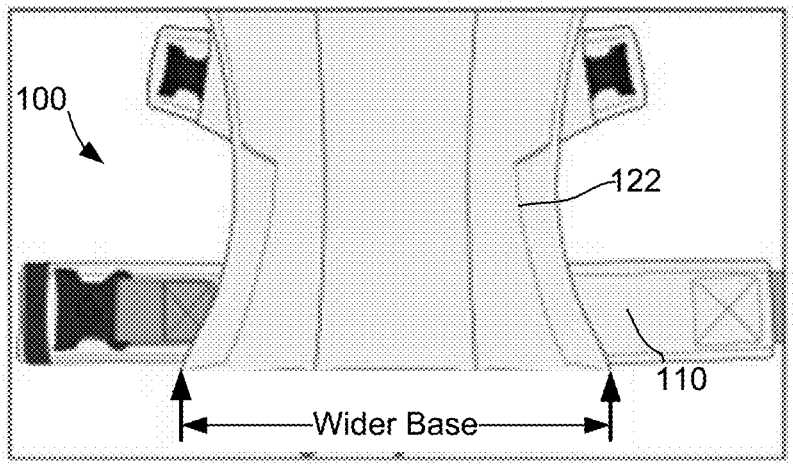
FIG. 4A is a diagrammatic representation of one embodiment of configuring a carrier to have a first base width.
Figure 4B:
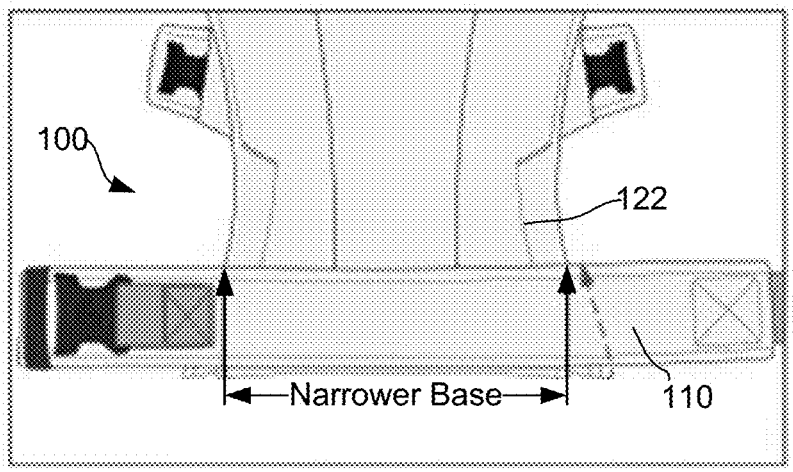
FIG. 4B is a diagrammatic representation of one embodiment of configuring a carrier to have a second base width.
Figure 4C:
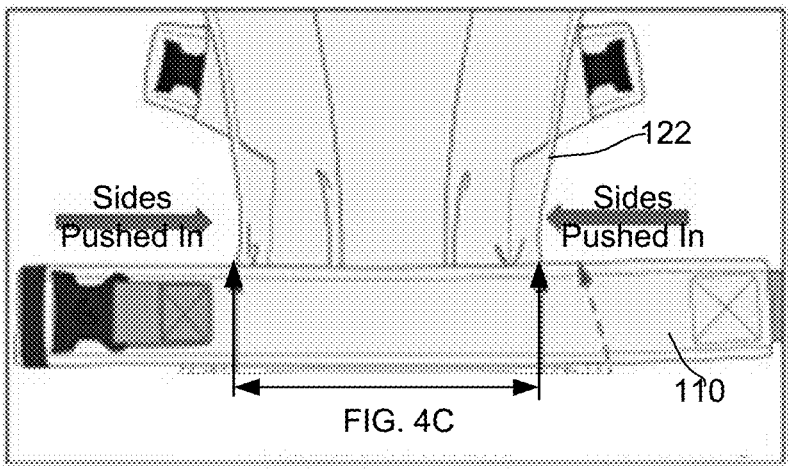
FIG. 4C is a diagrammatic representation of one embodiment of configuring a carrier to have a third base width.

Carrier 100 can be reconfigured to accommodate a child through a range of ages/sizes. FIGS. 4A, 4B and 4C illustrate, for example, that the carrier's configuration can be changed based on how the body panel 122 is positioned and/or folded relative to the waistband 110. The configuration of FIGS. 4B and 4C may be suitable for a newborn/infant and the configuration of FIG. 4A may be suitable for a larger child (e.g., a baby or toddler).

FIG. 4A illustrates a first configuration in which the body panel 122 is not folded behind waistband 110 but is lifted up to the exterior of the waistband 110. In this configuration, the base width of the carrier—the width of the seat proximate to waistband 110—is relatively wide. More particularly, in the first configuration, the body panel 122 is exiting the waistband at the carrier's widest seat width as determined by the width of the bottom edge of body panel 122.

FIG. 4B illustrates a second configuration in which the body panel 122 is pulled up from the bottom of waistband 110 and behind waistband 110 between waistband 110 and the wearer's stomach. The lower portion of the body panel can be folded several times between the waistband 110 and the wearer's stomach, effectively shortening and narrowing the body panel 122. Body panel 122 is effectively shortened because the available height of body panel 122 to support a child is shorter than in the first configuration discussed above. The body panel is effectively narrower because the top edge of waistband 110 intersects the body panel 122 at an area that is narrower than the bottom edge of body panel 122—that is, the body panel 122 is exiting the waistband at a narrower area of body panel 122—creating a narrower base width and, hence, bucket seat than when the carrier is in the first configuration.

In the second configuration, the base edge of the seat proximate to the waistband is not fixed to the waistband. Consequently, the side edges of the carrier body panel 122 can be pushed together at the seat base to further narrow the base width of carrier. FIG. 4C thus illustrates that the base width of carrier 100 can be further reduced by pushing the sides in at the seat base.

Figure 5A:
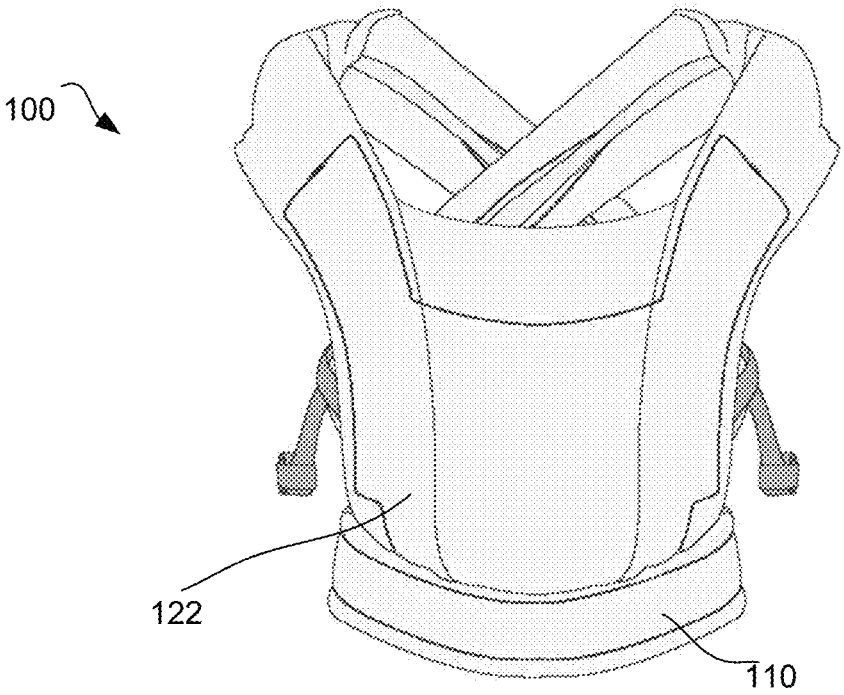
FIG. 5A is a diagrammatic representation of a front view one embodiment of a carrier configured with a narrower base width.
Figure 5B:
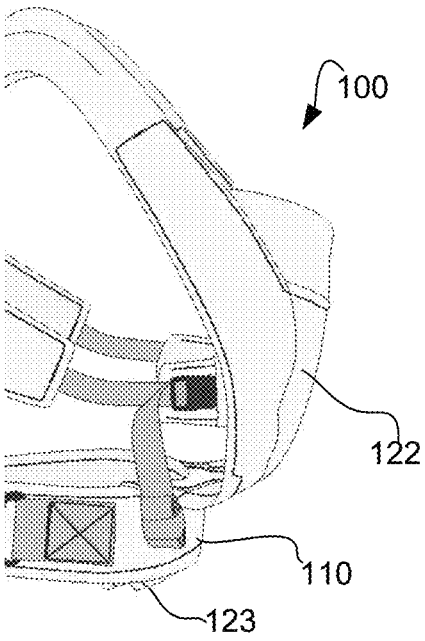
FIG. 5B is a diagrammatic representation of a side view one embodiment of a carrier configured with a narrower base width.
Figure 5C:
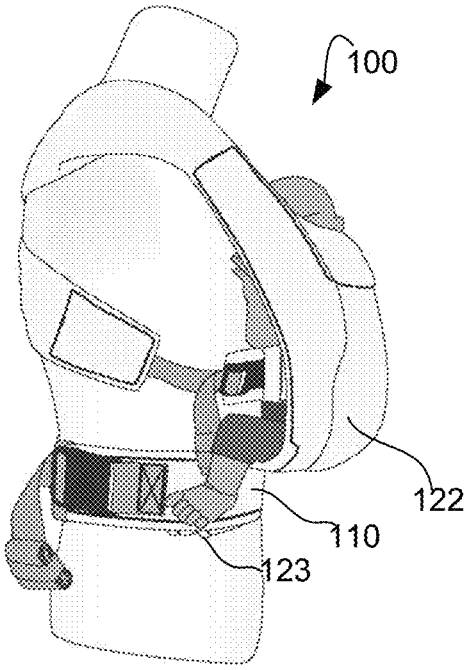
FIG. 5C is a diagrammatic representation of a side view one embodiment of a carrier carrying an infant/newborn.

FIG. 5A, FIG. 5B, FIG. 5C illustrates views of one embodiment of carrier 100 with the base of the carrier adjusted as illustrated, for example, in FIG. 4B with a portion of the body panel 122 folded behind waistband 110. More particularly, FIG. 5A illustrates a front view of carrier 100, FIG. 5B illustrates a side view of carrier 100, and FIG. 5C illustrates a sideview of carrier 100 carrying an infant in an inward facing orientation. In FIG. 5B and FIG. 5C, the ends of the folds 123 formed by folding body panel 122 behind the waistband 110 can be seen.

Figure 6A:
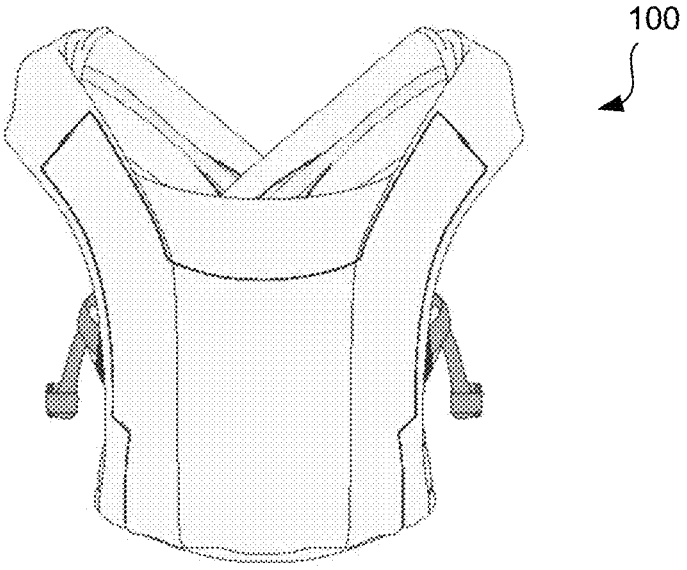
FIG. 6A is a diagrammatic representation of a front view one embodiment of a carrier configured with a wider base width.
Figure 6B:
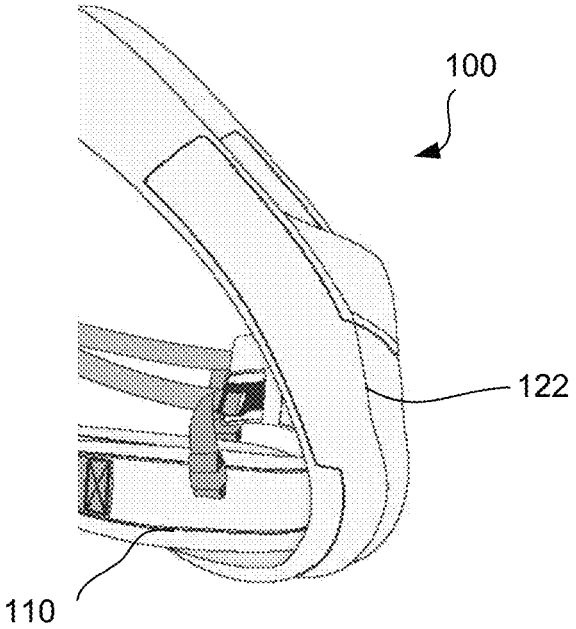
FIG. 6B is a diagrammatic representation of a side view one embodiment of a carrier configured with a wider base width.
Figure 6C:
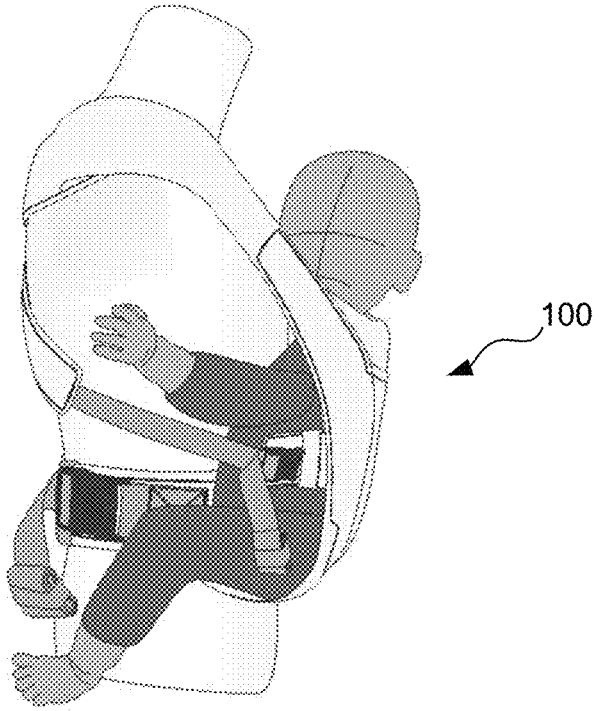
FIG. 6C is a diagrammatic representation of a side view one embodiment of a carrier carrying a larger child in an inward facing orientation.
Figure 6D:
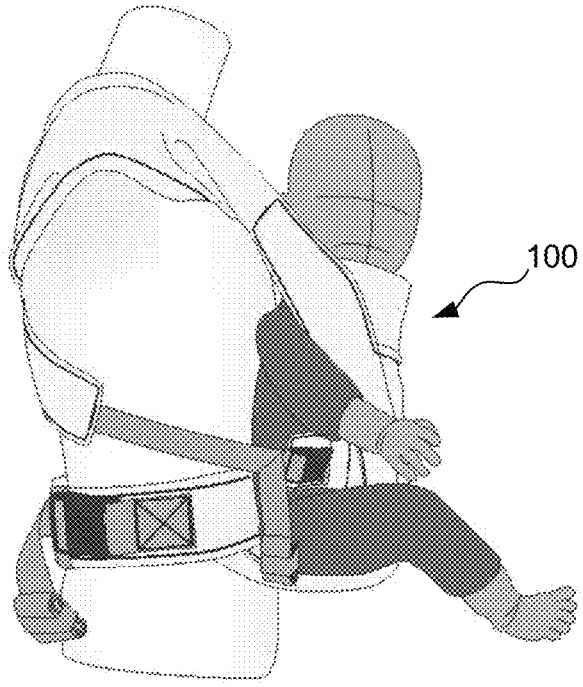
FIG. 6D is a diagrammatic representation of a side view one embodiment of a carrier carrying a larger child in an outward facing orientation.
Figure 6E:
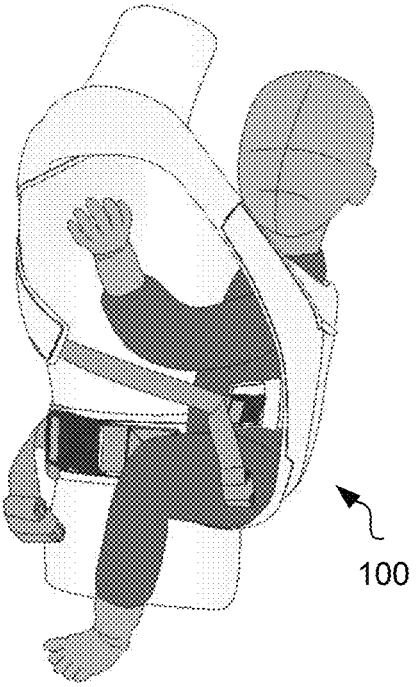
FIG. 6E is a diagrammatic representation of a side view one embodiment of a carrier carrying an even larger child in an inward facing orientation.
Figure 7:
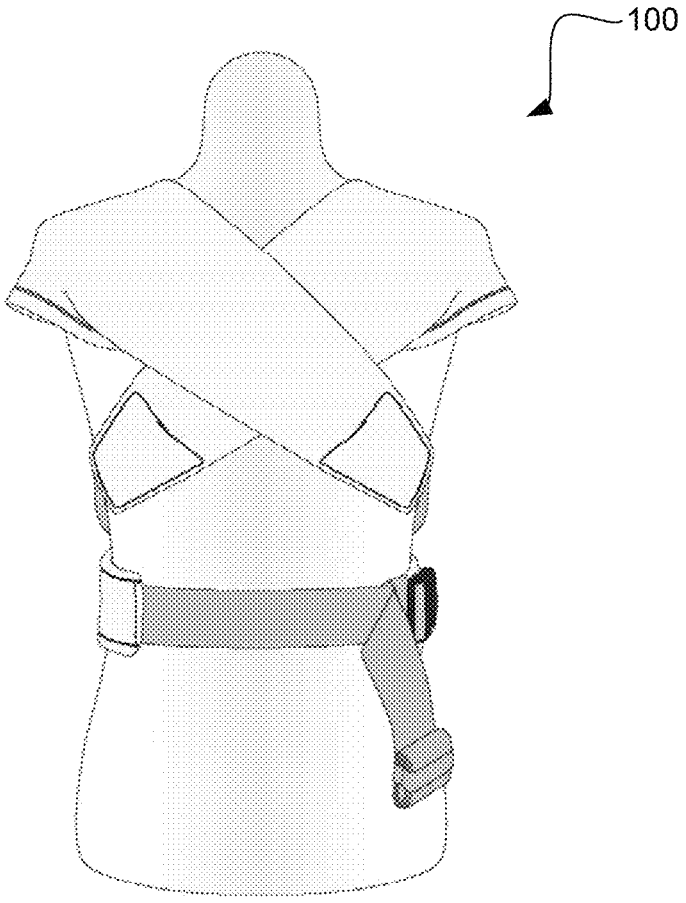
FIG. 7 is a diagrammatic representation of a rear view of one embodiment of a carrier.

As the child develops, the carrier can be reconfigured to accommodate the child. FIG. 6A, FIG. 6B, FIG. 6C, FIG. 6D and FIG. 6E illustrates views of one embodiment of carrier 100 with the base of carrier 100 adjusted as illustrated in FIG. 4A—that is with the body panel 122 lifted to the front of the waistband 110 and not folded behind the waistband. More particularly, FIG. 6A illustrates a front view of carrier 100, FIG. 6B illustrates a side view of carrier 100, FIG. 6C illustrates a side view of carrier 100 carrying a baby in an inward facing orientation, FIG. 6D illustrates a side view of carrier 100 carrying a baby in an outward facing orientation, and FIG. 6E illustrates a side view of carrier 100 with carrying a toddler in an inward facing orientation. FIG. 7 illustrates a rear view of carrier 100 as worn.

In one embodiment, the carrier can be adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

Carrier 100 is adapted to provide a supportive bucket seat with a generally concave (e.g., "C" shape) inner profile. The minimum body panel width, position of the minimum body panel width and the shape of the side edges 126 can be selected such that body panel 122 can create multiple bucket seat configurations to ergonomically support a child through a range of ages/sizes and in multiple seating orientations. The side panels can be shaped so that the outer edge 126 is shorter than the inside/center edge of the side panel. In use, the outer side edges 126 can be higher than the center of the seat and spaced such that the they pass under and around the child's thighs at a distance from the child's hips to lift the child's legs (e.g., above the knee). In some embodiments, additional support or padding may be placed proximate to edges 126 at the areas that will support a child's thighs.

According to one embodiment, carrier 100 is adapted so that the bucket seat formed in the narrower base width configuration can ergonomically support newborns and infants. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position (also known as the "frog leg", "frog", "squat spread" or "M" position) in which the flexion at the hip joint is at least 90° and in some cases is 110° to 120° from the coronal plane with the knees spread as appropriate for the developmental stage. In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

In another configuration (e.g., a wider base configuration), the carrier can be adapted to support the larger child in a spread squat position with the child's femur approximately 90° to 120° (or other elevated position) from the coronal plane and to position the child's knees with an amount of spreading. The amount of spreading may depend on the developmental stage of the child and orientation of the child in the carrier. In one embodiment, the spreading may be at least 20° degrees from the median plane. The child's weight can be distributed across the child's bottom, thighs and back so that the sacrum does not bear too much weight. Further, the carrier can support the child's spine with a level of curvature appropriate of the child's developmental stage. It can be noted, however, that the child can be positioned in any comfortable position, preferably emphasizing a supportive posture rather than a posture where the child is primarily sitting on his or her sacrum.

Figure 8B:
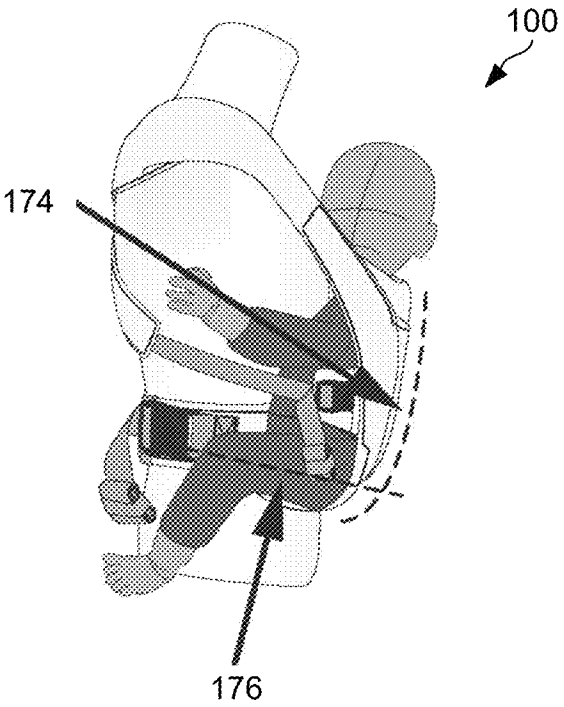
FIG. 8B is a diagrammatic representation of a side view of one embodiment of a carrier carrying a larger child in an inward facing orientation.
Figure 8A:
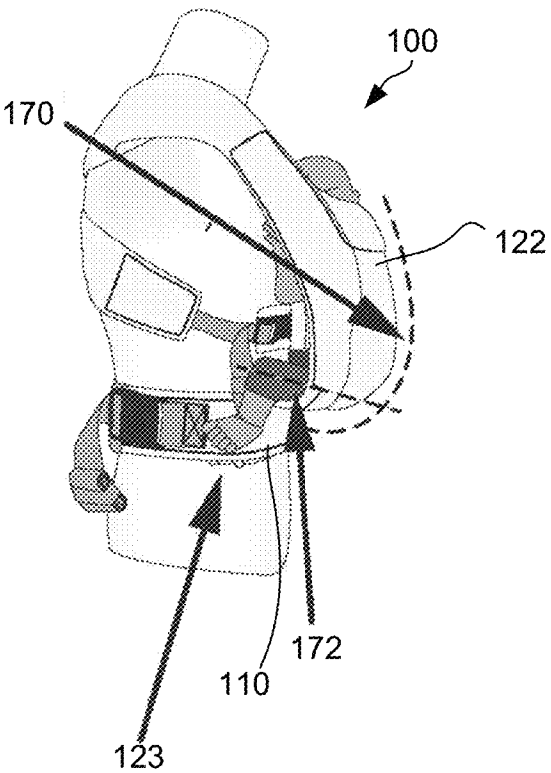
FIG. 8A is a diagrammatic representation of a side view of one embodiment of a carrier carrying a new/born infant.

Carrier 100 may be adjusted to provide ergonomic support for the child regardless of the size of the child through a supported range. In accordance with one embodiment, carrier 100 can be set for an infant with a narrower seat configuration. In this configuration, the bucket seat will be at its deepest with higher walls at the thigh support areas, lifting the child's thighs and knees to a greater angle and into a spread squat position appropriate for that size child. FIG. 8A, for example, illustrates the embodiment of FIG. 5C with the c-shape of the carrier indicated generally by line 170 and the angle of the child's thigh is indicated generally by line 172. Here, carrier 100 achieves a maximum c-shape and thigh angle appropriate for an infant.

Figure 8D:
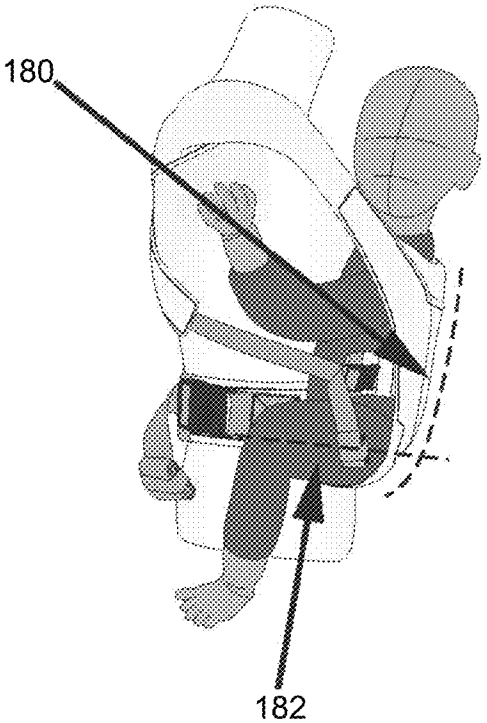
FIG. 8D is a diagrammatic representation if a side view of one embodiment of a carrier carrying an even larger child in an inward facing orientation.
Figure 8C:
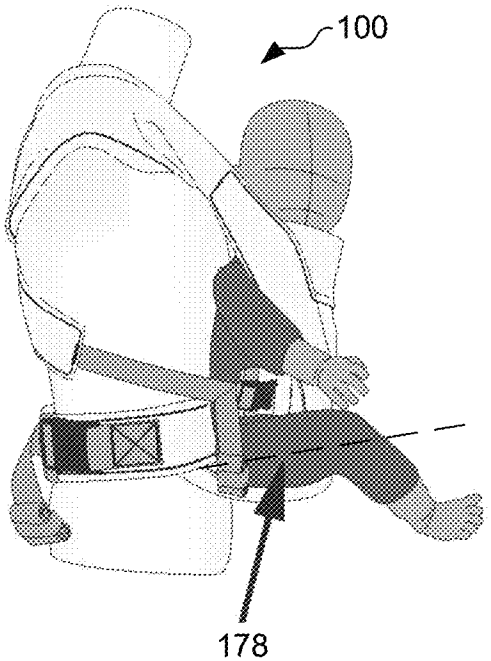
FIG. 8C is a diagrammatic representation of a side view of one embodiment of a carrier carrying a larger child in an outward facing orientation.

Similarly, carrier 100 can be set for a larger child with the seat at its widest setting. In this configuration, the bucket seat may be at its shallowest depth with lower walls at the thigh support areas, lifting the child's thighs and knees to a lesser angle and into a spread squat position appropriate for a larger sized child. For example, FIG. 8B illustrates the embodiment of FIG. 6C with the c-shape of the carrier indicated generally by line 174 and the angle of the child's thigh indicated generally by line 176, FIG. 8C illustrates the embodiment of FIG. 6D with the angle of the child's thigh indicated generally by line 178, and FIG. 8D illustrates the embodiment of FIG. 6E with the c-shape of the carrier indicated generally by line 180 and the angle of the child's thigh indicated generally by line 182. In the configuration of FIG. 8B, the carrier supports and inwardly facing baby with a moderate c-shape and moderate thigh angle appropriate for the child's development. As shown in FIG. 8C, carrier 100 can also support the baby in an outward facing orientation with an appropriate thigh angle. Further, as illustrated in FIG. 8D, carrier 100 supports a larger child, say a toddler, with a minimum c-shape and thigh angle.

Thus, the adjustable bucket seat is configurable in a plurality of configurations having different seat bucket depths and seat bucket widths. The different configurations can be adapted to support a child in a corresponding size range in a spread squat position. For example, in one embodiment, bucket seat can have a configuration adapted to ergonomically carry a child of 20-24 inches (generally corresponding to an infant of 0-3 months and over 7 pounds) in a spread squat position appropriate for the infant without requiring an infant insert. Furthermore, the carrier can have another configuration adapted to ergonomically carry a larger child in a spread squat position appropriate for that child's size. The configuration for carrying newborns/infants can correspond to the seat width being at the narrowest setting and the configuration for carrying larger children can correspond to the seat width being at a widest setting (shallowest bucket seat) (a toddler mode). It can be noted that the ranges provided above are provided by way of example and not limitation. Furthermore, the seat may have other configurations.

The user can thus adjust carrier 100 to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The carrier can be adjusted to form a sling or pouch that is wider than the child's hips.

Figure 9C:
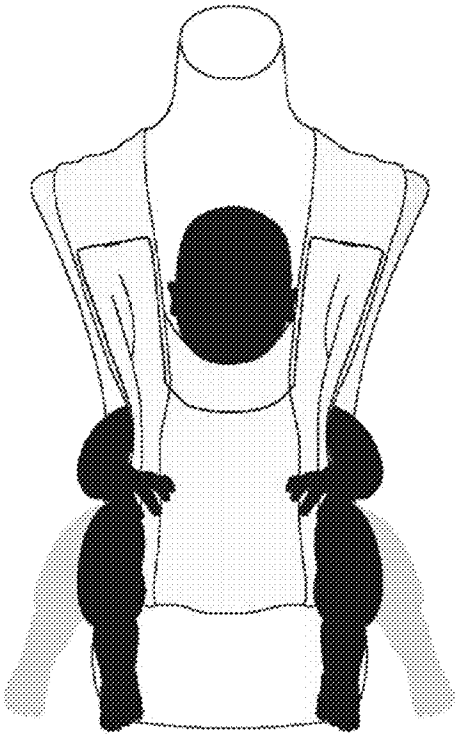
FIG. 9C is a diagrammatic representation of a front view of one embodiment of a carrier illustrating enhanced freedom of leg movement.
Figure 9B:
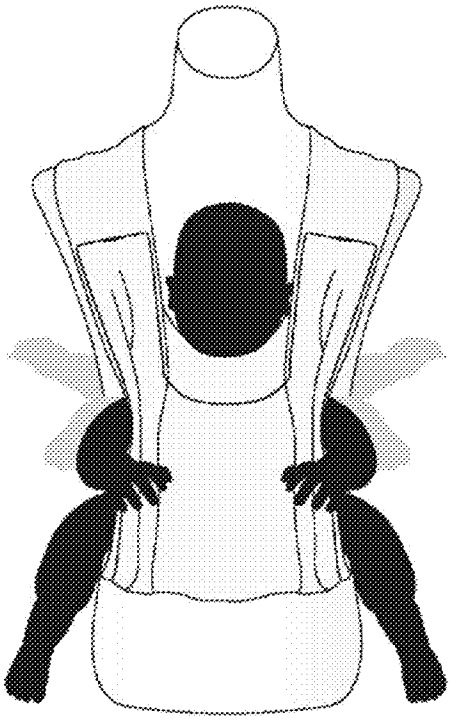
FIG. 9B is a diagrammatic representation of a front view of one embodiment of a carrier illustrating enhanced freedom of arm movement.
Figure 9A:
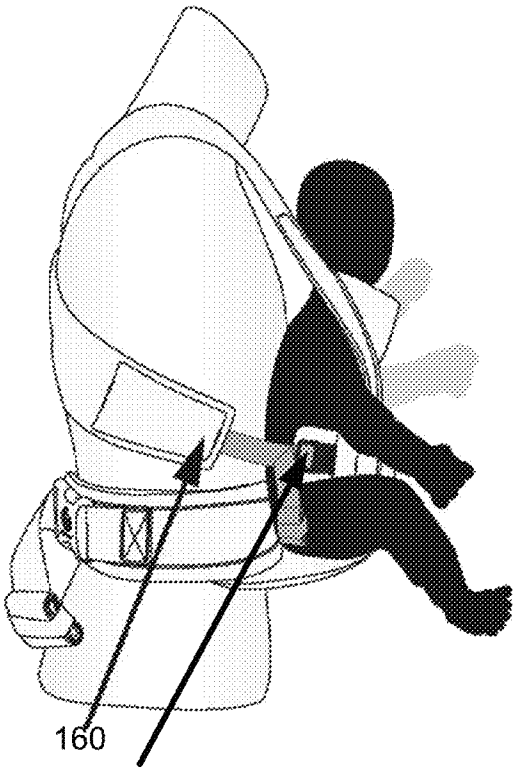
FIG. 9A is a diagrammatic representation of a side view of one embodiment of a carrier illustrating enhanced freedom of movement.

Carrier 100 can also provide enhanced freedom of movement. Turning to FIGS. 9A-9C, FIG. 9A illustrates a side view of one embodiment of carrier 100, FIG. 9B illustrates a front view of carrier 100 and shows an example of the freedom of movement of the child's arms, and FIG. 9C illustrates a front view of one embodiment of carrier 100 and shows an example of the freedom of movement of the child's legs.

As shown in FIG. 9A, the shoulder straps 160 couple to the side shoulder webbing attachment tabs 140 on the shoulder strap attachment panels 130, which in turn attach to the interior of panel 122 away from side edges 126, as opposed to at the outside edges 126. This relieves tension from the outside edges which otherwise draws the outside edges more tightly toward the wearer and restricts the child's arm and leg movement. Further, reducing the tension on the outside edge edges of the panel 122 reduces overspreading of the child's legs.

It can be noted that panel 122 is provided by way of example and panel 122 can have a variety of form factors. Moreover, a carrier with height and/or width adjustment according to the teachings of the present disclosure may have a variety of shoulder strap configurations. In one embodiment, for example, the lower/side attachment shoulder strap attachment points may occur on body panel 122 at or proximate to the side edges 126. Such an embodiment, while possibly exhibiting increased tension at the side edges, would still provide the advantage of easy height/width adjustment to ergonomically support a child through a range of ages/sizes.

Moreover, in some embodiments carrier 100 includes a retaining strap on the front of the waistband so that the bottom portion of body panel 122 can be folded between the waistband and retaining strap rather than between the waistband and the wearer. Other retaining mechanisms, such as snaps, retaining loops may also be used to maintain body panel 122 in a folded configuration.

Figure 10:
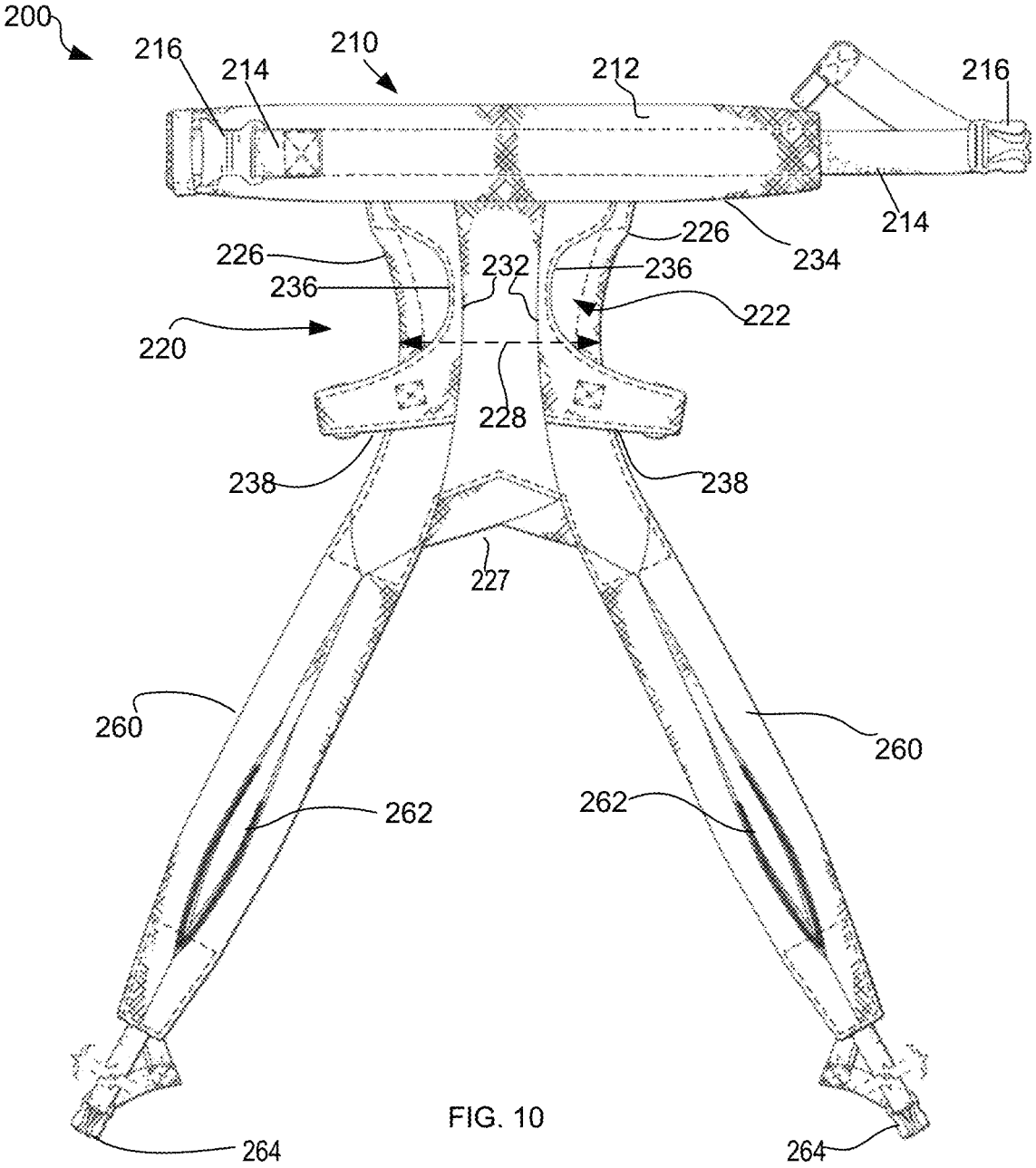
FIG. 10 is a diagrammatic representation of a first view of one embodiment of a carrier.
Figure 11:
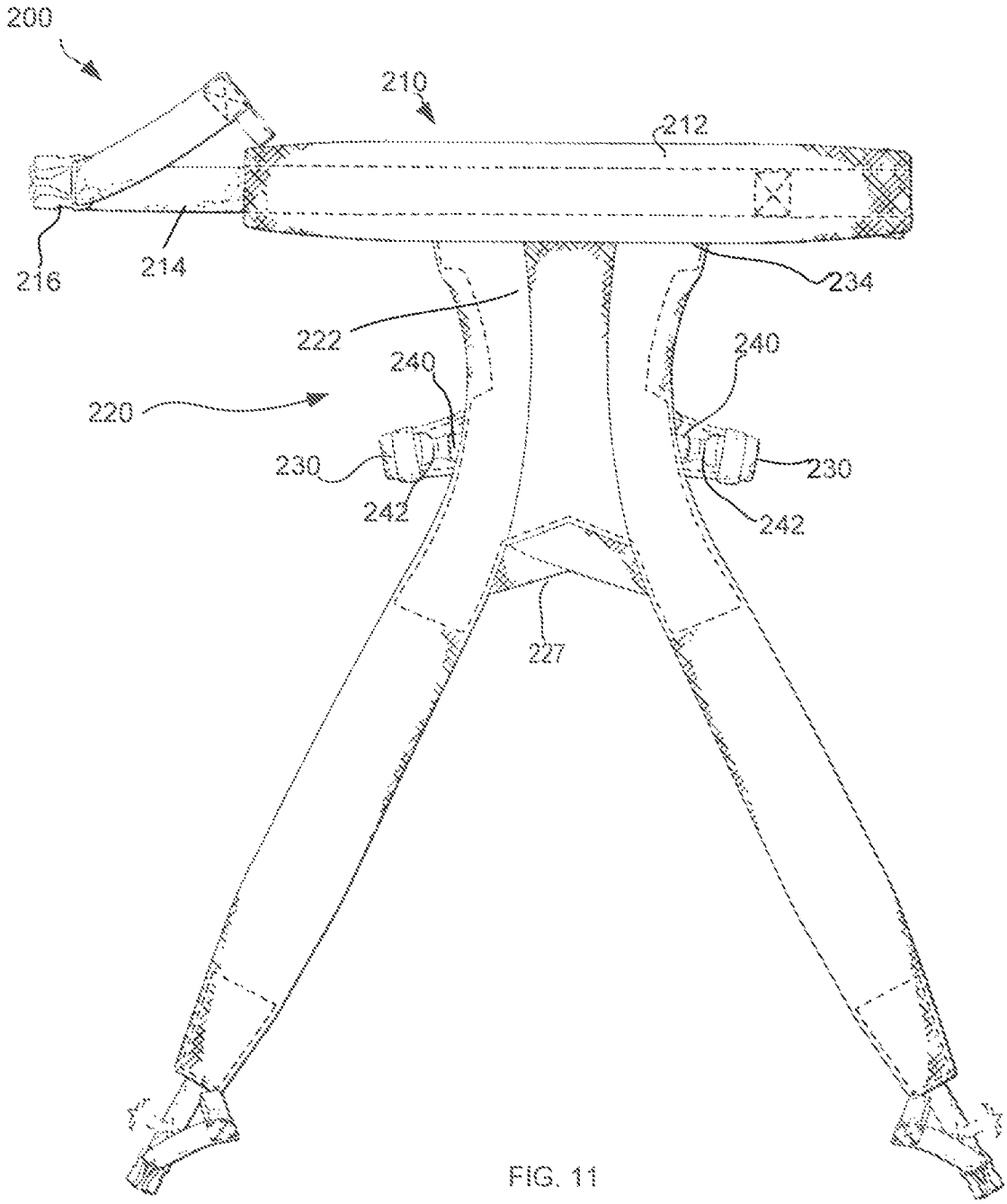
FIG. 11 is a diagrammatic representation of a second view of one embodiment of a carrier.
Figure 12:
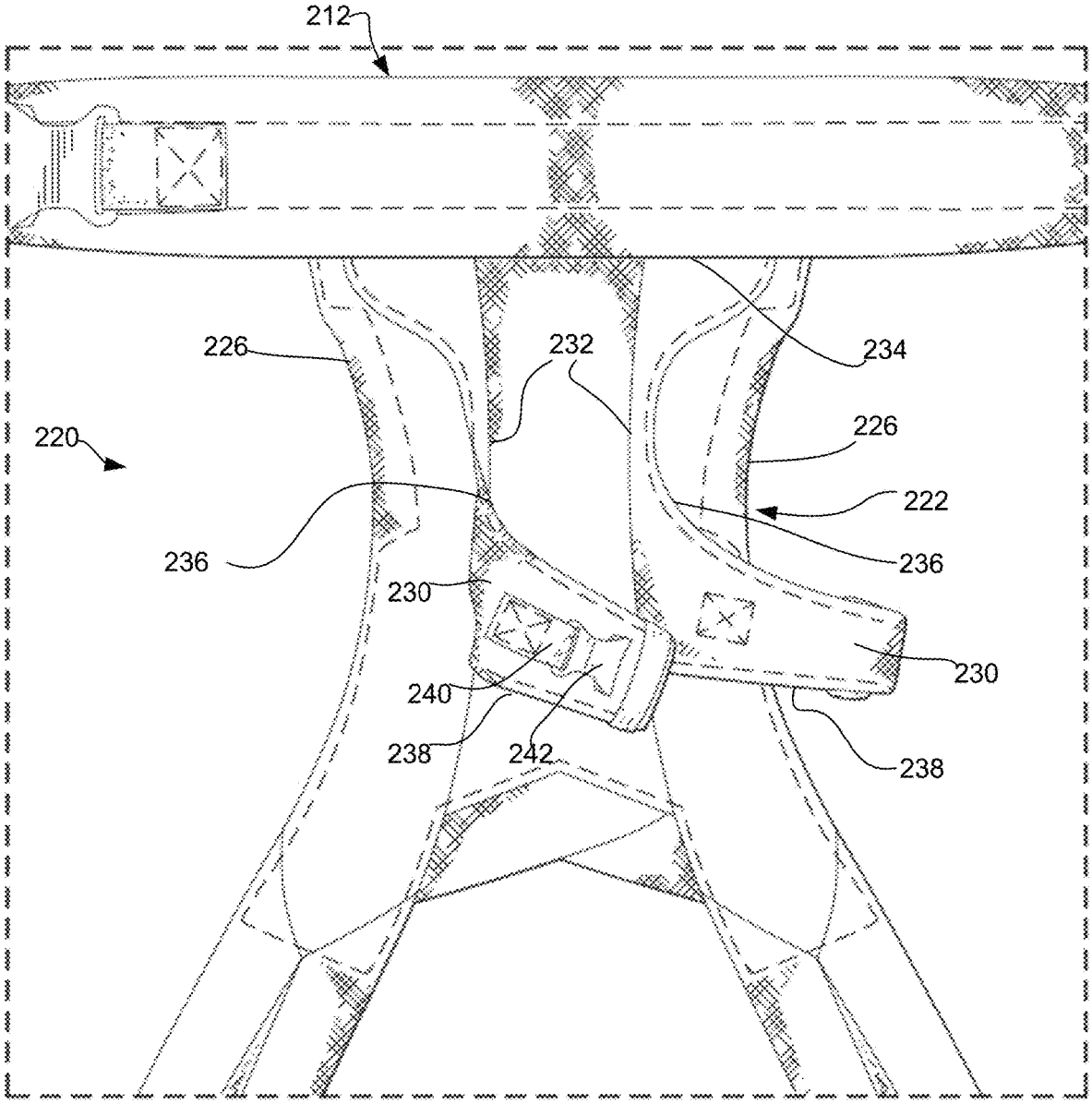
FIG. 12 is a diagrammatic representation of a detail view of one embodiment of a carrier.

FIG. 10 is a diagrammatic representation of a first view of another embodiment of a carrier 200 and FIG. 11 is a diagrammatic representation of a second view of one embodiment of a carrier 200. FIG. 12 is a diagrammatic representation of an interior view of one embodiment of a carrier 200 in more detail. FIG. 10 illustrates the exterior of waistband 210 (the side of the waistband that faces away from the wearer/does not touch the wearer during use) with body panel assembly 220 hanging down from the bottom edge 234 of waistband 210 to expose an interior side the body panel assembly 220 and shoulder straps 260. FIG. 11 illustrates the interior of the waistband 210 (the side of the waistband that faces the wearer/touches the wearer during use) with the body panel assembly 220 hanging down to show the exterior of the body panel assembly 220 and shoulder straps 260.

Waistband 210 comprises a band of one or more sections to encircle a wearer and a fastening mechanism, such as a buckle, snaps, ties or other mechanism, to fasten the band. In the illustrated embodiment, waistband 210 comprises a padded section 212, strap sections 214 sewn or otherwise attached to padded sections 212 and complementary buckle members 216 attached to strap sections 214. Padded section 212 is adapted to encircle the hips of the wearer when the carrier is worn. Padded section 212 can be padded, for example, with a semi-rigid material and covered with fabric. This material can be stiff foam, or any other appropriate material known or convenient, including closed cell foams such as ethylene-vinyl acetate (also known as EVA). The semi-rigid material and the wide shape of the padded section 212 serves to distribute the weight of the child around waist of the wearer. Limited adjustment of the waist belt length is provided by an adjusting loop formed at one of the buckle members. In another embodiment, the waistband comprises a relatively narrow waist belt sized to fit entirely around a user's waist and a belt pad disposed along a portion of the belt to provide the padded section 212.

Body panel assembly 220 is adapted to form a child carrying area in cooperation with the wearer's torso. To this end, body panel assembly 220 comprises a body panel 222 (e.g., a front panel) that may be adapted to form a curved shape that supports the legs, hips, posterior and upper body of the child. Body panel 222 includes an end proximate to waistband 210 (referred to as the "bottom end" of body panel 222), opposed side edges 226 and a top end 227. The bottom end of body panel 222 is sewn or otherwise attached to the bottom portion of waistband 210, for example at or near the bottom edge of padded section 212. Moving away from waistband 210, the outer side edges 226 of body panel 222 are shaped such that the body panel width (indicated generally at 228) changes along at least a portion of the body panel 222. According to one embodiment, the outer side edges 226 curve or otherwise taper laterally inward from a width at the waistband 210 to a minimum body panel width and then curve or otherwise taper latterly outward again. According to one embodiment, the minimum body panel width occurs at a distance from the bottom end of body panel 222. The minimum body panel width, location of the minimum body panel width and the shape of side edges 226 can be selected to create desired carrier shapes in the multiple configurations.

In general, body panel 222, at least proximate to waistband 210, may be formed of an easily foldable textile construction. Body panel 222 may be formed from one or more panels joined together. For example, body panel 222 may include a center panel and side panels. Body panel 222 can be formed of a single material or multiple materials. For example, body panel 222 may be formed with an interior layer selected for comfort against a child's skin and an outer layer selected for breathability, fashion, stain resistance, etc. In some embodiments, body panel 222 and other portions of carrier 200 may incorporate engineered knitting to shape the carrier. For example, the center portion of the body panel may be shaped using engineered knitting. In some embodiments, the entire body panel 222 is shaped using seamless engineered knitting. In such an embodiment, body panel 222 can be constructed such that there are no seams or darts on the body of the carrier and all body shape is achieved through knitting.

According to one embodiment, each shoulder strap 260 is sewn or otherwise coupled to body panel assembly 220 at a respective first point, which may be referred to as an upper attachment point because it is an upper attachment point when the carrier is in use, and second point, which may be referred to as a lower attachment point or side attachment point. In the illustrated embodiment, each shoulder strap 260 extends from an upper corner or portion of body panel 222.

The shoulder straps 260 are adapted to lift body panel assembly 220 and pull body panel assembly 220 toward the wearer to create the child carrying area. In the embodiment illustrated, each shoulder strap 260 has a portion that extends from an upper corner or portion of body panel 222 to a buckle member 264. The buckle member 264 connects to a respective buckle member 242, which is in turn attached to a webbing tab 240.

According to one embodiment, the shoulder straps 260 may have an expandable width. According to one embodiment, the shoulder straps 260 may have an expandable width. For example, shoulder straps 260 may include material that is folded over to form a slit 262 or other opening that can open/widen to allow the shoulder straps to widen.

Body panel assembly 220 comprises wings, flaps or other mechanism to direct tension or force from the lower shoulder strap attachment points away from the side edge 226, thus reducing the tension on outer edges 226 of body panel 222 during use and allowing greater freedom of movement for the child. In the illustrated embodiment, body panel assembly 220 comprises pair of shoulder strap attachment panels 230 that are sewn or otherwise attached to the interior of the body panel 222. Shoulder strap attachment panels 230 provide lower attachment points for the shoulder straps 260 and are adapted so that force or tension at the lower attachment points is transferred to body panel 222 away from side edges 226.

According to one embodiment, each shoulder strap attachment panel 230 is sewn or otherwise coupled to body panel 222 along an inner side edge 232 to body panel 222 at a position that is away from the outer side edges 226 of body panel 222. Even more particularly, according to one embodiment, the inner side edges 232 are coupled to the body panel 222 closer to the lateral centerline of the body panel than to the respective body panel side edge 226. While the shoulder strap attachment panels 230 of the illustrated embodiment are attached to body panel 222 away from the lateral centerline of body panel 222, the shoulder strap attachment panels 230 may be sewn or otherwise attached to body panel 222 at the lateral centerline in other embodiments.

Shoulder strap attachment panels 230 provide wings or flaps. More particularly, a portion of each shoulder strap attachment panel 230 is free to be pulled (e.g., swing) away from body panel 222. In the illustrated embodiment, the bottom edges, outer side edges 236 and top edges 238 of shoulder strap attachment panels 230 are free and thus shoulder strap attachment panels 230 may swing or otherwise be pulled away from away from body panel 222 (e.g., swing away from body panel 222).

According to one embodiment, all or a portion of each shoulder strap attachment panel 230 may have a width such that, when the carrier is spread open, the width of the carrier at the shoulder strap attachment panels 230 is greater than the width of the body panel 222 at the same distance from the bottom end of the body panel 222. In the illustrated embodiment, the top portions of the shoulder strap attachment panels 230 (the portions proximate to the respective top edges 238 and distal from waistband 210) have a sufficient length that they can extend past the closest body panel side edges 226. The outer edges 236 are cut so that shoulder strap attachment panels 230 are shaped to provide leg openings for a child's legs when shoulder strap attachment panels 230 are pulled away from body panel 222 by the shoulder straps.

Each shoulder strap attachment panel 230 includes an attachment point for a shoulder strap. In the illustrated embodiment, for example, each shoulder strap attachment panel 230 includes an attachment point at which a shoulder strap webbing attachment tab 240 is sewn or otherwise coupled to the exterior side of each shoulder strap attachment panel 230. Buckle members 242 are attached to the shoulder strap webbing attachment tabs 240 so that shoulder straps can be connected to strap webbing attachment tabs 240 using complementary buckle members 264. The shoulder strap attachment point on each shoulder strap attachment panel 230—that is, the point where the shoulder strap webbing attachment tab 240 is sewn or otherwise coupled to the shoulder strap attachment panel 230 in the illustrated embodiment—is located on a portion of the shoulder strap attachment panel 230 that can swing or otherwise move away from body panel 222. In some embodiments, the shoulder strap attachment point on each shoulder strap attachment panel 230 is latterly inboard of the respective side edge 226. Furthermore, the shoulder strap side attachment point on each shoulder strap attachment panel 230 is located so that it is farther away from the bottom edge of body panel 222 than the narrowest portion of body panel 222. In other embodiments, the attachment point may be located outboard of the respective side edge 226 and/or in another location relative to the narrowest part of the body panel 222.

FIG. 12 illustrates a view of the interior of one embodiment of body panel assembly 220 with a shoulder strap attachment panel 230 partially folded over. Side shoulder webbing attachment tab 240, is sewn or otherwise attached to shoulder strap attachment panel 230, which is sewn or otherwise attached to the interior of the body panel 222, as opposed to the outside edge 226 of body panel 222. Thus, the force or tension from the respective shoulder strap at the shoulder strap attachment point on the shoulder strap attachment panel 230 is transferred to the body panel 222 away from the outside edge 226. This results in less tension on the body panel edges 226 to allow for more freedom of movement for the child.

It will be appreciated that shoulder strap attachment panels 230 are provided by way of example and other shapes of shoulder strap attachment panels may be used. Moreover, while shoulder strap attachment panels 230 are illustrated as separate panels, shoulder strap attachment panels 230 may be portions of a single panel that is sewn or otherwise attached to body panel 222 to form shoulder strap attachment panels. Further, shoulder strap attachment panels 230 may have a variety of form factors.

Moreover, the force or tension from a lower shoulder strap attachment point may be directed away from the side edges 226 of a body panel 222 by other mechanisms. For example, in another embodiment the second end of each shoulder strap (e.g., shoulder strap webbing attachment tabs 240 or other shoulder strap portion) may be sewn or otherwise attached directly to the interior of a body panel 222 away from the side edges 226. Thus, it will be appreciated that a variety of mechanisms may be used to reduce tension on the side edges of the body panel. Moreover, various mechanism to reduce tension on the side edges of a panel, such as shoulder strap attachment panels, can be used with a variety of carrier designs. By way of example, attachment panels of various forms or other mechanisms to reduce tension at the side edges of the body panel may be used with a variety of carrier designs, including carriers in which the body panel height and width is adjustable and designs in which the body panel height and width is not adjustable.

Similar to carrier 100, carrier 200 can provide enhanced freedom of movement by reducing tension on the laterally outer edges 226 of the panel 222 (e.g., as discussed in conjunction with FIGS. 9A-9C). Moreover, similar to carrier 100, carrier 200 can be configured to accommodate a child through a range of ages/sizes. For example, that the carrier's configuration can be changed based on how the body panel 222 is positioned and/or folded relative to the waistband 210.

For example, in a configuration suitable for a larger child (e.g., a baby/toddler) body panel 222 is not folded behind waistband 210 but is lifted up to the exterior of the waistband 210. In this configuration, the base width of the carrier—the width of the seat proximate to waistband 210—is relatively wide. More particularly, in this configuration, the body panel 222 is exiting the waistband at the carrier's widest seat width as determined by the width of the bottom edge of body panel 222.

In another configuration, the body panel 222 is pulled up from the bottom of waistband 210 and behind waistband 210 between waistband 210 and the wearer's stomach. The lower portion of the body panel can be folded several times between the waistband 210 and the wearer's stomach, effectively shortening and narrowing the body panel 222. Body panel 222 is effectively shortened because the available height of body panel 222 to support a child is shorter than in the first configuration discussed above. The body panel is effectively narrower because the top edge of waistband 210 intersects the body panel 222 at an area that is narrower than the bottom edge of body panel 222—that is, the body panel 222 is exiting the waistband at a narrower area of body panel 222—creating a narrower base width and, hence, bucket seat than when the carrier is in the first configuration.

In the configuration with body panel 222 pulled up and folded behind waistband 210, the base edge of the seat proximate to the waistband is not fixed to the waistband. Consequently, the side edges of the carrier body panel 222 can be pushed together at the seat base to further narrow the base width of carrier.

Figure 13A:
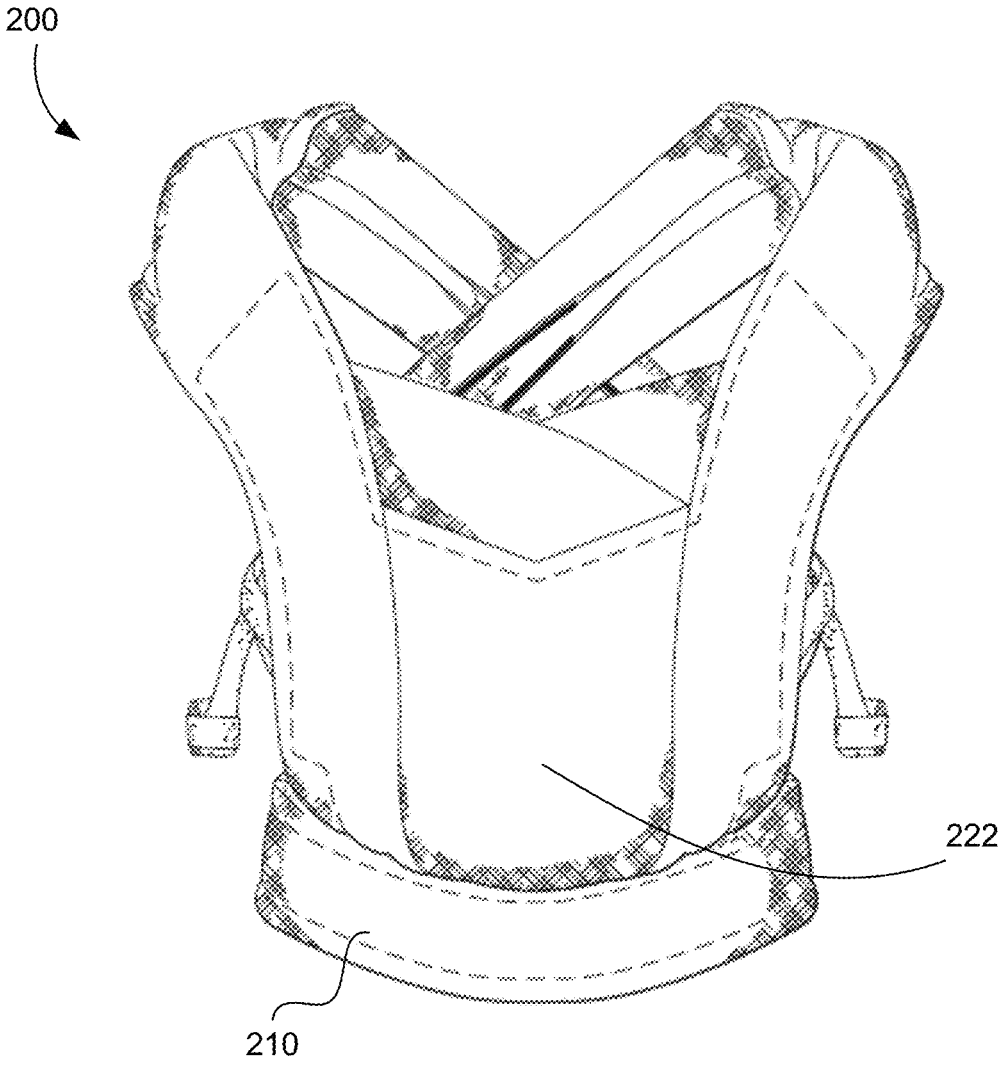
FIG. 13A is a diagrammatic representation of a front view one embodiment of a carrier configured with a narrower base width.
Figure 13B:
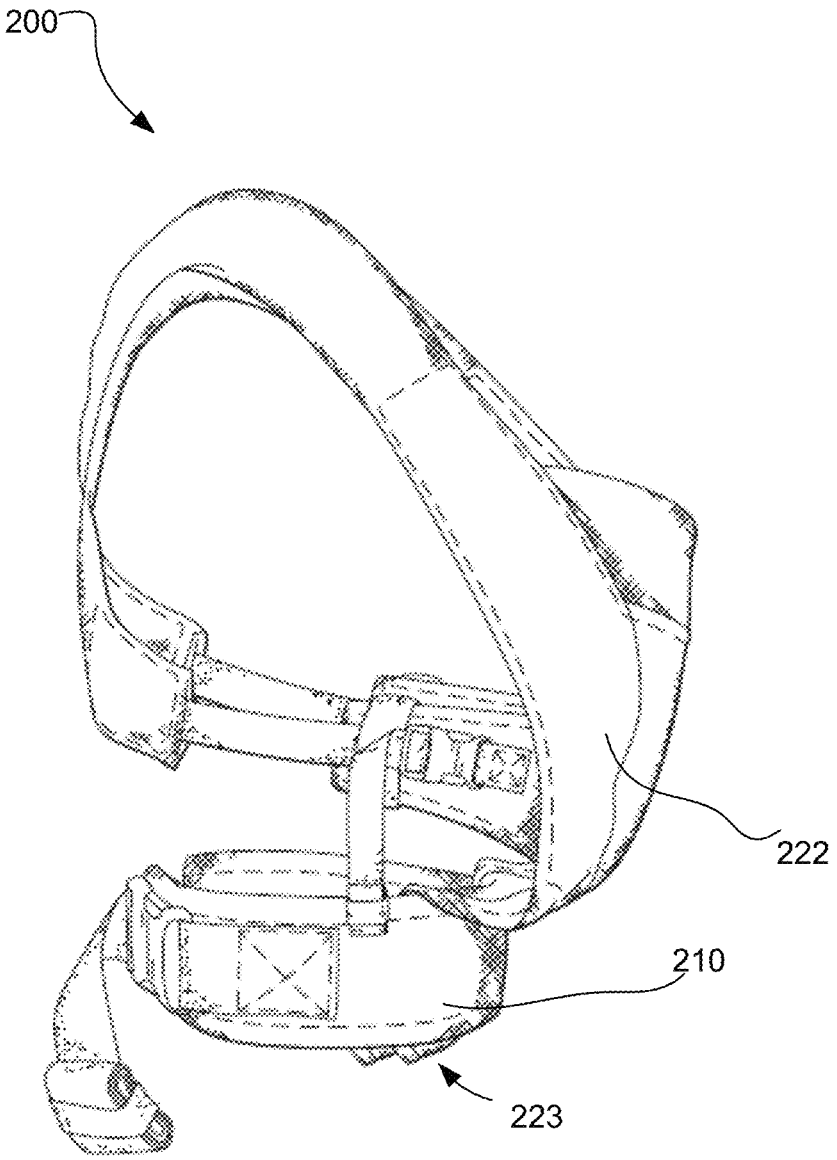
FIG. 13B is a diagrammatic representation of a side view one embodiment of a carrier configured with a narrower base width.
Figure 13C:
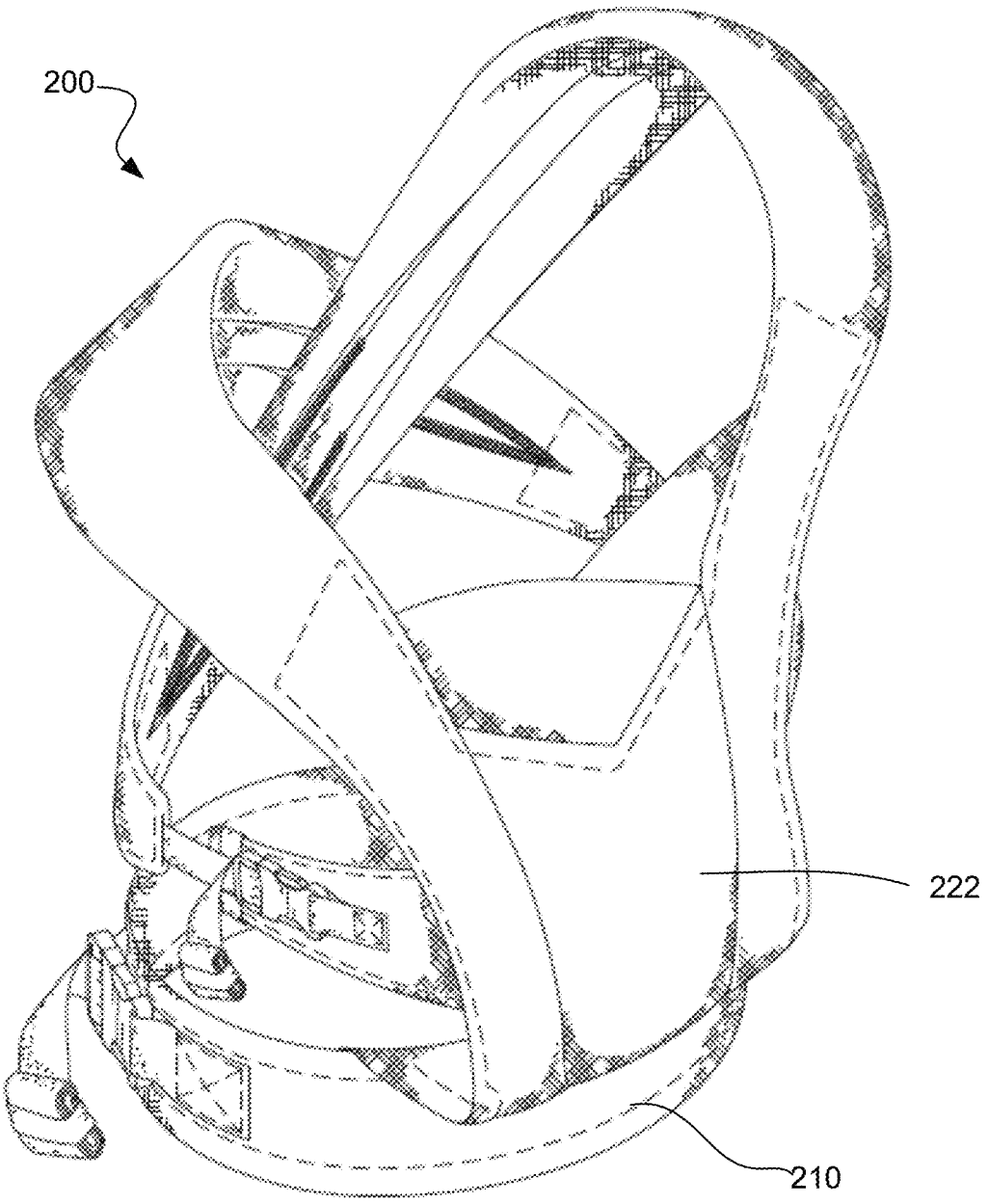
FIG. 13C is a diagrammatic representation of an oblique view one embodiment of a carrier configured with a narrower base width.
Figure 13D:
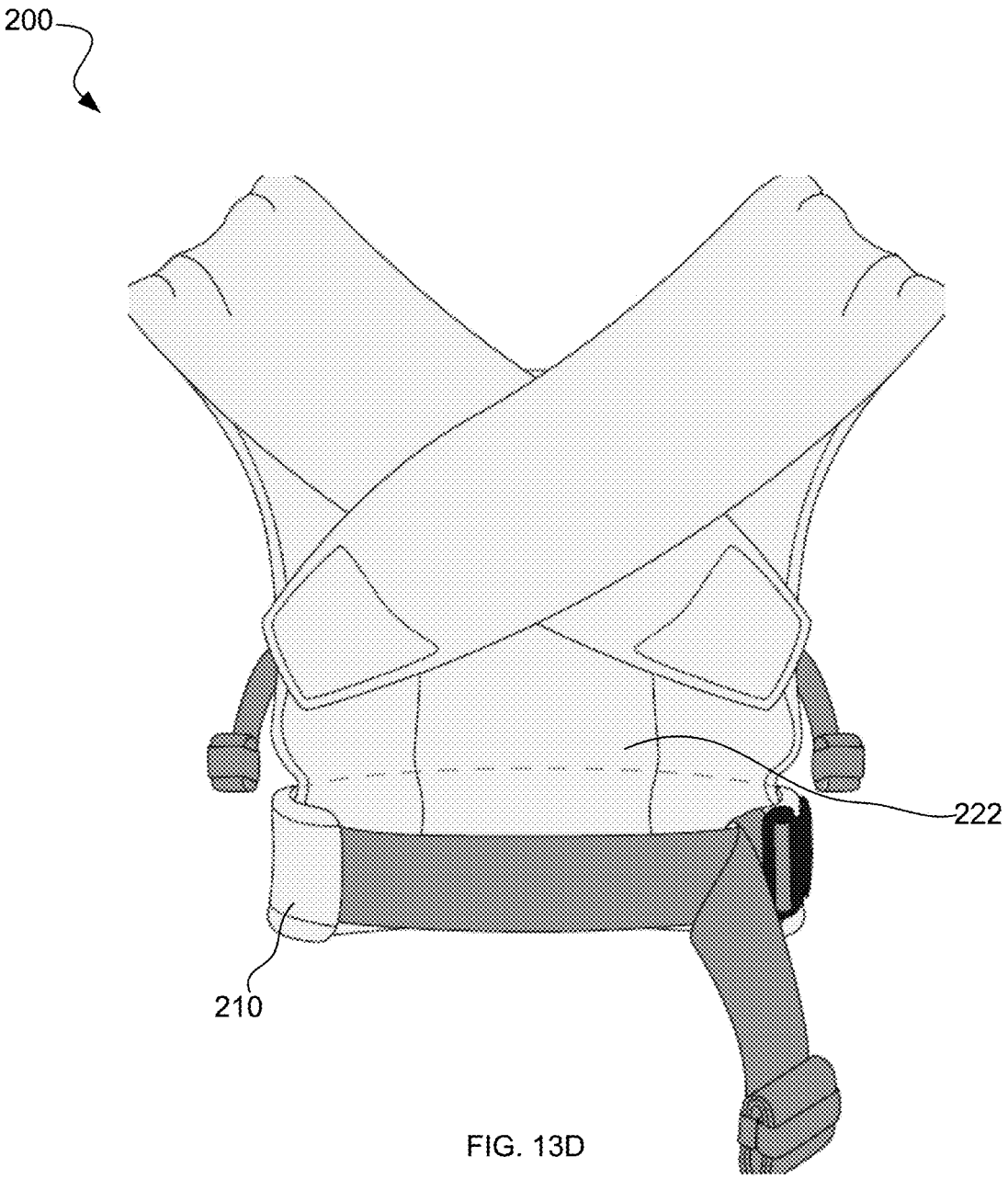
FIG. 13D is a diagrammatic representation of a rear view one embodiment of a carrier configured with a narrower base width.

FIG. 13A, FIG. 13B, FIG. 13C and FIG. 13D illustrate views of one embodiment of carrier 200 with a portion of body panel 122 pulled up and folded behind the waistband to form a shorter carrier with a narrower base width. More particularly, FIG. 13A illustrates a front view of carrier 200, FIG. 13B illustrates a side view of carrier 200, FIG. 13C illustrates an oblique view of carrier 200 and FIG. 13D illustrates a rear view of carrier 200. In FIG. 13B the ends of the folds 223 formed by folding body panel 222 behind the waistband 210 can be seen. According to one embodiment, the carrier as configured in FIGS. 13A-13D is adapted to carrier a newborn or infant in an inward facing orientation, similar to carrier 100 as illustrated in FIG. 5C.

Figure 14A:
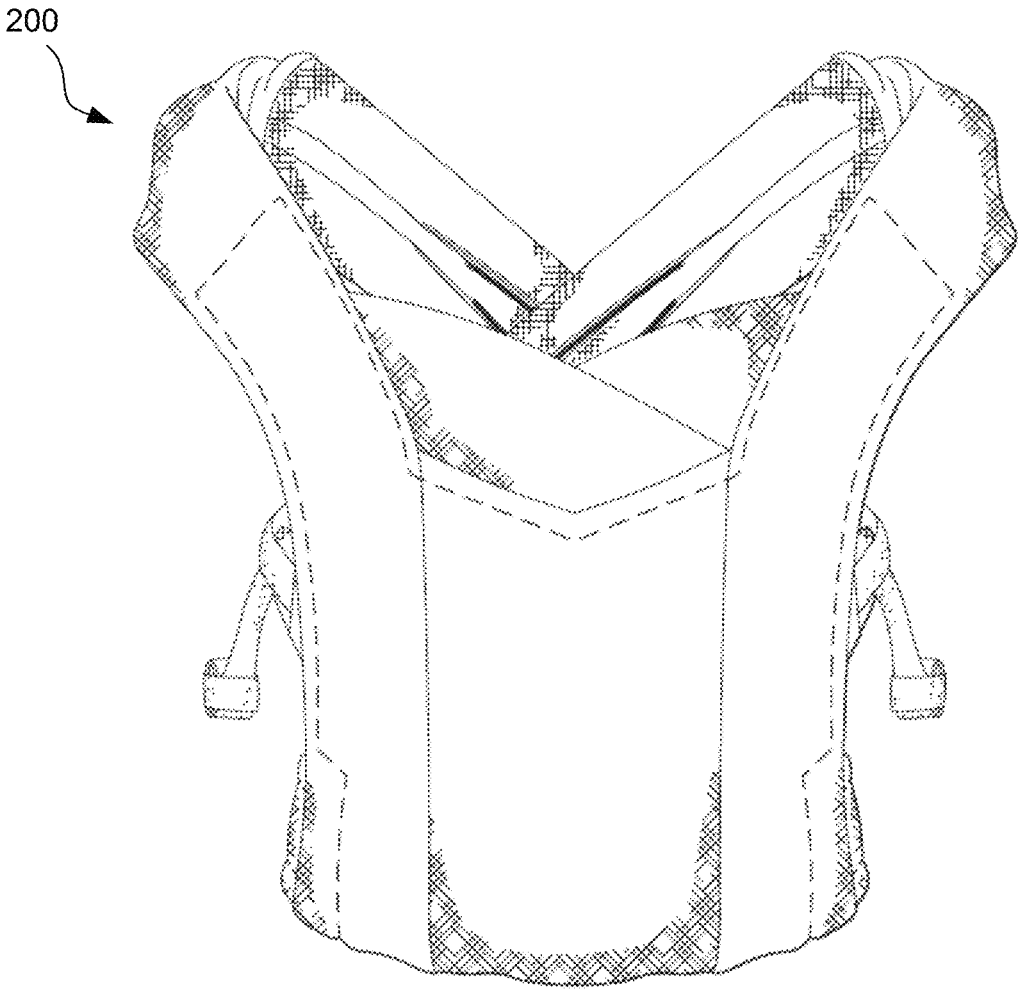
FIG. 14A is a diagrammatic representation of a front view one embodiment of a carrier configured with a wider base width.
Figure 14B:
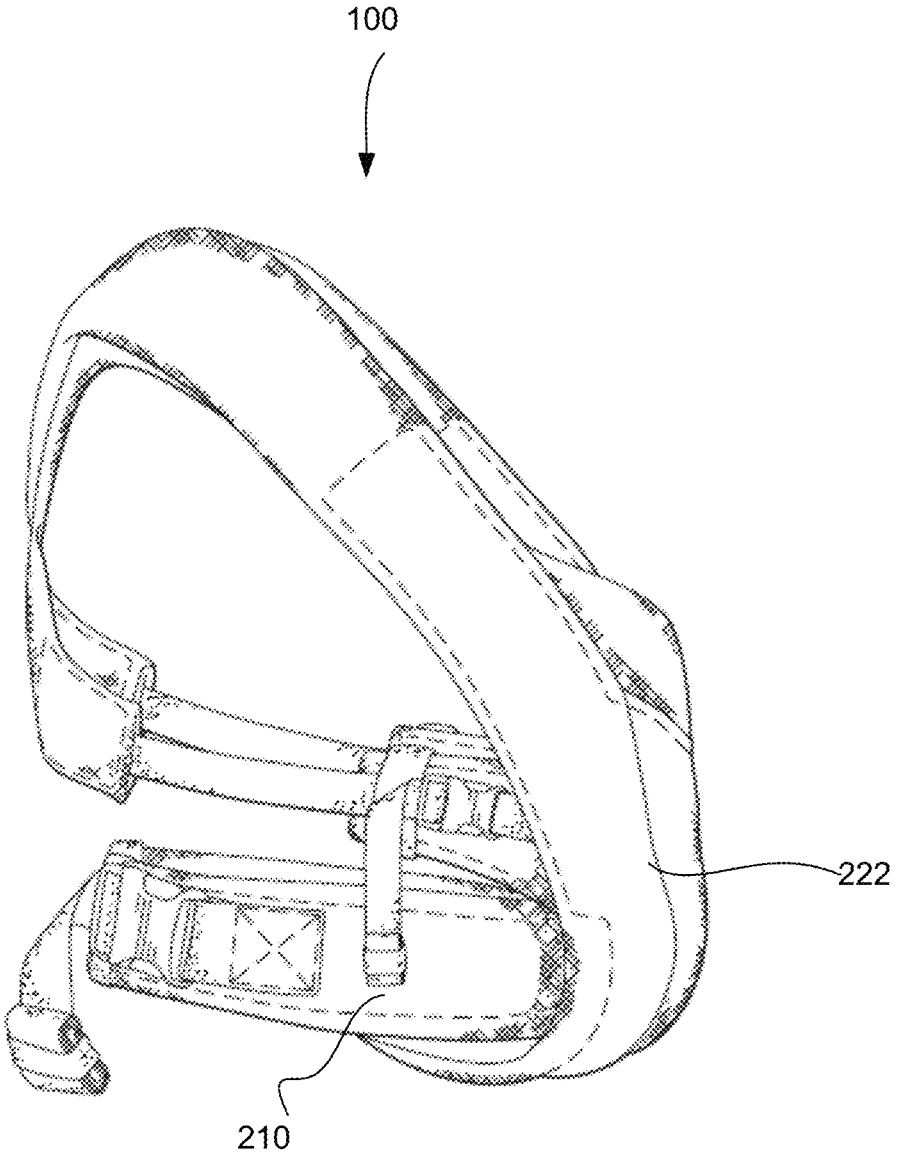
FIG. 14B is a diagrammatic representation of a side view one embodiment of a carrier configured with a wider base width.
Figure 14C:
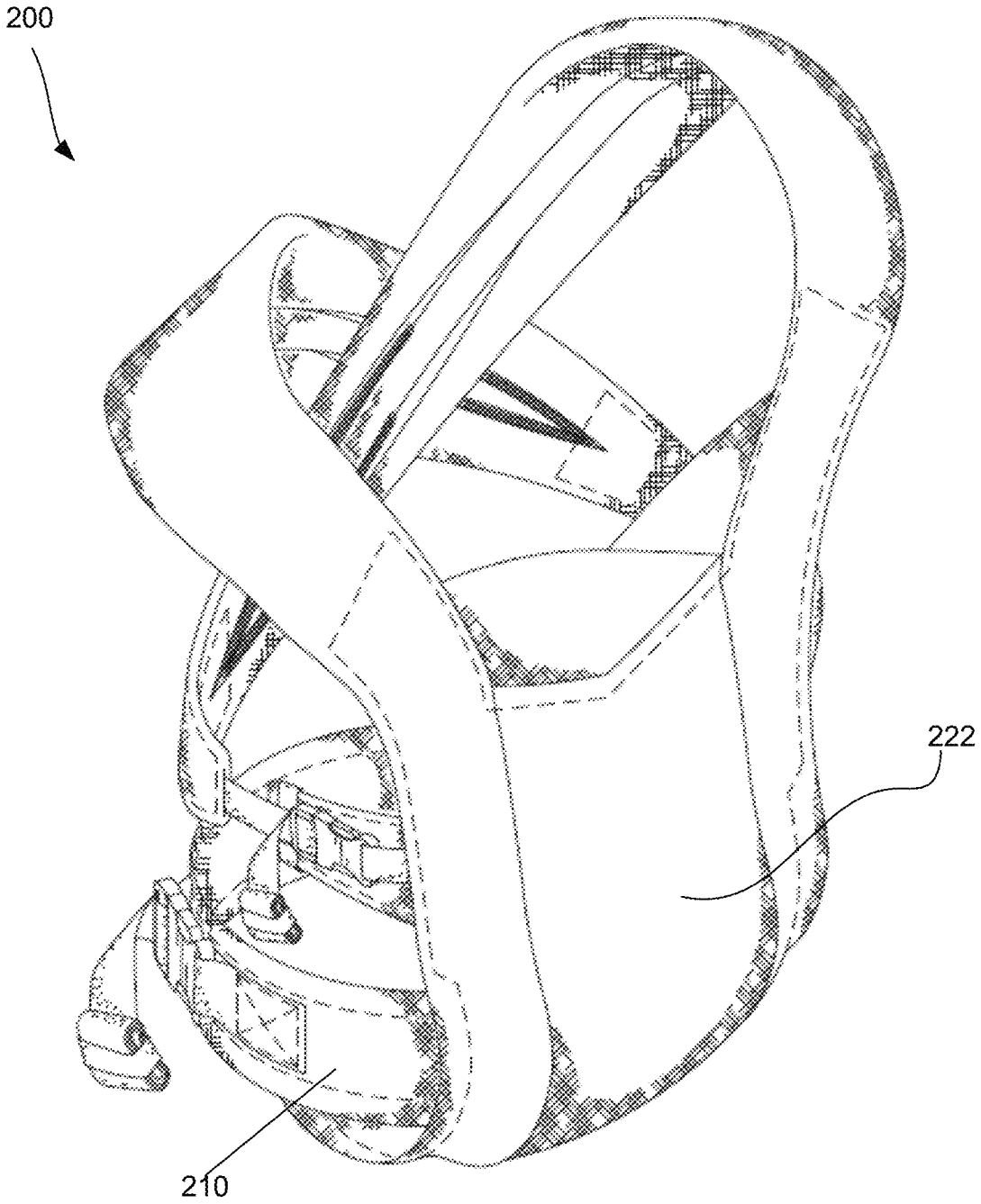
FIG. 14C is a diagrammatic representation of an oblique view one embodiment of a carrier configured with a wider base width.
Figure 14D:
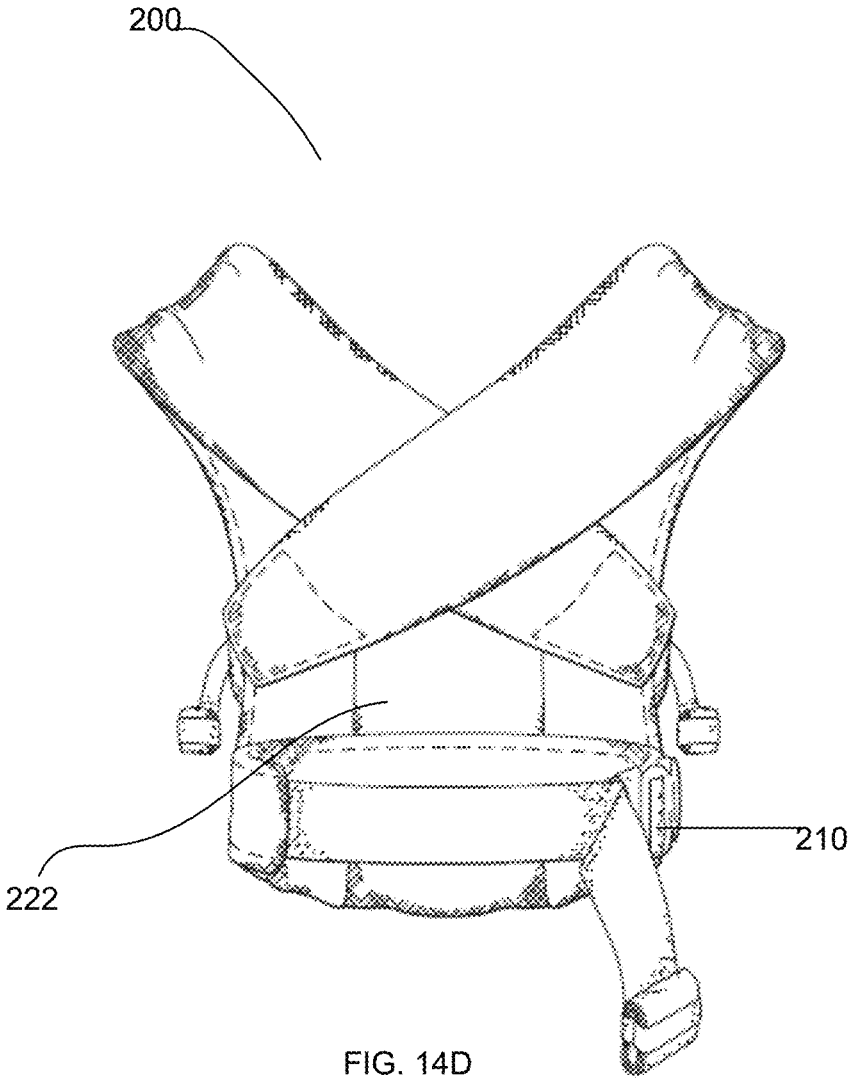
FIG. 14D is a diagrammatic representation of a rear view one embodiment of a carrier configured with a wider base width.

As the child develops, the carrier can be reconfigured to accommodate the child. FIG. 14A, FIG. 14B, FIG. 14C and FIG. 14D illustrates views of one embodiment of carrier 200 with a wider base—that is with the body panel 222 lifted to the front of the waistband 210 and not folded behind the waistband. More particularly, FIG. 14A illustrates a front view of carrier 200, FIG. 14B illustrates a side view of carrier 200, FIG. 14C illustrates an oblique view of carrier 200 and FIG. 14D illustrates a rear view of carrier 200. According to one embodiment, the carrier as configured in FIGS. 14A-14D is adapted to carry a larger child in an inward facing or outward facing orientation, similar to carrier 100 illustrated in FIG. 6C-6E.

In one embodiment, carrier 200 is adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

Carrier 200 is adapted to provide a supportive bucket seat with a generally concave (e.g., "C" shape) inner profile. The minimum body panel width, position of the minimum body panel width and the shape of the side edges 226 can be selected such that body panel 222 can create multiple bucket seat configurations to ergonomically support a child through a range of ages/sizes and in multiple seating orientations. The side panels can be shaped so that the outer edge 226 is shorter than the inside/center edge of the side panel. In use, the outer side edges 226 can be higher than the center of the seat and spaced such that the they pass under and around the child's thighs at a distance from the child's hips to lift the child's legs (e.g., above the knee). In some embodiments, additional support or padding may be placed proximate to edges 226 at the areas that will support a child's thighs.

According to one embodiment, carrier 200 is adapted so that the bucket seat formed in the narrower base width configuration can ergonomically support newborns and infants. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position (also known as the "frog leg", "frog", "squat spread" or "M" position) in which the flexion at the hip joint is at least 90° and in some cases is 110° to 120° from the coronal plane with the knees spread as appropriate for the developmental stage. In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

In another configuration (e.g., a wider base configuration), the carrier can be adapted to support the larger child in a spread squat position with the child's femur approximately 90° to 120° (or other elevated position) from the coronal plane and to position the child's knees with an amount of spreading. The amount of spreading may depend on the developmental stage of the child and orientation of the child in the carrier. In one embodiment, the spreading may be at least 20° degrees from the median plane. The child's weight can be distributed across the child's bottom, thighs and back so that the sacrum does not bear too much weight. Further, the carrier can support the child's spine with a level of curvature appropriate of the child's developmental stage. It can be noted, however, that the child can be positioned in any comfortable position, preferably emphasizing a supportive posture rather than a posture where the child is primarily sitting on his or her sacrum.

Carrier 200 may be adjusted to provide ergonomic support for the child regardless of the size of the child through a supported range. In accordance with one embodiment, carrier 100 can be set for an infant with a narrower seat configuration. In this configuration, the bucket seat will be at its deepest with higher walls at the thigh support areas, lifting the child's thighs and knees to a greater angle and into a spread squat position appropriate for that size child. Similar to carrier 100 in FIG. 8A, carrier 200 can achieve a maximum c-shape and thigh angle appropriate for an infant.

Similarly, carrier 200 can be set for a larger child with the seat at its widest setting. In this configuration, the bucket seat may be at its shallowest depth with lower walls at the thigh support areas, lifting the child's thighs and knees to a lesser angle and into a spread squat position appropriate for a larger sized child. Similar to carrier 100 as depicted in FIG. 8B-FIG. 8D, carrier 200 can provide appropriate support for the child's development.

Thus, the adjustable bucket seat is configurable in a plurality of configurations having different seat bucket depths and seat bucket widths. The different configurations can be adapted to support a child in a corresponding size range in a spread squat position. For example, in one embodiment, bucket seat can have a configuration adapted to ergonomically carry a child of 20-24 inches (generally corresponding to an infant of 0-3 months and over 7 pounds) in a spread squat position appropriate for the infant without requiring an infant insert. Furthermore, the carrier can have another configuration adapted to ergonomically carry a larger child in a spread squat position appropriate for that child's size. The configuration for carrying newborns/infants can correspond to the seat width being at the narrowest setting and the configuration for carrying larger children can correspond to the seat width being at a widest setting (shallowest bucket seat) (a toddler mode). It can be noted that the ranges provided above are provided by way of example and not limitation. Furthermore, the seat may have other configurations.

The user can thus adjust carrier 200 to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The carrier can be adjusted to form a sling or pouch that is wider than the child's hips.

It can be noted that panel 222 is provided by way of example and panel 222 can have a variety of form factors. Moreover, a carrier with height and/or width adjustment according to the teachings of the present disclosure may have a variety of shoulder strap configurations. In one embodiment, for example, the lower/side attachment shoulder strap attachment points may occur on body panel 222 at or proximate to the side edges 226. Such an embodiment, while possibly exhibiting increased tension at the side edges, would still provide the advantage of easy height/width adjustment to ergonomically support a child through a range of ages/sizes.

Moreover, in some embodiments carrier 200 includes a retaining strap on the front of the waistband so that the bottom portion of body panel 122 can be folded between the waistband and retaining strap rather than between the waistband and the wearer. Other retaining mechanisms, such as snaps, retaining loops may also be used to maintain body panel 122 in a folded configuration.

Figure 15:
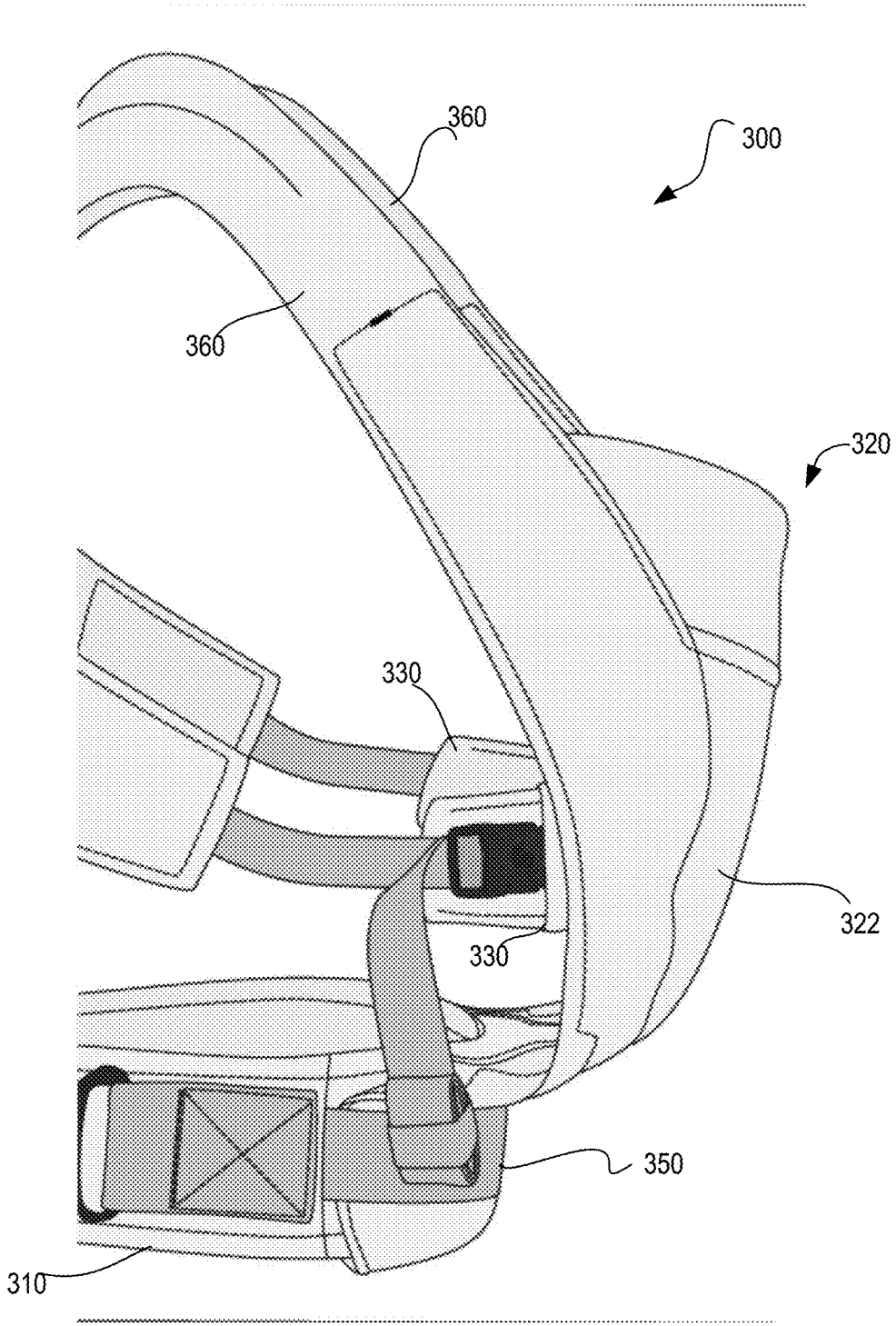
FIG. 15 is a diagrammatic representation of another embodiment of a carrier.
Figure 16:
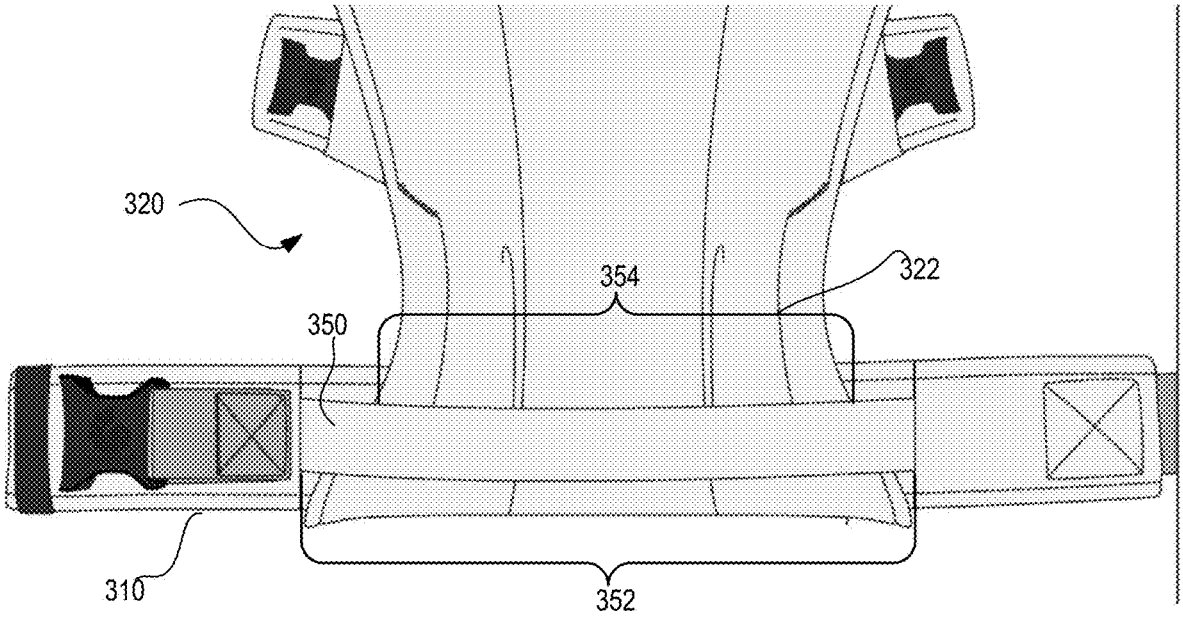
FIG. 16 is a diagrammatic representation of one embodiment of a carrier configured to have a narrower base width.

FIG. 15 and FIG. 16 illustrate one embodiment of a carrier 300 that includes a waistband 310, a body panel assembly 320, shoulder straps 360 and a panel retaining strap 350. Carrier 300 can be generally similar to carriers 100, 200 and incorporate various features discussed above. In particular, carrier 300 includes the capability to achieve multiple bucket seat configurations suitable to support a child in a spread squat position appropriate for that size child, such as discussed above in conjunction with carriers 100, 200.

In the illustrated embodiment, carrier 300 includes a horizontal retaining strap 350 formed of webbing or the like attached to the midsection of waistband 310. Between the attached ends, retaining strap 350 is not attached to the waistband and thus comprises an open length 352. According to one embodiment, the open length 352 is approximately as long as the width of body panel 322 where body panel 322 is attached to waistband 310. In other embodiments, open length 352 is longer or shorter than the bottom width of body panel 322.

Body panel 322 can be folded up between the front of waistband 310 and panel retaining strap 350. With body panel 322 folded up, the base width of the resulting bucket seat is the width of body panel 322 where body panel 322 exits from between waistband 310 and panel retaining strap. For example, in the configuration of FIG. 16, the resulting bucket seat has a base width as indicated at 354.

Thus, the bottom portion of body panel 322 can be folded up between retaining strap 350 and waistband 350 to selectively narrow the base width of the bucket seat and shorten the effective height of the carrier. The material, length, attachment points, and tension in retaining strap 350 are selected such that, when carrier 300 is worn, there is sufficient tension in retaining strap 350 to retain body panel 322 under expected loads.

In the embodiment illustrated, the bottom portion of body panel 322 folds such that body panel 322 run up between the waistband and retaining strap without additional folds between the waistband 310 and retaining strap 350, in other embodiments, the carrier is constructed such that the bottom portion of a body panel can be folded multiple times (e.g., between a retaining strap and waistband or using another retaining mechanism).

Similar to as discussed above with respect to carriers 100, 200, body panel 322 can also be lifted up to the front of the waistband 310 and retaining strap 350 to achieve another configuration—that is, a configuration in which body panel 322 is not fed or folded between retaining strap 350 and waistband 310. In such a configuration, the effective height of the body panel (the height of the body panel used to support the child) is longer and the seat base is wider. The second configuration can be adapted to ergonomically support a larger child.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein and throughout the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the invention.

What is claimed is:

1. A soft-structured child carrier comprising:

a waistband having a bottom portion;

a body panel having a bottom end, a top end, a first side edge and a second side edge, an interior surface on an interior side and an exterior surface on an exterior side, the bottom end of the body panel attached to the waistband at the bottom portion of the waistband;

a first shoulder strap adapted to lift a first top corner of the body panel;

a second shoulder strap adapted to lift a second top corner of the body panel;

a first shoulder strap attachment panel that comprises a first laterally inner portion that is attached to the interior side of the body panel away from the waistband and away from the first side edge and second side edge, the first shoulder strap attachment panel providing a first flap that is movable away from the interior surface of the body panel to wrap during use from between a child being carried and the inner surface of the body panel to a first side of the child, the first flap comprising a first lower attachment point for the first shoulder strap; and a second shoulder strap attachment panel that comprises a second laterally inner portion that is attached to the interior side of the body panel away from the waistband and away from the first side edge and second side edge, the second shoulder strap attachment panel providing a second flap that is movable away from the interior surface of the body panel to wrap during use from between the child and the inner surface of the body panel to a second side of the child, the second flap comprising a second lower attachment point for the second shoulder strap.

2. The soft-structured child carrier of claim 1, wherein:

the first side edge is to a first side of a lateral centerline of the body panel, and the first shoulder strap attachment panel is attached to the body panel to the first side of the lateral centerline closer to the lateral centerline than to the first side edge; and the second side edge is to a second side of the lateral centerline of the body panel, and the second shoulder strap attachment panel is attached to the body panel to the second side of the lateral centerline closer to the lateral centerline than to the second side edge.

3. The soft-structured child carrier of claim 1, wherein the first shoulder strap attachment panel is adapted to protect a child carried in the soft-structured child carrier from the first shoulder strap and the second shoulder strap attachment panel is adapted to protect the child from the second shoulder strap.

4. The soft-structured child carrier of claim 1:

wherein the first shoulder strap attachment panel comprises a first shoulder strap attachment panel exterior side and the first lower attachment point is disposed on the first shoulder strap attachment panel exterior side; and wherein the second shoulder strap attachment panel comprises a second shoulder strap attachment panel exterior side and the second lower attachment point is disposed on the second shoulder strap attachment panel exterior side.

5. The soft-structured child carrier of claim 4, further comprising:

a first webbing tab attached to the first shoulder strap attachment panel at the first lower attachment point;

a first buckle member attached to the first webbing tab;

a second webbing tab attached to the second shoulder strap attachment panel at the second lower attachment point; and a second buckle member attached to the second webbing tab, wherein the first shoulder strap comprises a first shoulder strap portion extending from the first top corner of the body panel to a third buckle member, the third buckle member adapted to connect to the first buckle member, and wherein the second shoulder strap comprises a second shoulder strap portion extending from the second top corner to a fourth buckle member, the fourth buckle member adapted to connect to the second buckle member.

6. The soft-structured child carrier of claim 1, wherein the first shoulder strap attachment panel is adapted to form a first leg opening for a child when pulled away from the body panel by the first shoulder strap and the second shoulder strap attachment panel is adapted to form a second leg opening for the child when pulled away from the body panel by the second shoulder strap.

7. The soft-structured child carrier of claim 1, wherein body panel has a first body panel width at the bottom end of the body panel and a second body panel width away from the waistband, the second body panel width being less than the first body panel width.

8. The soft-structured child carrier of claim 7, wherein the first lower attachment point and second lower attachment point are farther away from the bottom end of the body panel than the second body panel width.

9. The soft-structured child carrier of claim 8, wherein the second body panel width is a minimum body panel width.

10. The soft-structured child carrier of claim 1, wherein the body panel is adapted to form a bucket seat, the bucket seat having a base width at the waistband.

11. The soft-structured child carrier of claim 10, wherein the body panel comprises a foldable portion that is adapted to fold between the waistband and a wearer to reduce an effective height of the body panel and the base width of the bucket seat.

12. The soft-structured child carrier of claim 11, wherein, along the foldable portion, the distance between the first side edge and second side edge narrows, moving away from the waistband.

13. The soft-structured child carrier of claim 1, wherein the waistband has a top edge and an exterior side of the waistband that faces away from a wearer during use, and wherein the body panel is configurable in a plurality of configurations relative to the waistband, the plurality of configurations comprising:

a first configuration in which the body panel is lifted up by the first shoulder strap and second shoulder strap to the exterior side of the waistband and is not folded between the waistband and the wearer, the first configuration forming a first bucket seat with a first base width; and a second configuration in which a portion of the body panel is folded between the waistband and the wearer and the body panel exists from behind the waistband at the top edge of the waistband, the second configuration forming a second bucket seat with a second base width.

14. The soft-structured child carrier of claim 13, wherein the first base width is wider than the second base width.

15. The soft-structured child carrier of claim 13, wherein the first configuration is adapted to support a larger child in a first spread squat position and the second configuration is adapted to support a smaller child in a second spread squat position.

16. The soft-structured child carrier of claim 13, wherein the body panel has a first body panel width at the bottom end of the body panel and a second body panel width away from the waistband and wherein the first base width is equal to the first body panel width and the second base width is equal to the second body panel width.

17. The soft-structured child carrier of claim 1, further comprising a panel retaining strap attached to an exterior side of the waistband that faces away from a wearer during use, wherein:

the body panel is configurable in a plurality of configurations relative to the waistband, the plurality of configurations comprising:

a first configuration in which the body panel is lifted up by the first shoulder strap and second shoulder strap to the exterior side of the waistband and is not folded between the waistband and the wearer, the first configuration forming a first bucket seat with a first base width; and a second configuration in which a portion of the body panel is folded between the waistband and the panel retaining strap, the second configuration forming a second bucket seat with a second base width.

18. The soft-structured child carrier of claim 17, wherein the first base width is wider than the second base width.

19. The soft-structured child carrier of claim 17, wherein the first configuration is adapted to support a larger child in a first spread squat position and the second configuration is adapted to support a smaller child in a second spread squat position.

20. The soft-structured child carrier of claim 17, wherein the body panel has a first body panel width at the bottom end of the body panel and a second body panel width away from the waistband and wherein the first base width is equal to the first body panel width and the second base width is equal to the second body panel width.

* * * * *